US009384716B2

(12) United States Patent
Okuda

(10) Patent No.: US 9,384,716 B2
(45) Date of Patent: Jul. 5, 2016

(54) AUTOMATIC KEY ADJUSTING APPARATUS AND METHOD, AND A RECORDING MEDIUM

(71) Applicant: CASIO COMPUTER CO., LTD., Shibuya-ku, Tokyo (JP)

(72) Inventor: Hiroko Okuda, Kokubunji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 108 days.

(21) Appl. No.: 14/175,915

(22) Filed: Feb. 7, 2014

(65) Prior Publication Data

US 2015/0228270 A1 Aug. 13, 2015

(51) Int. Cl.

| | |
|---|---|
| ***A63H 5/00*** | (2006.01) |
| ***G10H 1/00*** | (2006.01) |
| ***G10H 1/38*** | (2006.01) |
| ***G10H 1/42*** | (2006.01) |

(52) U.S. Cl.

CPC ..... *G10H 1/0008* (2013.01); *G10H 1/38* (2013.01); *G10H 1/42* (2013.01); *G10H 2210/005* (2013.01); *G10H 2210/331* (2013.01); *G10H 2210/576* (2013.01)

(58) Field of Classification Search

CPC ..... G10K 15/04
USPC ..... 84/609
See application file for complete search history.

(56) References Cited

U.S. PATENT DOCUMENTS

| | | | | |
|---|---|---|---|---|
| 5,296,644 | A | 3/1994 | Aoki | |
| 7,297,859 | B2 * | 11/2007 | Ueki | G10H 1/0008 84/600 |
| 7,671,267 | B2 * | 3/2010 | Hillborg | G10H 1/0025 84/609 |
| 8,314,320 | B2 * | 11/2012 | Okuda | G10H 1/38 84/609 |
| 2012/0073423 | A1 | 3/2012 | Okuda | |
| 2013/0025437 | A1 * | 1/2013 | Serletic | G10H 1/0025 84/634 |
| 2013/0305907 | A1 * | 11/2013 | Kakishita | G10H 1/38 84/613 |

FOREIGN PATENT DOCUMENTS

| | | | |
|---|---|---|---|
| CN | 102419969 | A | 4/2012 |
| CN | 103093747 | A | 5/2013 |
| JP | 3099436 | B2 | 10/2000 |
| JP | 2007041234 | A | 2/2007 |
| JP | 2011-158855 | A | 8/2011 |
| JP | 2012-068548 | A | 4/2012 |

(Continued)

OTHER PUBLICATIONS

Chinese Office Action dated Aug. 8, 2014, issued in counterpart Chinese Application No. 201210432371.8.

(Continued)

*Primary Examiner* — Jianchun Qin
(74) *Attorney, Agent, or Firm* — Holtz, Holtz & Volek PC

(57) ABSTRACT

An automatic key adjusting apparatus is provided, which determines keys on an input melody in real time and adjusts the determined keys in non real time to obtain accurate keys, thereby enhancing accuracy of placement of chords. The automatic key adjusting apparatus is provided with a keyboard for playing a melody of a musical piece. CPU judges keys on the melody in real time based on a history of pitches of the played melody of the musical piece, and adjusts the result of the key judgment in non real time after the melody of the musical piece is played.

17 Claims, 44 Drawing Sheets

(56) References Cited

FOREIGN PATENT DOCUMENTS

| | | | |
|---|---|---|---|
| JP | 2013-073112 | A | 4/2013 |
| JP | 2013-076908 | A | 4/2013 |
| JP | 2013-097302 | A | 5/2013 |

OTHER PUBLICATIONS

U.S. Appl. No. 13/245,230, Title: "Key Determination Apparatus and Storage Medium Storing Key Determination Program", filed Sep. 26, 2011, First Named Inventor: Hiroko Okuda.

* cited by examiner

FIG. 22

2200

CM

| | C | D | E | F | G | Ab | A | B |
|---|---|---|---|---|---|---|---|---|
| C | C C | C D | C E | C F | C G | C Ab | C A | C B |
| D | D C | D D | D E | D F | D G | D Ab | D A | D B |
| E | E C | E D | E E | E F | E G | E Ab | E A | E B |
| F | F C | F D | F E | F F | F G | F Ab | F A | F B |
| G | G C | G D | G E | G F | G G | G Ab | G A | G B |
| Ab | Ab C | Ab D | Ab E | Ab F | Ab G | Ab Ab | Ab A | Ab B |
| A | A C | A D | A E | A F | A G | A Ab | A A | A B |
| B | B C | B D | B E | B F | B G | B Ab | B A | B B |

PM

FIG. 23

2300

2310 2311 2301 2302 2322 2321

| PREVIOUS CHORD FUNCTIONS | SORTS | C D | C E | C F | C G | C Ab | C A | C B | ····· |
|---|---|---|---|---|---|---|---|---|---|
| Tonic | | V Major | I Major | IV Major | I Major | IV m | IV Major | V Major | ····· |
| | jump 1 | V Major | I Major | IV Major | I Major | IV m | IV Major | V Major | ····· |
| | jump 2 | II m | III m | IV Major | V Major | III 7 | IV Major | III m | ····· |
| Sub dominant | | II m7 | I Major | IV Major | I Major | IV m | IV Major | V Major | ····· |
| | jump 1 | II m7 | I Major | II m | I Major | IV m | II m | V Major | ····· |
| | jump 2 | V 7 | VI m | V Major | V Major | III 7 | II m7 | III m | ····· |
| Dominant | | V Major | I Major | V Major | I Major | IV m | VI m | I Major | ····· |
| | jump 1 | V Major | I Major | II m | I Major | IV m | VI m | I Major | ····· |
| | jump 2 | I Major | VI m | IV Major | III m | IV m | IV Major | VI m | ····· |

FIG. 24

2400

2410 2401 2402 2421

| PREVIOUS CHORD FUNCTIONS | C D | C E | C F | C G | C Ab | C A | C B |
|---|---|---|---|---|---|---|---|
| Tonic | IIm7 | I Major | IV Major | I Major | IV m | IVMajor | IM7 |
| Sub dominant | IIm7 | I Major | IV Major | VMajor | IV m | IVMajor | V Major |
| Dominant | VMajor | I Major | IV Major | I Major | IV m | VIm | I Major |

FIG. 25

2500

CM 2521 2511 2522 2513 2501 2503

| PreCH | C | C# | D | Eb | E | F | F# | G | Ab | A | Bb | B |
|---|---|---|---|---|---|---|---|---|---|---|---|---|
| IMajor | CT | | SN | | CT | SN | | CT | | SN | | SN |
| IM7 | CT | | SN | | CT | SN | | CT | | SN | | CT |
| IIm | SN | | CT | | SN | CT | | SN | | SN | | SN |
| IIm7 | CT | | CT | | SN | CT | | SN | | CT | | SN |
| IIm7-5 | CT | | CT | | SN | CT | | SN | CT | | SN | |
| ⋮ | ⋮ | ⋮ | ⋮ | ⋮ | ⋮ | ⋮ | ⋮ | ⋮ | ⋮ | ⋮ | ⋮ | ⋮ |
| IIIMajor | SN | | SN | | CT | | SN | | CT | SN | | CT |
| III7 | SN | | CT | | CT | SN | | | CT | SN | | CT |
| III7sus4 | SN | | CT | | CT | SN | | | SN | CT | | CT |
| ⋮ | ⋮ | ⋮ | ⋮ | ⋮ | ⋮ | ⋮ | ⋮ | ⋮ | ⋮ | ⋮ | ⋮ | ⋮ |

2502

2512

FIG. 26

2600

CM 2601 2611 2612

| PreCH | C | C# | D | Eb | E | F | F# | G | Ab | A | Bb | B |
|---|---|---|---|---|---|---|---|---|---|---|---|---|
| IMajor | | dim | | dim | | | dim | | aug | | aug | |
| IM7 | | dim | | aug | | | aug | | aug | | dim | |
| IIm | | aug | | dim | | | dim | | dim | | aug | |
| IIm7 | | aug | | dim | | | dim | | dim | | aug | |
| .... | .... | .... | .... | .... | .... | .... | .... | .... | .... | .... | .... | .... |

FIG. 39

| | FINAL MELODY TONES | | | | | | | |
|---|---|---|---|---|---|---|---|---|
| MID-KEYS | C | C# | D | Eb | E | F | ··· | B |
| Gb | | | | | | | ··· | |
| Db | | | | | | Db(3) | ··· | |
| Ab | Ab(3) | | | | | | ··· | |
| Eb | | | | | | | ··· | |
| Bb | | | Bb(1) | | | Bb(2) | ··· | |
| F | F(2) | | | | | F(1) | ··· | |
| C | C(1) | | | | C(1) | | ··· | |
| G | | | G(2) | | | | ··· | G(1) |
| D | | | D(3) | | | | ··· | |
| A | | | | | A(2) | | ··· | |
| E | | | | | E(3) | | ··· | E(2) |
| B | | | | | | | ··· | B(3) |

FIG. 40

| | | | | |
|---|---|---|---|---|
| ENDING PART | T | S | D | T |
| | T | S | T | |
| MIDDLE PART | T | S | D | T |
| | T | S | D | |
| | T | D | | |

FIG. 41

| | Major Key | TONIC-KEY SPECIFIC CHORDS | Major Key | TONIC-KEY SPECIFIC CHORDS |
|---|---|---|---|---|
| TONIC KEY | Major | | minor | |
| RELATIVE KEY | minor | | Major | VII7 |
| DOMINANT KEY | Major | V7, IIm | minor | III, III7, VIIm7b5 |
| SUBDOMINANT KEY | Major | V, V7, IIIm | minor | III, III7, VIIm7b5 |
| ⋮ | ⋮ | ⋮ | ⋮ | ⋮ |

FIG. 42

| PATTERNS | FIRST BEAT | SECOND BEAT | THIRD BEAT | FOURTH BEAT |
|---|---|---|---|---|
| ⋮ | ⋮ | ⋮ | ⋮ | ⋮ |
| QUADRUPLE METER APPOGGIATURA | TONES OTHER THAN CHORD COMPOSING TONES | CHORD COMPOSING TONES, AND WHOLE TONE FORM THE FIRST BEAT (OR LOWER (OR HIGHER) BY SEMITONE) | | |
| | | | TONES OTHER THAN CHORD COMPOSING TONES | CHORD COMPOSING TONES, AND WHOLE TONE FORM THE THIRD BEAT (OR LOWER (OR HIGHER) BY SEMITONE |
| ⋮ | ⋮ | ⋮ | ⋮ | ⋮ |

FIG. 43

| Key of C Tonal | C | C# | D | Eb | E | F | F# | G | Ab | A | Bb | B |
|---|---|---|---|---|---|---|---|---|---|---|---|---|
| IMajor | CT | | SN | | CT | SN | | CT | | SN | | SN |
| IM7 | CT | | SN | | CT | SN | | CT | | SN | | CT |
| I6 | CT | | SN | | CT | SN | | CT | | CT | | SN |
| Iadd9 | CT | | CT | | CT | SN | | CT | | SN | | SN |
| Isus4 | CT | | SN | | SN | CT | | CT | | SN | | SN |
| ⋮ | ⋮ | ⋮ | ⋮ | ⋮ | ⋮ | ⋮ | ⋮ | ⋮ | ⋮ | ⋮ | ⋮ | ⋮ |

FIG. 44

| | 1 | 2 | 3 | ··· |
|---|---|---|---|---|
| IMajor | IM7 | I6 | VIm | ··· |
| IIm | IIm7 | IV | IVM7 | ··· |

AUTOMATIC KEY ADJUSTING APPARATUS AND METHOD, AND A RECORDING MEDIUM

CROSS-REFERENCE TO RELATED APPLICATION

The present application is based upon prior Japanese Patent Application No. 2011-242251, filed Nov. 4, 2011, the entire contents of which are incorporated herein by reference.

BACKGROUND OF THE INVENTION

1. Field of the Invention

The present invention relates to an automatic key adjusting apparatus, a method of automatically adjusting keys and a recording medium.

It is general for players of an electronic musical instrument provided with a keyboard, such as an electronic piano and electronic organ to play a melody with their right hands and to play an accompaniment or press plural keys composing a chord with their hands. Therefore, the players of the electronic musical instrument are required to practice to move their right and left hands separately in accordance with a musical scale.

When playing the electronic piano or organ, the players are required to simultaneously move their right and left hands in different ways. To play these instruments, the players are required to do reasonable practice. In particular, there are many beginners, who can move their right hands to play a melody but feel hard to simultaneously move their left hands to play another performance. Therefore, electronic musical instruments are requested, which can automatically create accompaniment sounds that are be played and generated with the player's left hand while the player is playing a melody with his or her right hand.

For example, Japanese Patent Publication No. 3099436 discloses an apparatus, in which musical-note data for every plural intervals is stored, and when a chord name is attached to the musical-note data of the second interval, key data, musical-note date corresponding to the second interval, musical-note date of the first interval, and a chord name previously attached to the second interval are referred to and then a new chord name is determined.

In the above apparatus, the musical notes composing a musical piece are used as one of elements for determining the chords, but these musical notes do not evenly contribute to determination of the chord. For example, the weights given on the musical notes vary depending on which beat the musical notes belong to, and also the weights on the musical notes change depending on their temporal positions in the beat. Therefore, it is preferable to determine the chord depending on the weights given on the musical notes. Further, it is more preferable to refer not only to a single musical note but also a transition of plural musical notes to determine a chord name.

Unexamined Patent Publication 2011-158855 discloses an automatic accompaniment apparatus, which determines appropriate chord names in real time based on the weights given on musical notes composing a musical piece and the transition of the musical notes.

But the real-time chord placement will often use database generated based on experimental rules to determine some chords. Even if a simple musical piece can be attached with accurate chords in the real-time chord placement, but a musical piece using ornament tones and borrowed chords cannot be attached with so accurate chords in the real-time chord placement. This is because the key of the musical piece cannot be judged accurately, when attaching the chords. The key of the musical piece is not always constant, but the key in some musical piece is often modified. When the key has been modified, it is required to judge to which key the key has been altered and to obtain the key, before determining a chord name to be attached.

In general, a history of pitches of the melody composing the musical piece is often used to judge the key of the musical piece. But when the key is to be determined from the melody of musical piece in the real time, less pitch information is contained in the history at the beginning of the musical piece and/or phrases, and therefore it is hard to determine the accurate key in some sorts of musical pieces. To enhance an accuracy of real-time chord placement, it is required to determine the key of the musical piece more accurately in real time.

SUMMARY OF THE INVENTION

An apparatus is provided, which can enhance an accuracy of judgment of keys set to a musical piece played in real time, thereby improving an accuracy of chords placed to the musical piece in real time.

According to one aspect of the invention, there is provided an automatic key adjusting apparatus, which comprises a performance input unit for playing and sequentially inputting a melody of a musical piece, a real-time key judging unit for judging a key of the melody of the musical piece in real time based on a history of pitches of the melody of the musical piece sequentially input by the performance input unit, and a non real-time key modifying unit for modifying the key decided by the real-time key judging unit in non real-time after the melody of the musical piece is played by the performance input unit.

BRIEF DESCRIPTION OF THE DRAWINGS

FIG. 22 is a view of an example of a melody sequence table used in the present embodiment of the invention.

FIG. 23 is a view showing an example of the first chord table used in the present embodiment of the invention.

FIG. 24 is a view showing an example of the second chord table used in the present embodiment of the invention.

FIG. 25 is a view showing an example of a part of a melody function table used in the present embodiment of the invention.

FIG. 26 is a view showing an example of a part of a non verified-chord table used in the present embodiment of the invention.

FIG. 39 is a view showing an example of a key-determination table used in the present embodiment of the invention.

FIG. 40 is a view showing an example of a cadence judgment table used in the present embodiment of the invention.

FIG. 41 is a view showing an example of a relative key borrowing judgment table used in the present embodiment of the invention.

FIG. 42 is a view showing an example of a part of an ornament tone database used in the present embodiment of the invention.

FIG. 43 is a view showing an example of apart of a chord scale table used in the present embodiment of the invention.

FIG. 44 is a view showing an example of apart of a prior chord table used in the present embodiment of the invention.

DETAILED DESCRIPTION OF THE PREFERRED EMBODIMENTS

Figure 1:
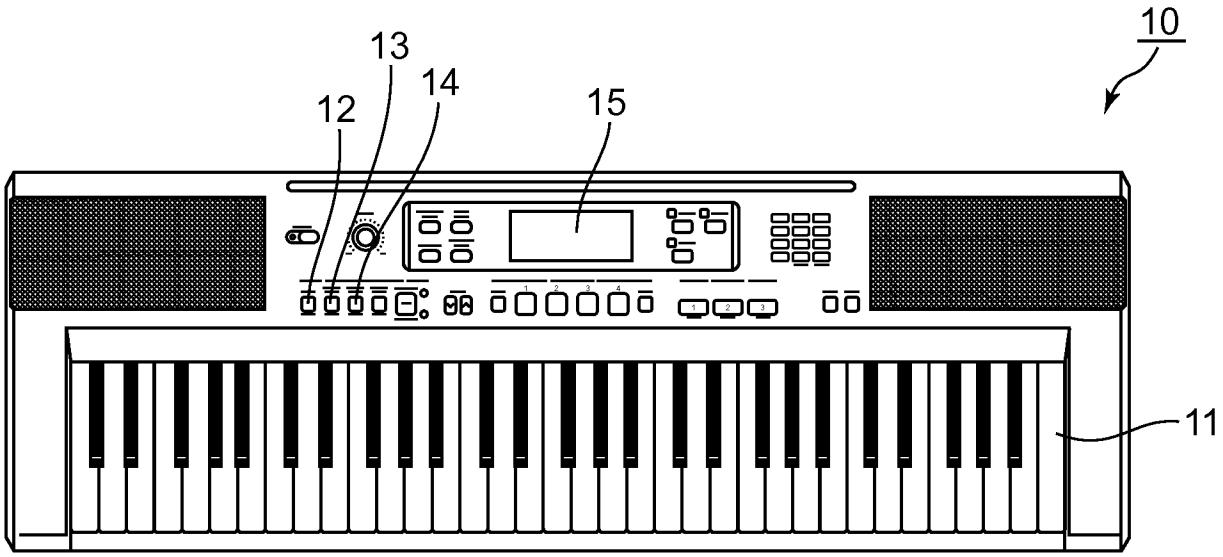
FIG. 1 is an external view of an electronic musical instrument, to which an automatic key adjusting apparatus according to the present invention is applied.

Now, embodiments of the present invention will be described with reference to the accompanying drawings. FIG. 1 is an external view of an electronic musical instrument, to which an automatic key adjusting apparatus according to the embodiment of the present invention is applied. As shown in FIG. 1, the electronic musical instrument 10 according to the present embodiment has a keyboard 11. Further, the electronic musical instrument 10 is provided with switches 12, 13, a non real-time adjustment switch 14, and a displaying unit 15 on the top side of the keyboard 11. The switches 12, 13 are used for designating a tone color, instructing of starting or finishing an automatic accompaniment, and designating a rhythm pattern. The non real-time adjustment switch 14 is used to start a non real-time chording adjustment after a real-time chord placing operation. The displaying unit 15 displays various sorts of information such as tone colors, rhythm patterns, chord names, and so on. For example, the electronic musical instrument 10 according to the present embodiment has 61 keys (C2 to C7). Further, the electronic musical instrument 10 has 2 performance modes: one is an automatic accompaniment mode, in which an automatic accompaniment is operated; and the other is a normal mode, in which the automatic accompaniment is not operated.

Figure 2:
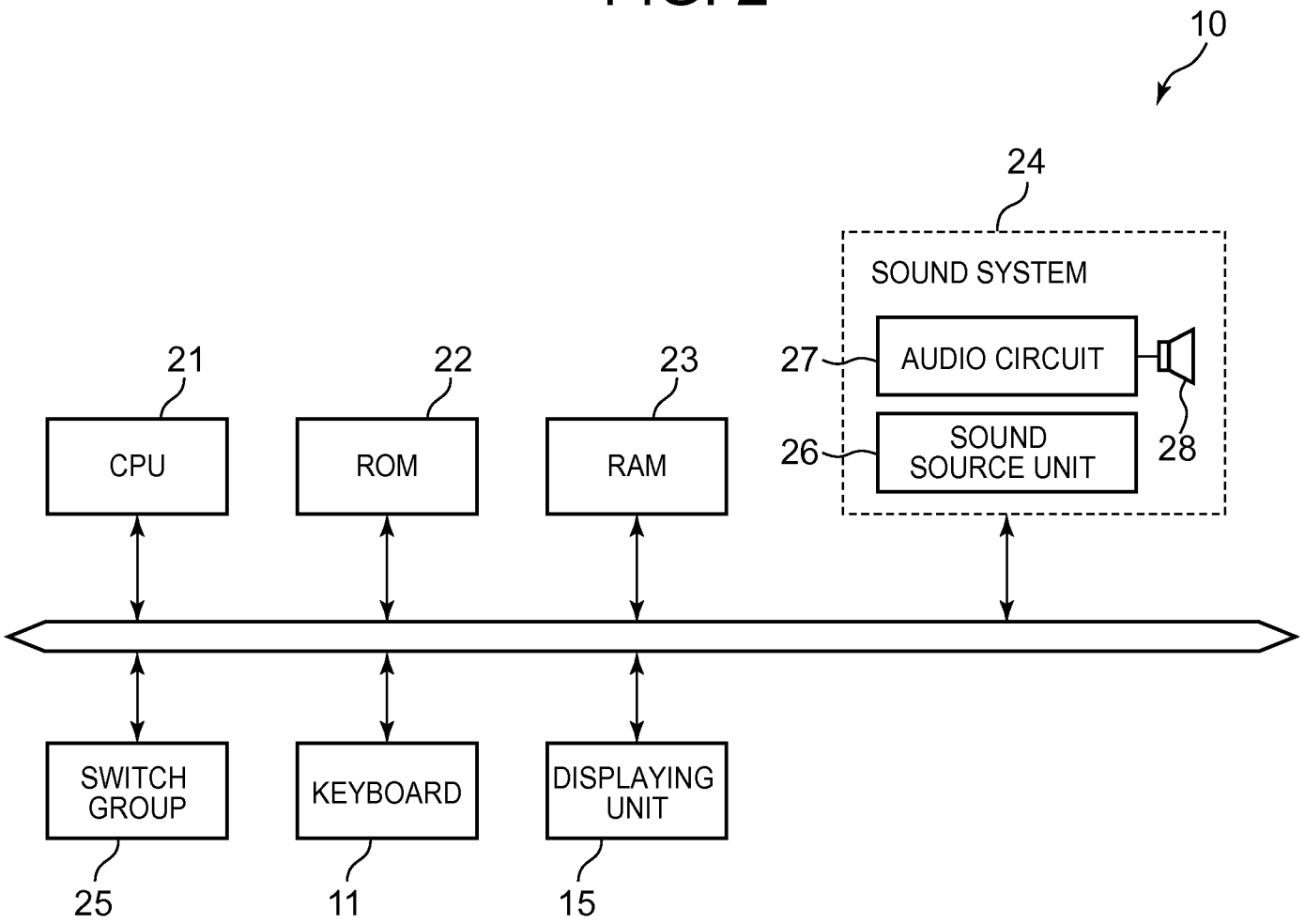
FIG. 2 is a view showing a block diagram of a configuration of the automatic key adjusting apparatus according to the present embodiment.

FIG. 2 is a view showing a block diagram of a configuration of the automatic key adjusting apparatus 10 according to the embodiment of the present invention. As shown in FIG. 2, the automatic key adjusting apparatus 10 according to the embodiment comprises CPU 21, ROM 22, RAM 23, a sound system 24, a switch group 25, the keyboard 11 and the displaying unit 15.

CPU 21 performs various processes, that is, CPU 21 controls the whole operation of the electronic musical instrument 10, detects a key-pressing operation on the keyboard 11 and an operation of the switch(es) involved in the switch group 25, and controls the operation of the sound system 24 in accordance with the operation of the key(s) and the switch(es), and further CPU 21 determines chord names in accordance with pitches of musical tones corresponding to pressed keys, and performs the automatic accompaniment in accordance with automatic accompaniment patterns and the chord names.

ROM 22 serves to store various programs to be run by CPU 21 to perform processes including generation of a musical tone(s) in accordance with the operation of the switch(es) and the pressed key(s) of the keyboard 11, determination of the chord names in accordance with pitches of musical tones corresponding to the pressed keys, and performance of the automatic accompaniment in accordance with the automatic accompaniment patterns and the chord names.

Further, ROM 22 has a waveform data area and an automatic accompaniment pattern area. In the waveform data area is stored waveform data for generating musical tones of pianos, guitars, bass drums, snare drums, and cymbals and in the automatic accompaniment pattern area is stored data (automatic accompaniment data) representing various sorts of automatic accompaniment patterns.

RAM 23 serves to store the program read from ROM 22 and data generated in the course of the performed process. In the present embodiment of the invention, the automatic accompaniment pattern has a chord pattern including composing tones of each chord name, a bass pattern including bass tones, and a rhythm pattern including drum tones. For instance, a data record of the chord pattern and bass pattern includes pitches, generation timings and durations of musical tones. The data record of the rhythm pattern includes tone colors and generation timings of musical tones.

The sound system 24 comprises a sound source unit 26, an audio circuit 27 and a speaker 28. Upon receipt of information of the pressed key(s) or information of the automatic accompaniment patterns, the sound source unit 26 reads related waveform data from the waveform data area of ROM 22, and generates and outputs musical-tone data having certain pitches. The sound source unit 26 is able to output waveform data. Especially, the sound source unit 26 is able to output the waveform data such as sounds of percussion instruments including bass drums, snare drums, and cymbals, as musical-tone data without any modification. The audio circuit 27 converts the musical-tone data into an analog signal and outputs a sound signal through the speaker 28.

The electronic musical instrument 10 according to the present embodiment generates a musical tone in response to a key-pressing operation on the keyboard 11 in the normal mode. Meanwhile, when an automatic accompaniment switch (not shown) is operated, the automatic accompaniment mode is set. In the automatic accompaniment mode, a musical tone of a pitch corresponding to the pressed key is generated. Further, a chord name is determined based on the pitches of the pressed keys, and musical tones are generated in accordance with the automatic accompaniment pattern including tones composing the chord of the chord name. Hereinafter, an operation of the electronic musical instrument 10 in the automatic accompaniment mode will be described.

Figure 3:
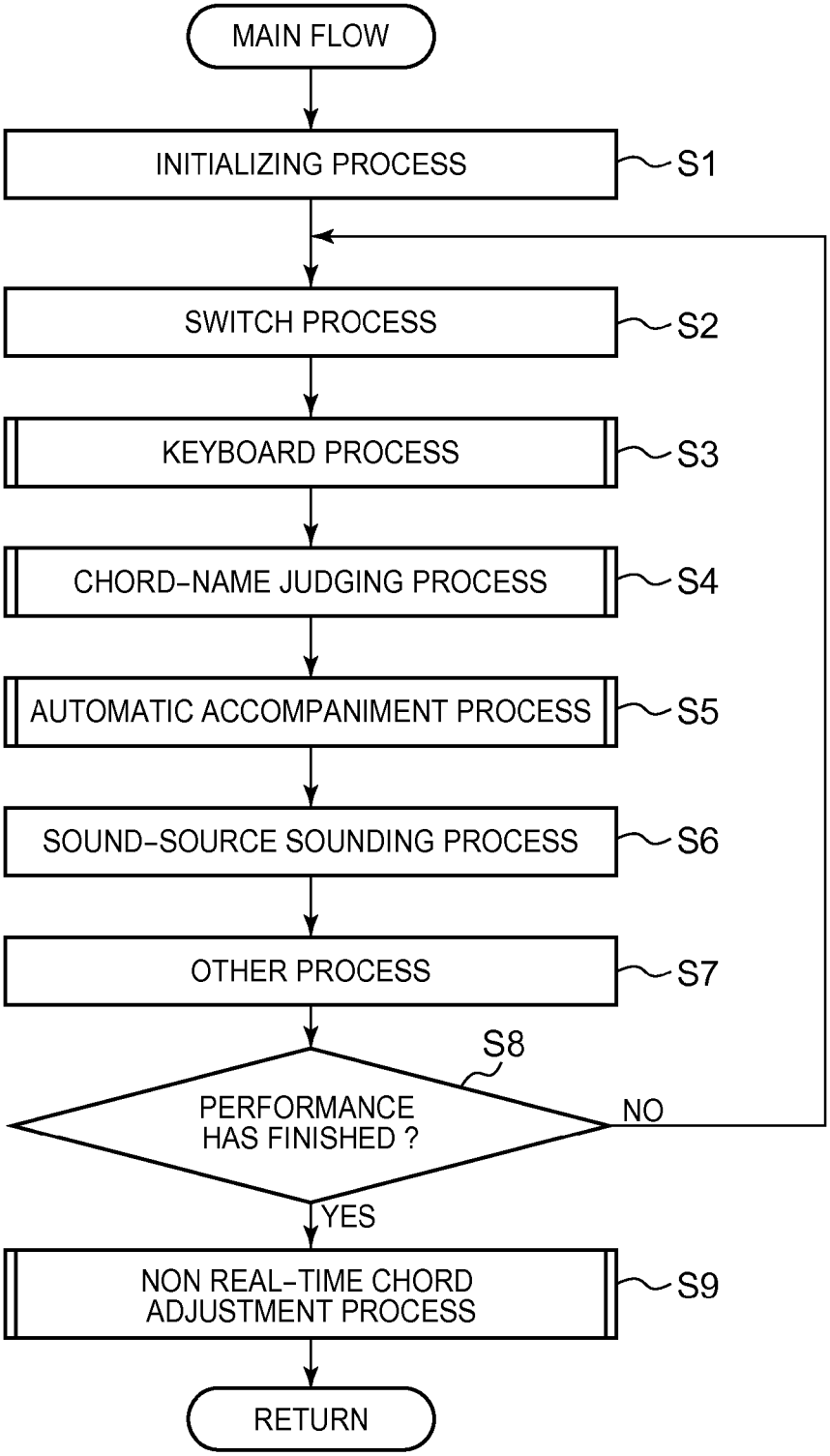
FIG. 3 is a flow chart showing an example of a process performed in the automatic key adjusting apparatus according to the present embodiment.

A process to be performed in the electronic musical instrument 10 according to the present embodiment will be described in more detail. FIG. 3 is a flow chart showing an example of a process to be performed in the automatic key adjusting apparatus according to the present embodiment of the invention. Although not shown in the flow chart, a timer incrementing process is performed at predetermined intervals to increment a counter value of an interruption counter.

When a power is turned on, CPU 21 of the electronic musical instrument 10 performs an initializing process (step S1 in FIG. 3), clearing data in RAM 23 and an image on the displaying unit 15. Then, CPU 21 performs a switch process (step S2), in which operations of the respective switches in the switch group 25 are detected and processes are performed based on the detected operations of the switches.

For instance, in the switch process (step S2), CPU 21 detects operations of various switches such as operations of a tone-color designating switch, automatic-accompaniment pattern designating switch, and automatic-accompaniment pattern on/off designating switch. When the automatic-accompaniment pattern is set to ON, CPU 21 switches the performance mode to the automatic accompaniment mode. Data indicating the performance mode is set in a predetermined area of RAM 23. Data indicating the tone color and the sort of automatic-accompaniment pattern is also stored in a predetermined area of RAM 23.

Figure 4:
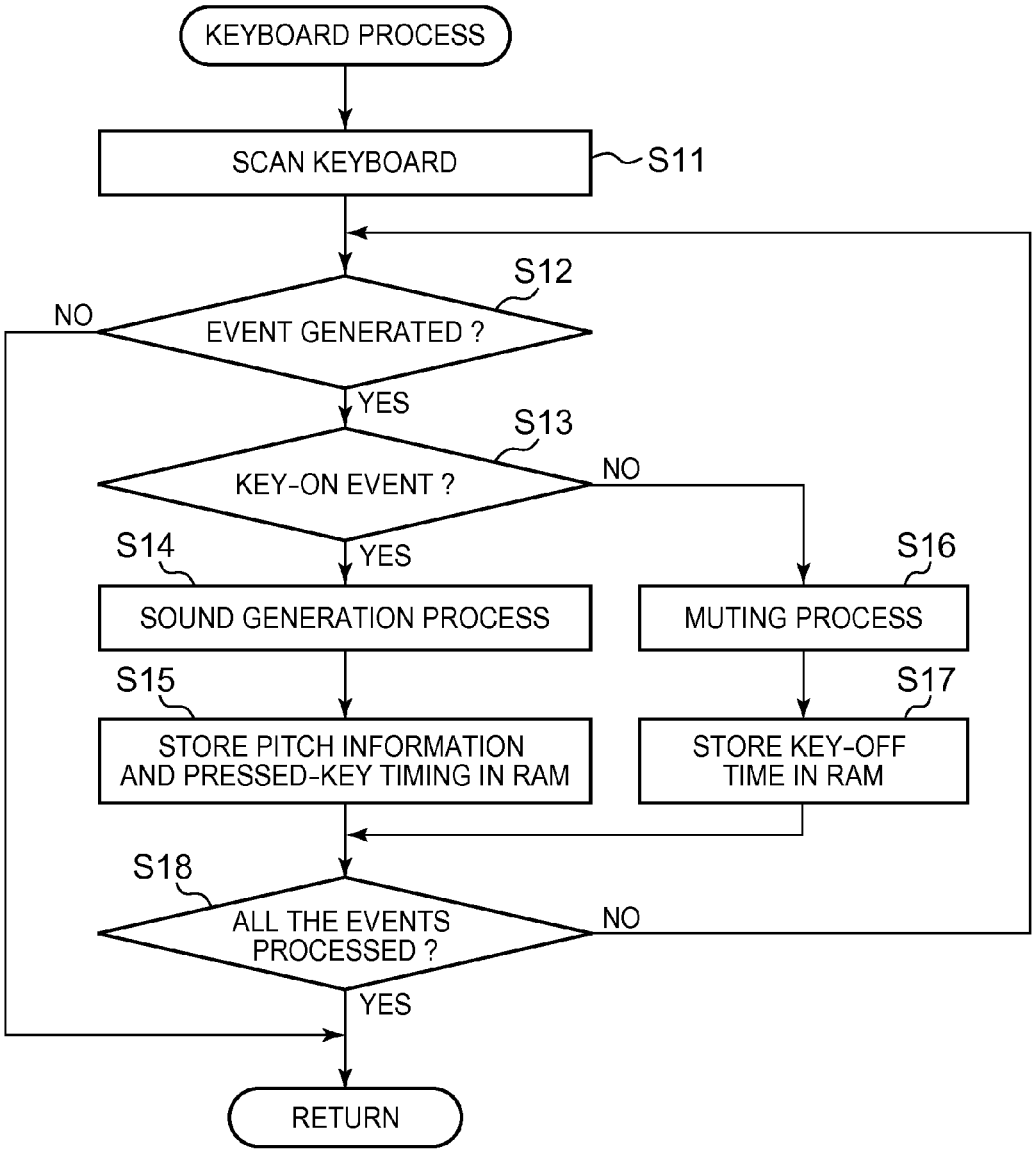
FIG. 4 is a flow chart showing an example of a keyboard process performed in the present embodiment of the invention in more detail.

Then, CPU 21 performs a keyboard process (step S3). FIG. 4 is a flow chart showing the detail of the keyboard process to be performed in the present embodiment. In the keyboard process, CPU 21 sequentially scans the keys of the keyboard 11 (step S11). Referring to the result of the scanning operation, CPU 21 judges whether or not any event has been generated with respect to any key of the keyboard (step S12). When it is determined that an event has been generated with respect to the key (YES at step S12), then CPU 21 judges whether the event is KEY-ON EVENT (pressed key) or not (step S13).

When it is determined that the event is KEY-ON EVENT (pressed key) (YES at step S13), CPU 21 performs a sound generation process corresponding to the pressed key (step S14). In the sound generation process, CPU 21 reads from ROM 22 tone-color data for a melody key and data (pitch data) indicating a pitch corresponding to the key and temporarily stores the tone-color data and pitch data in RAM 23. In a sound-source sounding process (step S6 in FIG. 3) to be described later, CPU 21 supplies the tone-color data and pitch data to the sound source unit 26. The sound source unit 26 reads waveform data from ROM 22 in accordance with the tone-color data and pitch data, generating musical-tone data, whereby outputting a musical tone through the speaker 28.

Thereafter, CPU 21 stores in RAM 23 pitch information (for example, a key number) of the pressed key (KEY-ON key) and a pressed-key timing (for example, a time at which the key has been pressed) (step S15). The pressed-key timing can be counted from a counter value of the interruption counter.

When it is determined that the event is not KEY-ON EVENT (NO at step S13), the generated event is KEY-OFF EVENT (released key). Then, CPU 21 performs a muting process with respect to KEY-OFF key (released key) (step S16). In the muting process, CPU 21 obtains data (pitch data) indicating a pitch from the generated event. In this case, the obtained pitch data is supplied to the sound source unit 26 in the sound-source sounding process (step S6). The sound source unit 26 mutes the musical tone having the pitch based on the supplied pitch data. Thereafter, CPU 21 stores in RAM 23 a time (released time) at which KEY-OFF key (released key) has been released (step S17).

Then CPU 21 judges whether or not the process has been performed on all the KEY-EVENTS (step S18). When it is determined NO, CPU 21 returns to step S12.

Figure 5:
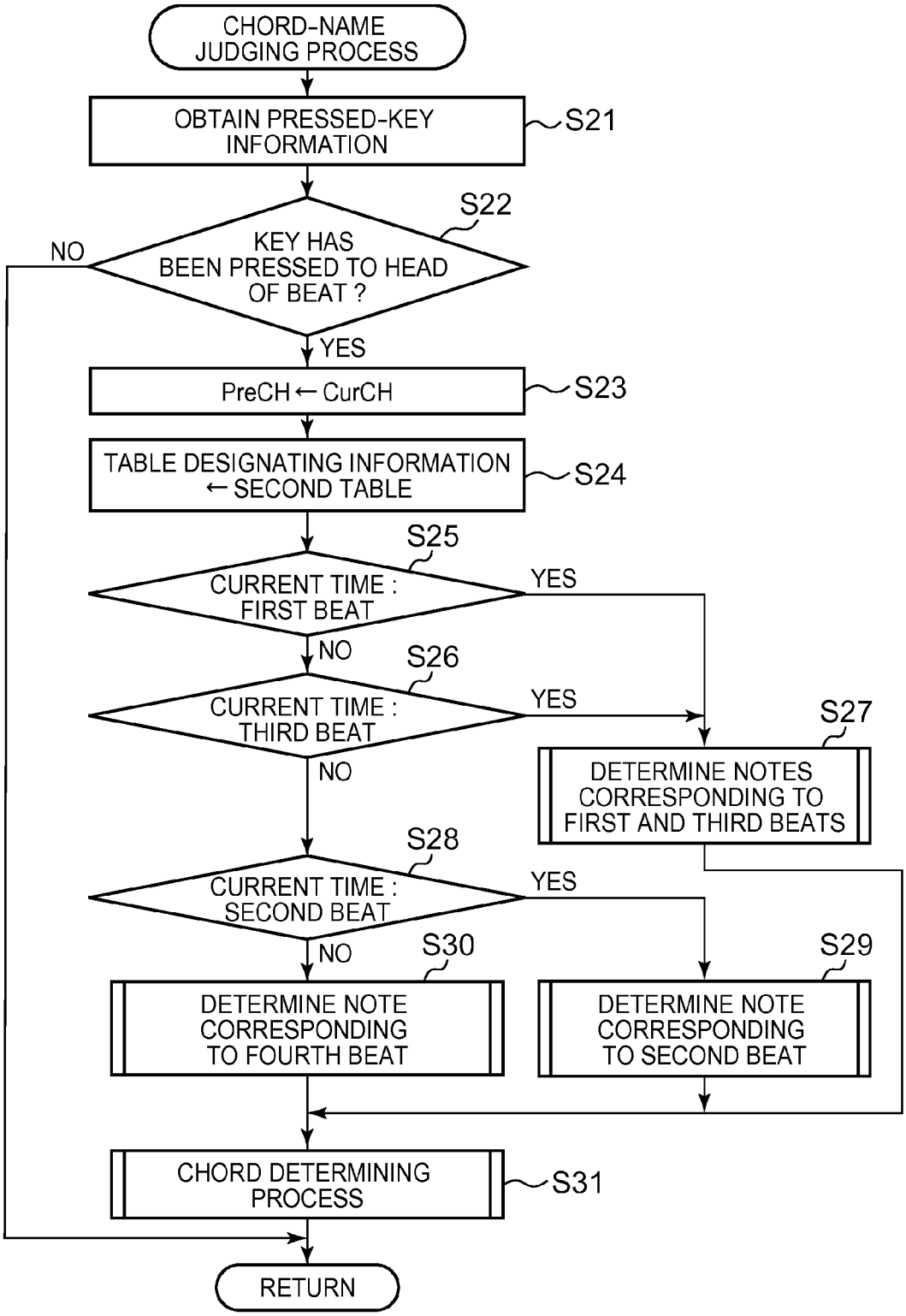
FIG. 5 is a flowchart showing an example of a chord-name judging process performed in the present embodiment of the invention.

When the keyboard process has been finished (step S3 in FIG. 3), CPU 21 performs a chord-name judging process (step S4). FIG. 5 is a flow chart showing an example of the chord-name judging process to be performed in the present embodiment. In the present embodiment, a melody tone currently generated is expressed by Current Melody tone CM, a melody tone generated just previously is expressed by Previous Melody tone PM, a chord name performed just previously is expressed by Previous Chord name PreCH, and a current chord name to be newly generated is expressed by Current Chord name CurCH. The Current Chord name CurCH is determined based on the Current Melody tone CM, Previous Melody tone PM and Previous Chord name PreCH. In the present embodiment, the tonality of a musical piece (melody) is set to (C Major) or (A Minor), and the chord name is expressed by a degree to the tonic such as I Major and II m, and the data expressing these details is stored in RAM 23. In the case of other tonality, a chord name with the root note (fundamental note) can be obtained based on a pitch difference between the root note of the tonality and the note of "C" or "A".

The tonality of a melody is not restricted to C Major or A Minor but can be set to any major or minor key in real time. In this case, the sorts of the determined tonality will be one or more, and the determined tonality is stored in RAM 23.

Sometimes, it is required to determine the Current Melody tone CM and Previous Melody tone PM based on what number of the beat a key has been pressed to, a temporal position where the key has been pressed, and/or whether or not the key has been pressed at the head of a beat, or a duration of plural notes, a sequential motion of plural notes, and/or a disjunct motion of plural notes. In other words, it is sometimes required to determine the Current Melody tone CM with respect to a key other than the key which is actually pressed and determine the Previous Melody tone PM with respect to a key other than the key which was pressed just before the key is currently pressed. Hereinafter, processes (step S24 to step S30) will be described of determining the Current Melody tone CM and Previous Melody tone PM in the chord-name determining process. In the following process (chord determining process) (step S31), the Current Chord name CurCH is specifically determined based on the Current Melody tone CM, Previous Melody tone PM, and Previous Chord name PreCH.

CPU 21 refers to beat information of the beat, to which the current time belongs, and pressed-key information (a time when a key has been pressed and a duration in which the key is kept pressed) to specify a key which has been pressed to the current beat, and obtains information of a key which was pressed in an interval (previous beat interval) just previous to the beat interval to which the current time belongs (step S21 in FIG. 5). In the process at step S21, the information of a key which is pressed during the current beat will be the initial value of the Current Melody tone CM, and the information of a key which was pressed to the head of the previous beat interval will be the initial value of the Previous Melody tone PM.

Then, CPU 21 refers to the beat information and pressed-key information to judge whether or not any key has been pressed to the head of the beat, to which the current time belongs (step S22). When it is determined that no key has been pressed to the head of the beat, to which the current time belongs (NO at step S22), the chord-name determining process finishes. When it is determined that a key has been pressed to the head of the beat, to which the current time belongs (YES at step S22), CPU 21 copies the Current Chord name CurCH to the Previous Chord name PreCH (step S23).

CPU 21 sets table-designating information of designating a chord table (to be described later) to information of designating the second chord table (step S24). The chord table includes the first chord table, which is mainly used when a key is pressed to the first beat and the second chord table, which is used when a key is pressed to a beat other than the first beat. The first and second chord tables are stored in ROM 22. The table-designating information is used to indicate which chord table should be used, the first chord table or the second chord table. The table-designating information is stored in RAM 23.

Then, CPU 21 judges what number of the beat a key has been pressed to, that is, CPU 21 determines a temporal position where the key has been pressed (steps S25, S26, and S27). When a key has been pressed to the first beat (YES at step S25), or when a key has been pressed to the third beat (YES at step S26), CPU 21 performs a process of determining notes corresponding to the first and third beats (step S27). When a key has been pressed to the second beat (YES at step S28), CPU 21 performs a process of determining a note corresponding to the second beat (step S29). When a key has not been pressed to the second beat (NO at step S28), that is, when a key has been pressed to the fourth beat, CPU 21 performs a process of determining a note corresponding to the fourth beat (step S30).

In the present embodiment, a musical piece is in four-four time and its one measure consists of four beats. The key pressed to the n-th beat means that the key has been pressed to the head of the n-th beat or later in terms of time and prior to the head of the (n+1)-th beat.

Concerning elements composing the musical piece, there is a concept of meters and beats. In the meter, weights are given to respective beats, and the musical piece or the melody progresses with weighted beats. In the case of syncopation, sometimes, weights on beats can fluctuate. In the present embodiment, CPU 21 extracts tones composing the most appropriate flow of a melody with consideration of the weights on beats, specifying the Current Melody tone CM and Previous Melody tone PM, which are most appropriate for a chord determination.

FIG. 6 to FIG. 9 are flow charts showing an example of the process (step S27 in FIG. 5) of determining notes corresponding to the first and third beats in the present embodiment. CPU 21 judges whether or not a key has been pressed to the first beat (step S41 in FIG. 6). When it is determined YES at step S41, CPU 21 changes the table-designating information to the information of designating the first chord table (step S42). Then, CPU 21 performs the first dominant-motion judgment process (step S43).

Figure 10:
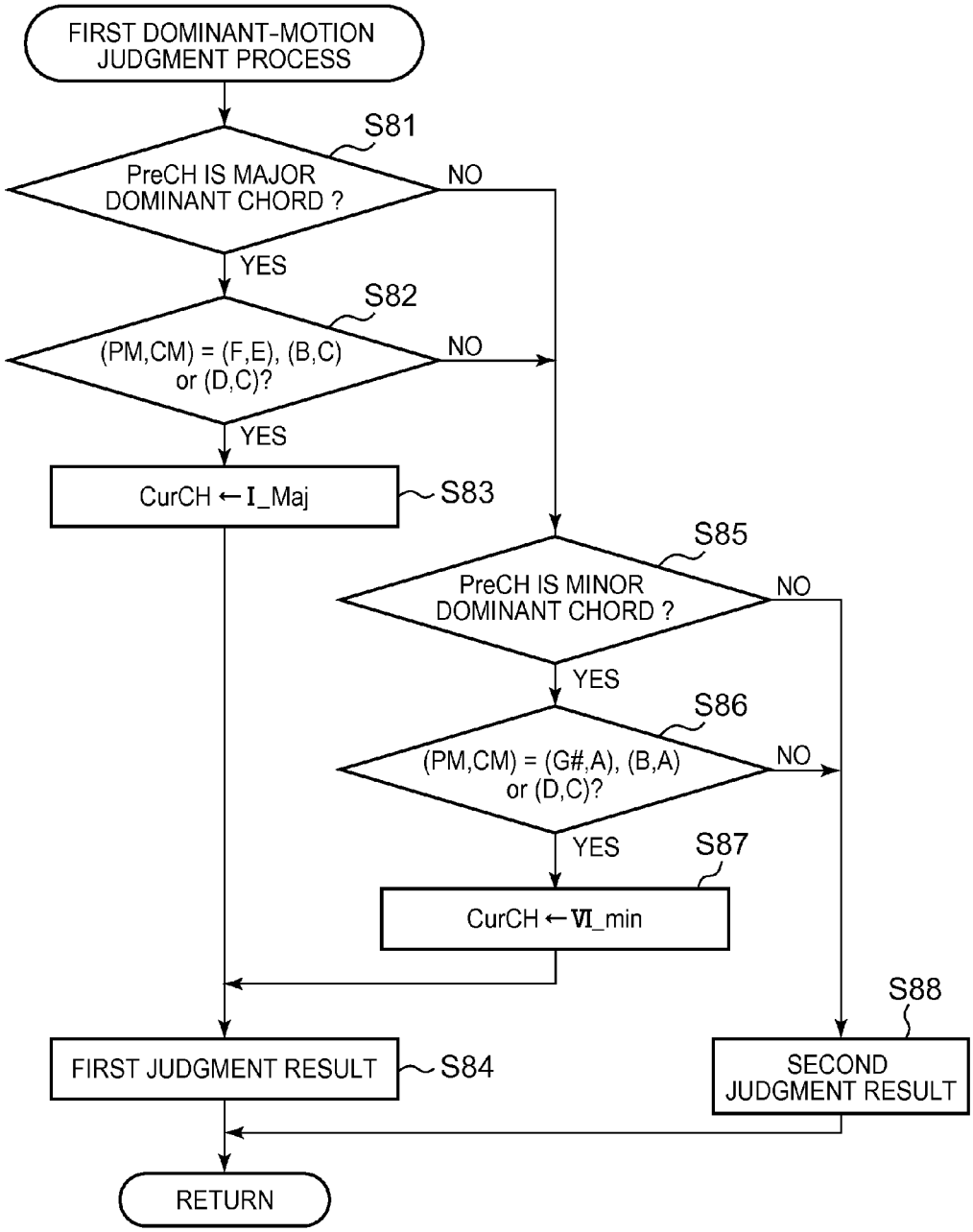
FIG. 10 is a flow chart showing an example of a first dominant-motion judgment process performed in the present embodiment of the invention.

The dominant-motion judgment process is performed to extract a dominant motion (motion from a dominant chard to a tonic chord) from the flow of a melody. In the present embodiment, a first dominant-motion judgment process, in which a chord name is considered and a second dominant-motion judgment process, in which no chord name is considered are performed. FIG. 10 is a flow chart showing an example of the first dominant-motion judgment process performed in the present embodiment.

CPU 21 judges whether or not the Previous Chord name PreCH stored in RAM 21 corresponds to any of the major dominant chords (step S81 in FIG. 10). In the first dominant-motion judgment process in the present embodiment, for example, the major dominant chord is either of "VMaj", "V7", and "VIIm7 (−5)". When it is determined YES at step S81, CPU 21 judges whether or not (PM, CM) or a combination of a value of the Current Melody tone CM and a value of the Previous Melody tone PM is equivalent to any of (F, E), (B, C) and (D, C) (step S82). In other words, CPU 21 judges at step S82 whether or not a motion from the Previous Melody tone PM to the Current Melody tone CM is equivalent to a motion of solving from the dominant chord to the tonic chord in the major chord progression.

When it is determined YES at step S82, CPU 21 decides the Current Chord name CurCH to be "IMaj" and stores the information in RAM 23 (step S83). Then, CPU 21 stores in RAM 23 information representing that the first judgment result was obtained in the dominant motion process (step S84). When it is determined NO at step S81 or when it is determined NO at step S82, CPU 21 judges whether or not the Previous Chord name PreCH corresponds to any of the minor dominant chords (step S85). In the present embodiment, for example, the minor dominant chord is either of "IIIMaj" and "III7".

When it is determined YES at step S85, CPU 21 judges whether or not (PM, CM) is any of (G♯, A), (B, A) and (D, C) (step S86). In other words, CPU 21 judges at step S86 whether or not the motion from the Previous Melody tone PM to the Current Melody tone CM is equivalent to the motion of solving from the dominant chord to the tonic chord in the minor chord progression. When it is determined YES at step S86, CPU 21 decides the Current Chord name CurCH to be "VImin" and stores the information in RAM 23 (step S87). Then, CPU 21 advances to step S84.

When it is determined NO at step S85 or when it is determined NO at step S86, CPU 21 stores in RAM 23 information representing that the second judgment result was obtained in the dominant motion process (step S88).

Figure 6:
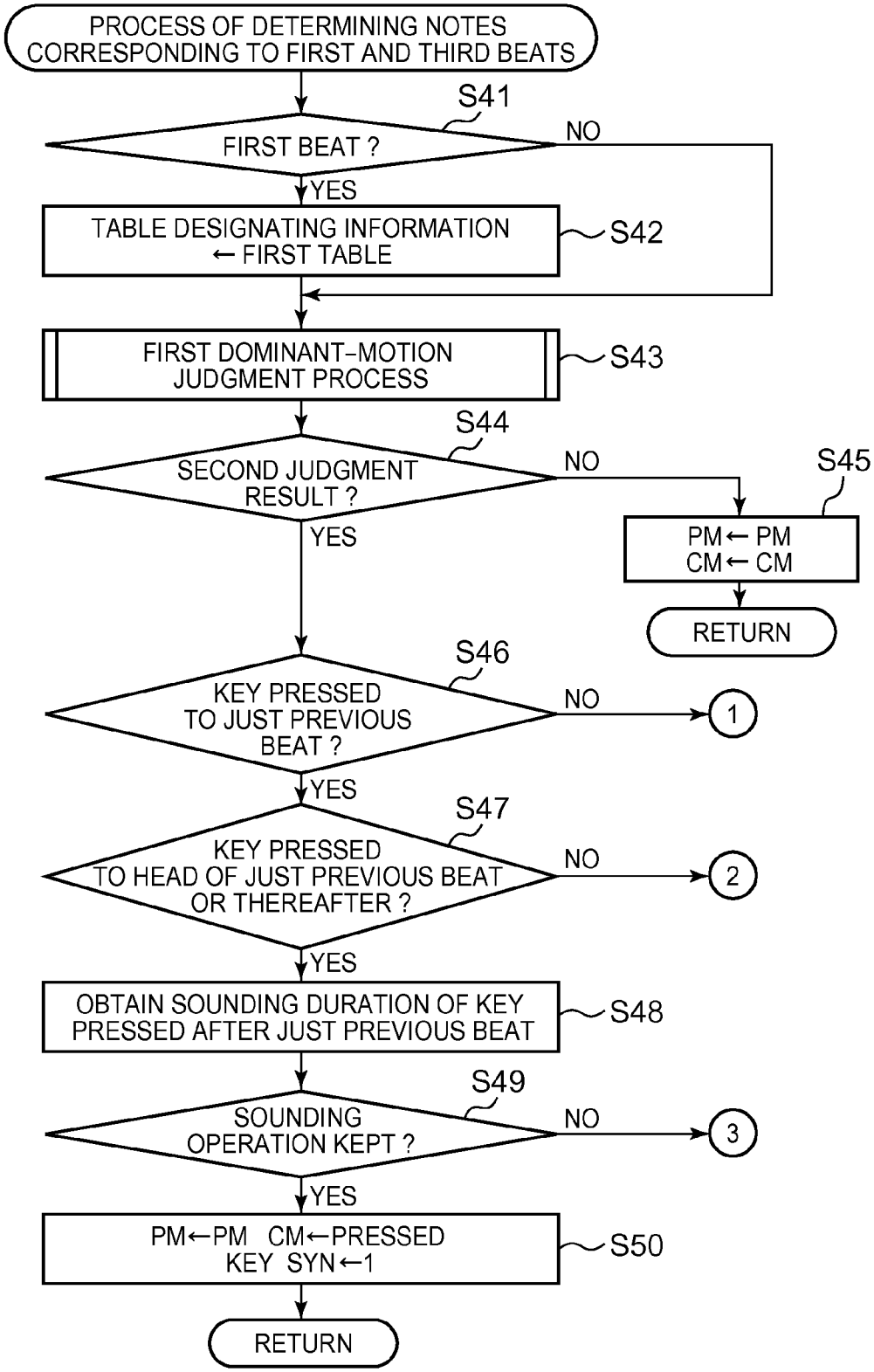
FIG. 6 to FIG. 9 are flow charts showing an example of a process of determining notes corresponding to the first and third beats in the present embodiment of the invention.

When the first dominant-motion judgment process finishes at step S43 in FIG. 6, CPU 21 judges whether or not the second judgment result was obtained as the result of the first dominant-motion judgment process (step S44). When it is determined NO at step S44, that is, when the first judgment result was obtained as the result of the first dominant-motion judgment process, CPU 21 does not change the Previous Melody tone PM and Current Melody tone CM form their initial values and stores them in RAM 23, finishing the process (step S45). When it is determined YES at step S44, CPU 21 refers to the pressed-key information stored in RAM 23 to judge whether or not any key has been pressed to the beat just previous to the beat corresponding to the current time (step S46).

When it is determined YES at step S46, CPU 21 refers to the pressed-key information stored in RAM 23, and judges whether or not any key has been pressed to the head of the just previous beat or thereafter too (step S47). When it is determined that no key has been pressed to the head of the just previous beat or thereafter (NO at step S47), this means that keys of quarter note have been pressed respectively to the just previous beat and the current beat. The process of this case will be described later. When it is determined that a key has been pressed to the head of the just previous beat or thereafter (YES at step S47), CPU 21 refers to the pressed-key information stored in RAM 23, that is, more particularly, CPU 21 refers to a sound duration of the key which has been pressed to the head of the just previous beat or thereafter, which is included in the pressed-key information, and judges whether or not a sounding operation is still kept until now (step S49). Even if a key has not been pressed to the head of the beat but the key has been pressed after the head of the beat and kept pressed, said pressed key corresponds to syncopation. Therefore, CPU 21 judges at step S49 whether or not the key has been pressed off the beat (syncopation).

When it is determined that the key has been pressed off the beat (YES at step S49), CPU 21 keeps the Previous Melody tone PM with its initial value, and sets the key pressed to the head of the just previous beat or thereafter to the Current Melody tone CM, and further sets a syncopation flag SYN to "1", and stores related information in RAM 23 (step S50). The Previous Melody tone PM and Current Melody tone CM are stored in RAM 23. Since the pressed key corresponding to the syncopation is given the same weight as the key pressed to the head of the beat, the pressed key corresponding to the syncopation will be processed similarly to the key pressed to the head of the beat.

Figure 7:
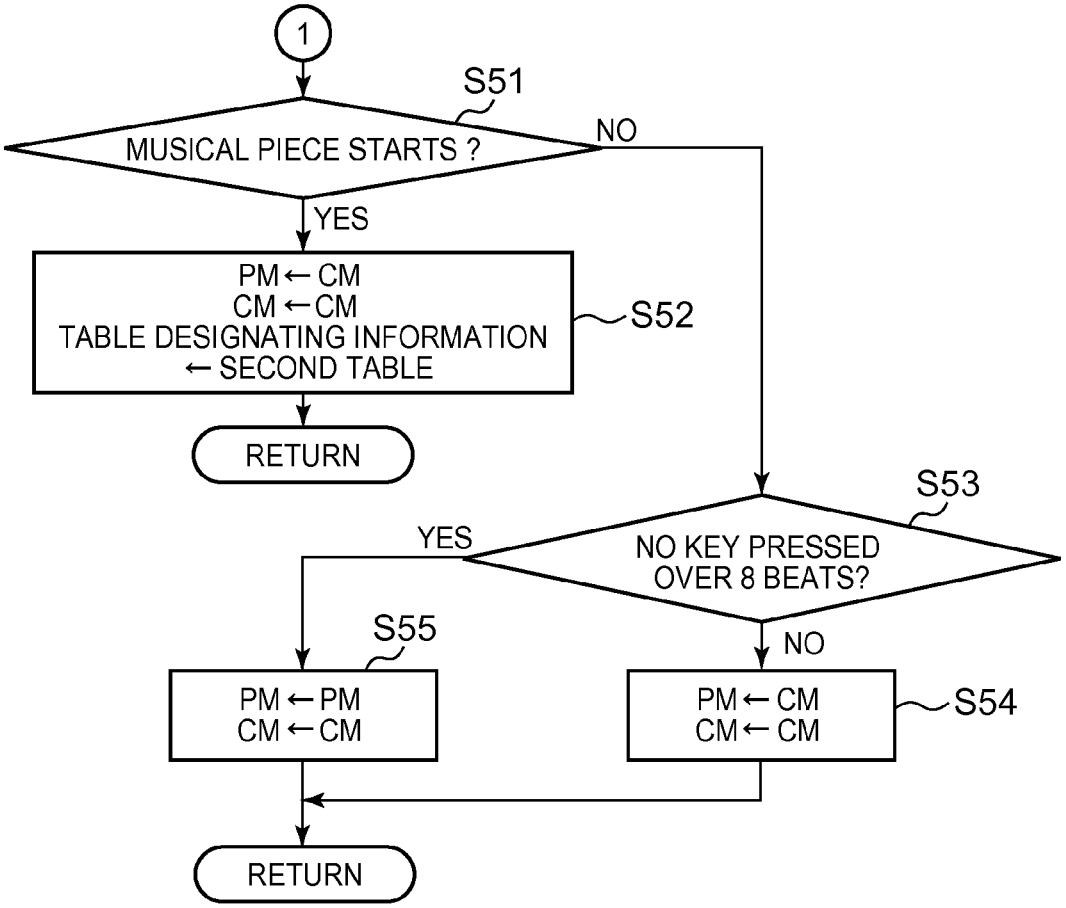

A process will be described with reference to the flow chart of FIG. 7, which process is to be performed, when it is determined that no key has been pressed to the beat just prior to the beat corresponding to the current time (NO at step S46). CPU 21 judges whether or not a key has been pressed to the head of the beat to start the musical piece (step S51 in FIG. 7). More specifically, CPU 21 refers to the pressed-key information stored in RAM 23 at step S51 to judge whether or not the information of the pressed key is the first pressed-key information. When it is determined YES at step S51, CPU 21 gives the Current Melody tone CM to the Previous Melody tone PM. Further, CPU 21 does not change the Current Melody tone CM from its initial value but changes the table-designating information to the information of designating the second chord table (step S52).

When it is determined NO at step S51, CPU 21 judges whether or not no key of a duration of 8 beats or more has been pressed (step S53). When it is determined NO at step S53, CPU 21 holds the Current Melody tone CM with its initial value and gives to the Current Melody tone CM to the Previous Melody tone PM and stores the information in RAM 23 (step S54). In the case where it is determined NO at step S53, this case means that no key has been pressed during a period of two measures and more. In this case, a melody sequence will have less feature and the initial value of the Previous Melody tone PM of the key which was pressed before 2 measures and more is neglected. When it is determined YES at step S53, CPU 21 holds the Previous Melody tone PM and Current Melody tone CM with their initial values (step S55).

Figure 8:
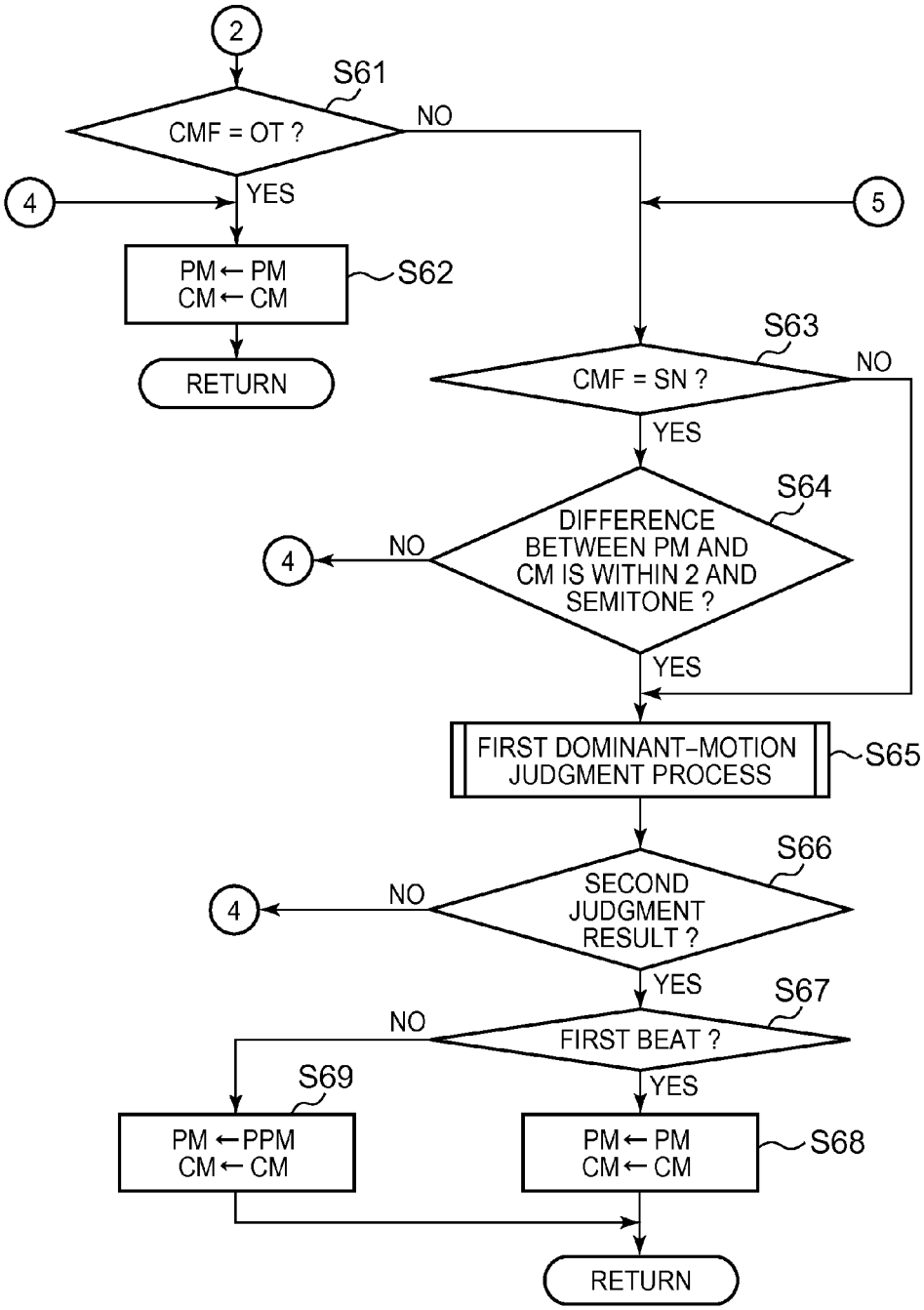

A process will be described with reference to the flow chart of FIG. 8, which process is to be performed, when it is determined that no key has been pressed to the head of the just previous beat or thereafter (NO at step S47 in FIG. 6). When it is determined NO at step S47, CPU 21 judges whether or not the Current Melody Function CMF is Other Tone OT (step S61 in FIG. 8). The Current Melody Function CMF represents the functions of the Current Melody tone CM against the Previous Chord name PreCH. In the present embodiment, the Current Melody Function CMF is either of Chord Tone CT representing that Current Melody tone CM is a chord composing tone of Previous Chord name PreCH, Scale Note SN representing that Current Melody tone CM is a composing tone of Current Scale (tonality), and Other Tone OT representing other tone.

More specifically, a melody function table, which shows relationships between chord names and tone names is stored in ROM 22, and CPU 21 refers to a value given to a combination of the Current Melody tone CM and Previous Chord name PreCH to determine the Current Melody Function CMF. FIG. 25 is a view showing an example of a part of the melody function table. As shown in FIG. 25, a predetermined value corresponding to a combination of the Current Melody tone CM and Previous Chord name PreCH can be obtained from the melody function table 2500. In the melody function table 2500 shown in FIG. 25, CT represents the chord tones (for instance, see to reference numbers 2501 to 2503), SN represents the scale notes (for instance, see to reference numbers 2511 to 2513). Further, in the melody function table 2500 shown in FIG. 25, empty spaces represent other tones (for instance, see to reference numbers 2521 to 2523).

When it is determined that the Current Melody Function CMF is Other Tone OT (YES at step S61 in FIG. 8), CPU 21 holds the Previous Melody tone PM and Current Melody tone CM with their initial values (step S62). Meanwhile, when it is determined NO at step S61, CPU 21 judges whether or not the Current Melody Function CMF is Scale Note SN (step S63). When it is determined YES at step S63, CPU 21 judges whether or not a difference between the Previous Melody tone PM and the Current Melody tone CM is within 2 and semitone (step S64). In other words, it is judged whether a motion from PM to CM is a conjunct motion or not. When it is determined YES at step S64, or when it is determined NO at step S63, CPU 21 performs the first dominant-motion judgment process (step S65).

Then, CPU 21 judges whether or not the second judgment result was obtained as the result of the first dominant-motion judgment process (step S66). When it is determined NO at step S66, that is, when it is determined that the first judgment result was obtained in the first dominant-motion judgment process, CPU 21 holds the Previous Melody tone PM and the Current Melody tone CM with their initial values (step S62). When it is determined YES at step S66, CPU 21 judges whether or not a currently pressed key or a key to be processed is one that has been pressed to the first beat (step S67). When it is determined YES at step S67, CPU 21 holds the Previous Melody tone PM and Current Melody tone CM with their initial values (step S68).

Meanwhile, when it is determined NO at step S67, that is, when a key has been pressed to the third beat, CPU 21 gives the Previous Melody tone PM a pitch PPM of a key which was pressed prior to the initial Previous Melody tone PM and meanwhile holds the Current Melody tone CM with its initial value (step S69). Since a musical tone, which composes a conjunct motion at the third beat is likely to be an ornament tone, it will be appropriate to use a musical tone corresponding to the key which was pressed prior to the initial Previous Melody tone PM as a musical tone predominating on a melody line.

A process will be described with reference to the flow chart of FIG. 9, which process is to be performed, when it is determined that a key has been pressed after the head of the just previous beat (NO at step S49 in FIG. 6). CPU 21 specifies the key, which has been pressed after the head of the just previous beat (step S71 in FIG. 9) and judges whether or not a pitch of the tone of the specified key is the same as the initial Current Melody tone CM (step S72). When it is determined YES at step S72, CPU 21 holds the Current Melody tone CM with its initial value and meanwhile gives the Current Melody tone CM to the Previous Melody tone PM (step S73). For instance, the case is considered, where the melody progresses in the order of eighth notes from "D" to "C" in the just previous beat and a key of "C" has been pressed to the current beat. In this case, it is considered that a tone of the first "D" in the just previous beat is an ornament tone and that a sequence is not from "D" to "C" but a sequence from "C" to "C" is appropriate. Therefore, the current melody tone is given to the previous melody tone and the same tones continue.

When it is determined NO at step S72, CPU 21 judges whether or not all the specified tones of the keys pressed to the head of the beat or thereafter are the same as the Previous Melody tone PM (step S74). When it is determined YES at step S74, CPU 21 returns to step S63 in FIG. 8. For example, the case could be possible, where sixteenth notes of "D", "C", "C", and "C" are pressed to the previous beat. In this case, though the note of "D" is pressed to the head of the beat, the note of "D" could be an ornament tone. There is a case that the note of "D" pressed to the head of the beat should not be set as the Previous Melody tone PM. Therefore, the processes at step S63 and at the following steps are performed.

Figure 9:
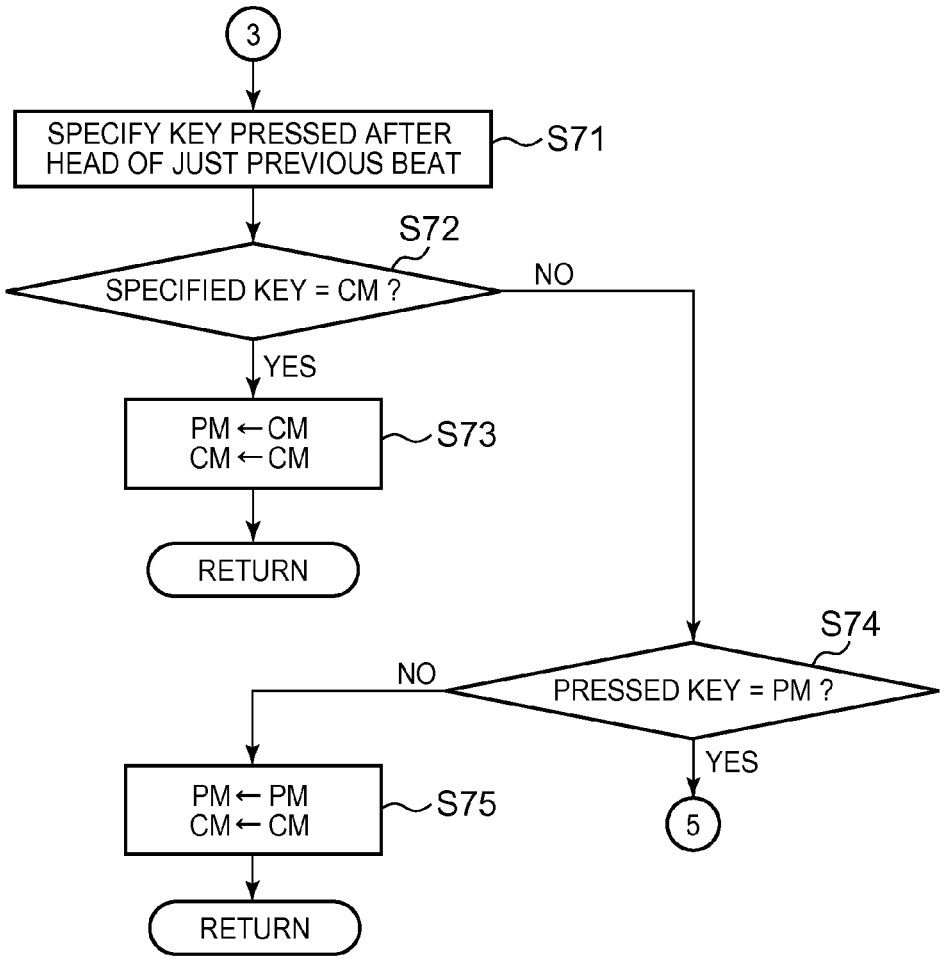

Meanwhile, when it is determined NO at step S74 in FIG. 9, CPU 21 holds the Previous Melody tone PM and Current Melody tone CM with their initial values (step S75).

Now, a process (step S29 in FIG. 5) of determining a note corresponding to the second beat will be described. FIG. 11 to FIG. 14 are flow charts showing an example of the process of determining a note corresponding to the second beat in the present embodiment. CPU 21 judges whether or not a key has been pressed to the first beat (step S91 in FIG. 11). When it is determined that no key has been pressed to the first beat, CPU 21 changes the table-designating information to the information of designating the first chord table (step S92). For example, in the case where a sounding duration of the previous measure extends, a rest is placed at the first beat, and the following phrase starts from the second beat in the middle of the musical piece, it is considered in the present embodiment that the key pressed to the first beat and the key pressed to the second beat are given the same weights, respectively, and therefore the first chord table for the first beat is used.

Figure 11:
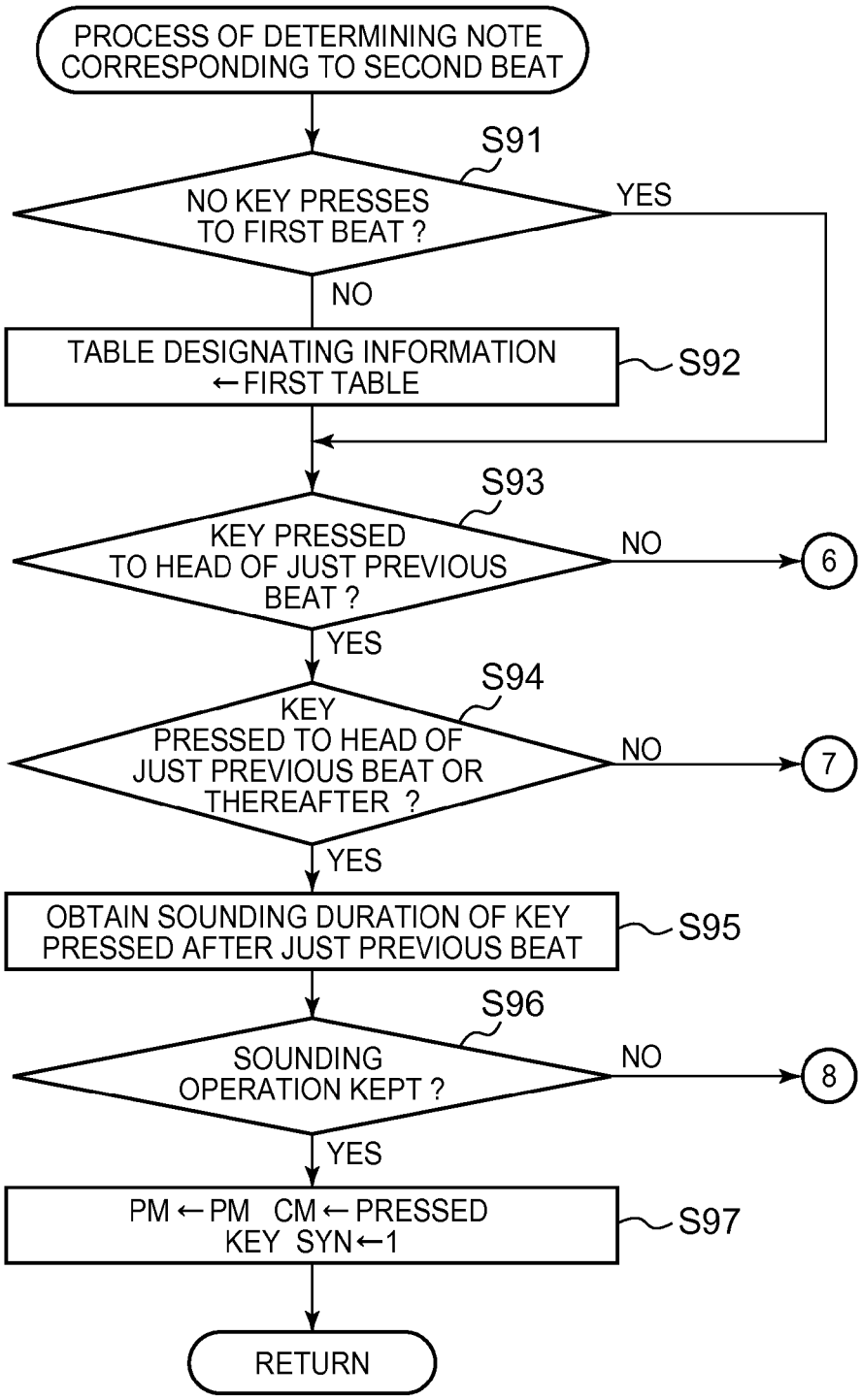
FIG. 11 to FIG. 14 are flow charts showing an example of a process of determining a note corresponding to the second beat in the present embodiment of the invention.

In the process of determining a note corresponding to the second beat shown in FIG. 11, the first dominant-motion judgment process (step S43) in the process of determining notes corresponding to the first and third beats and the processes (step S44 and step S45) based on the judgment result are omitted. Processes at step S93 to step S97 in FIG. 11 are substantially the same as those at step S46 to step S50 in FIG. 6.

Figure 12:
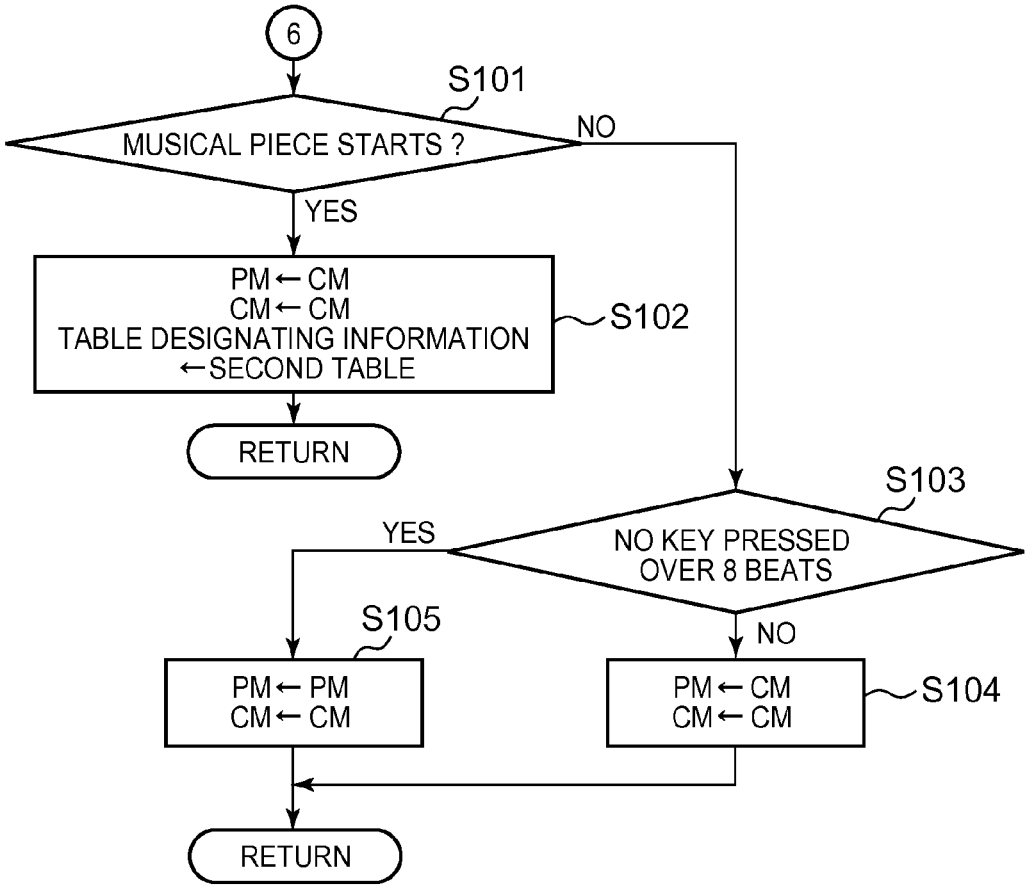

FIG. 12 is a flow chart of a process which is to be performed, when it is determined that no key has been pressed to the head of the just previous beat (NO at step S93 in FIG. 11). In FIG. 12, processes at step S101 and step S103 to step S105 are substantially the same as those at step S51 and step S53 to step S55 in FIG. 7. The process at step S102 is also substantially the same as that at step S52 in FIG. 7, excepting that the table-designating information is changed.

Figure 13:
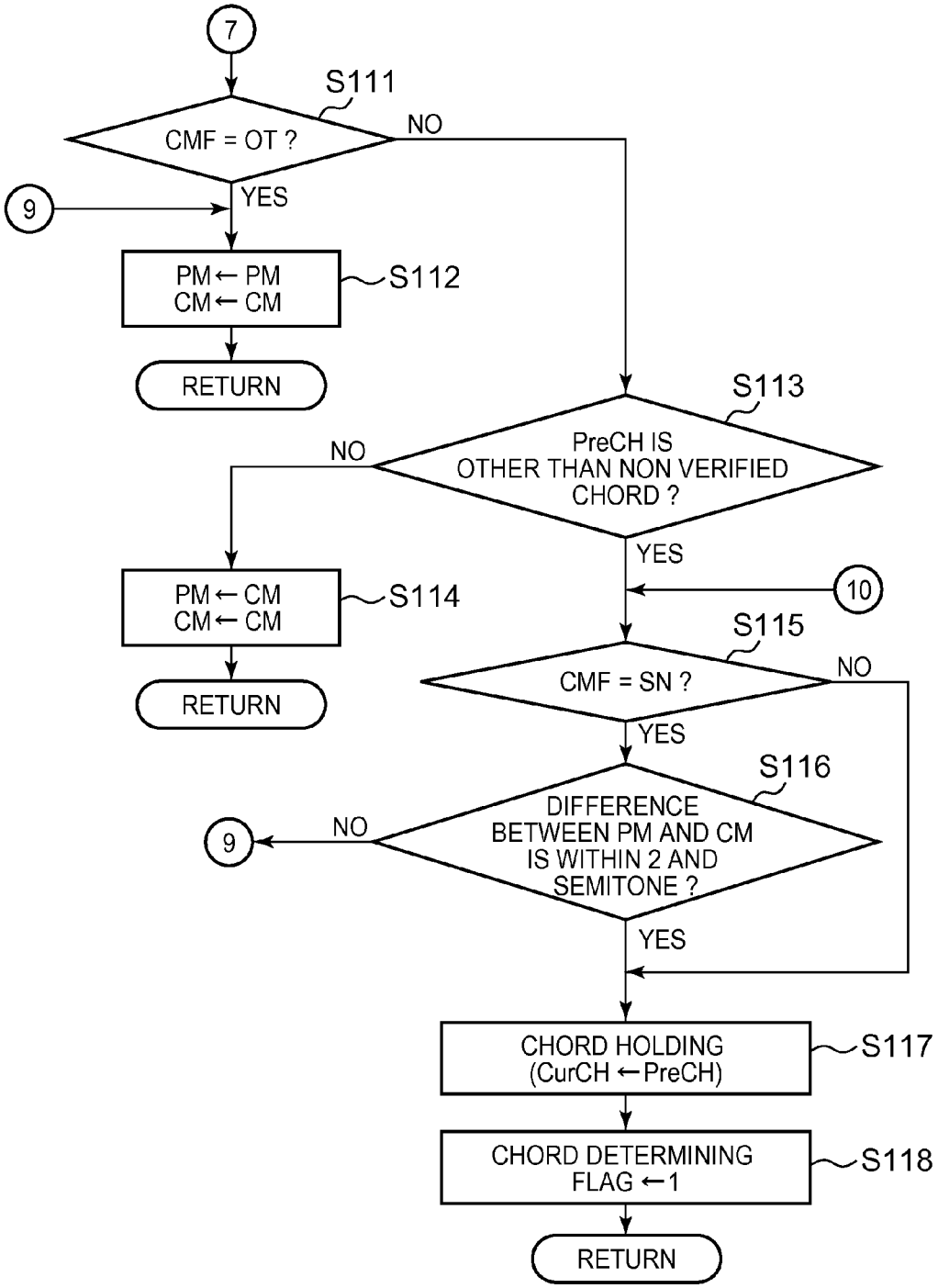

A process will be described with reference to the flow chart of FIG. 13, which process is to be performed, when it is determined that no key has been pressed to the head of the just previous beat or thereafter (NO at step S94). CPU 21 judges whether or not the Current Melody Function CMF is Other Tone OT (step S111). When it is determined YES at step S111, CPU 21 advances to step S112. The process at step S112 is the substantially the same as the process at step S62 in FIG. 8.

Figure 21:
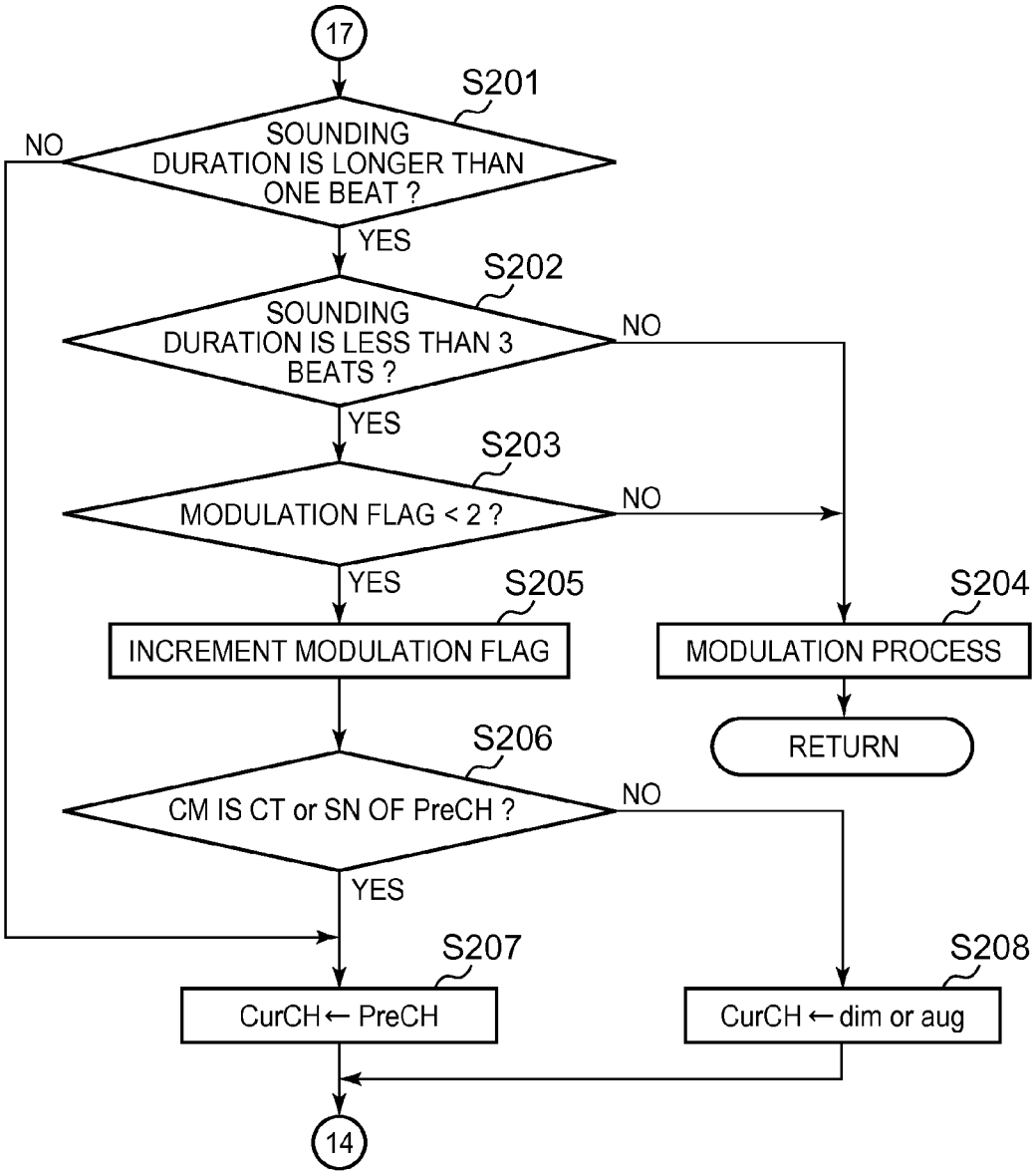

When it is determined NO at step S111, CPU 21 judges whether or not the Previous Chord name PreCH is a chord other than an non-verified chord (step S113). As will be described in FIG. 21 (step S205), a modulation flag has been set to "1" or more in the previous process. When it is determined NO at step S111, CPU 21 is only required to judge whether or not the modulation flag stored in RAM 23 has been set to "1" or more (step S113).

When it is determined NO at step S113, that is, when it is determined that the Previous Chord name PreCH is an non-verified chord, CPU 21 gives the Previous Melody tone PM the Current Melody tone CM (step S114). Meanwhile, when it is determined YES at step S113, that is, when it is determined that the Previous Chord name PreCH is a chord other than an non-verified chord, CPU 21 judges whether or not the Current Melody Function CMF is the Scale Note SN (step S115). When it is determined YES at step S115, CPU 21 judges whether or not a difference between the Previous Melody tone PM and the Current Melody tone CM is within 2 and semitone (step S116). The processes at step S115 and step S116 are substantially the same as those at step S63 and step S64 in FIG. 8. When it is determined NO at step S115, or when it is determined YES at step S116, CPU 21 gives the Current Chord name CurCH the Previous Chord name PreCH (step S117). That is, the Previous Chord name PreCH is held.

Since the chords are held at the second and fourth beats, an appropriate Previous Chord name PreCH is held (chord holding is effected). In the present embodiment, when the Current Melody Function CMF is the Chord Tone CT, or when the Current Melody Function CMF is the Scale Note SN and the tone progression is the conjunct motion, the chord holding is effected. In the music piece of a quadruple time, the second and fourth beats are anacrusis. Therefore, as long as the anacrusis is not given weight in the melody, the chords at the second and fourth beats fundamentally hold up the chords at the first and third beats, respectively.

Figure 46:
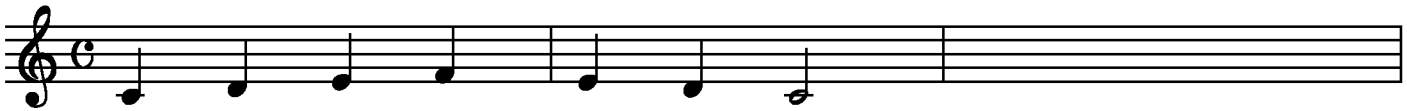
FIG. 46 is a view showing an example of a musical score.

For instance, in the musical score shown in FIG. 46, there are placed notes "C", "D", "E", "F", "E", "C", and "D" at the heads of beats and the sequence of the tones is the conjunct motion. In practice, a proper chord name of this sequence is IMaj(CMaj). But if no processes are performed at step S115 to step 117, the chords names at the second and fourth beats will be one other than IMaj(CMaj). Therefore, the chord holding is effected at step S115 to step S116 under a certain condition, and a proper chord name is obtained.

After the process at step S117, CPU 21 sets a chord determining flag stored in RAM 23 to "1" (step S118). In this case, since the Current Chord Name CurCH has been determined, following chord name determining process is not required.

When it is determined NO at step S116, CPU 21 returns to step S112 and CPU 21 holds the Previous Melody tone PM and Current Melody tone CM with their initial values (step S112).

Figure 14:
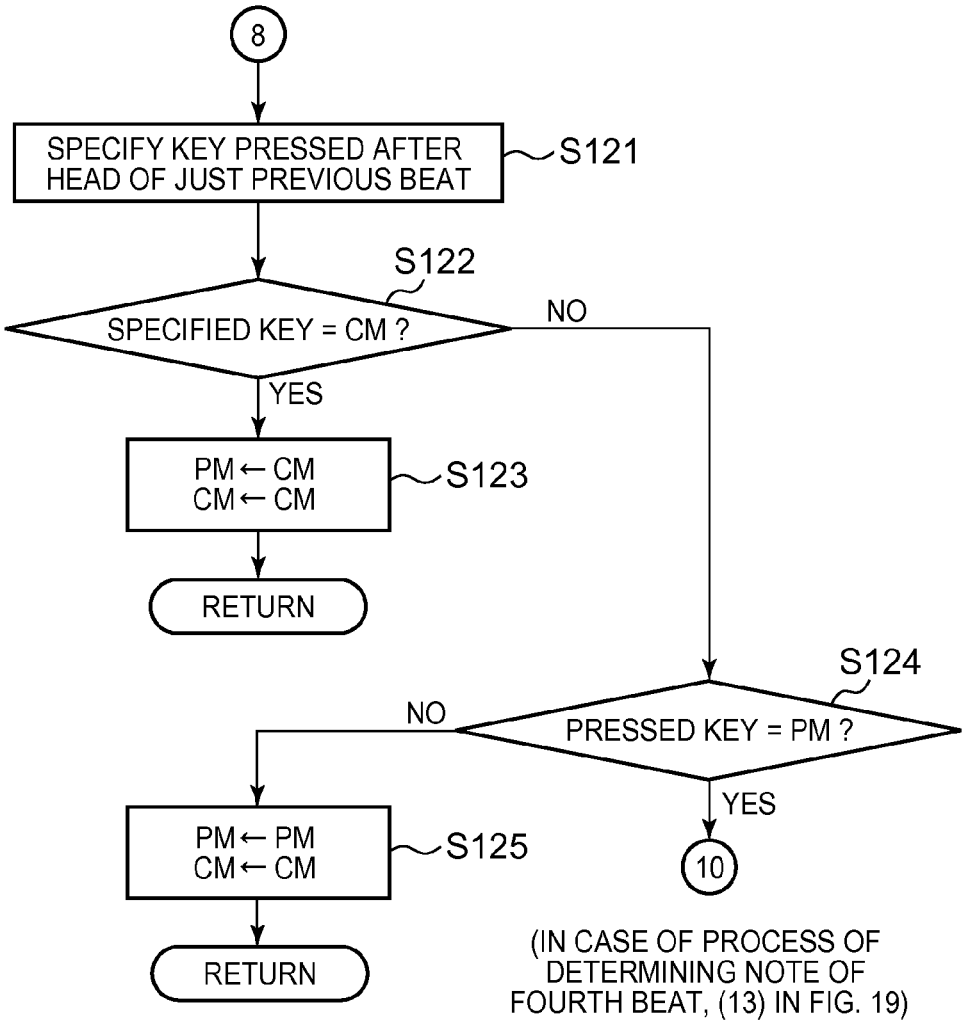

When it is determined NO at step S96 in FIG. 11, a process is performed in accordance with the flow chart shown in FIG. 14. In FIG. 14, processes at step S121 to step S125 are substantially the same as those at step S71 to step S75 in FIG. 9. When it is determined YES at step S124, CPU 21 returns to step S115 in FIG. 13, where the chord holding is effected.

Figure 15:
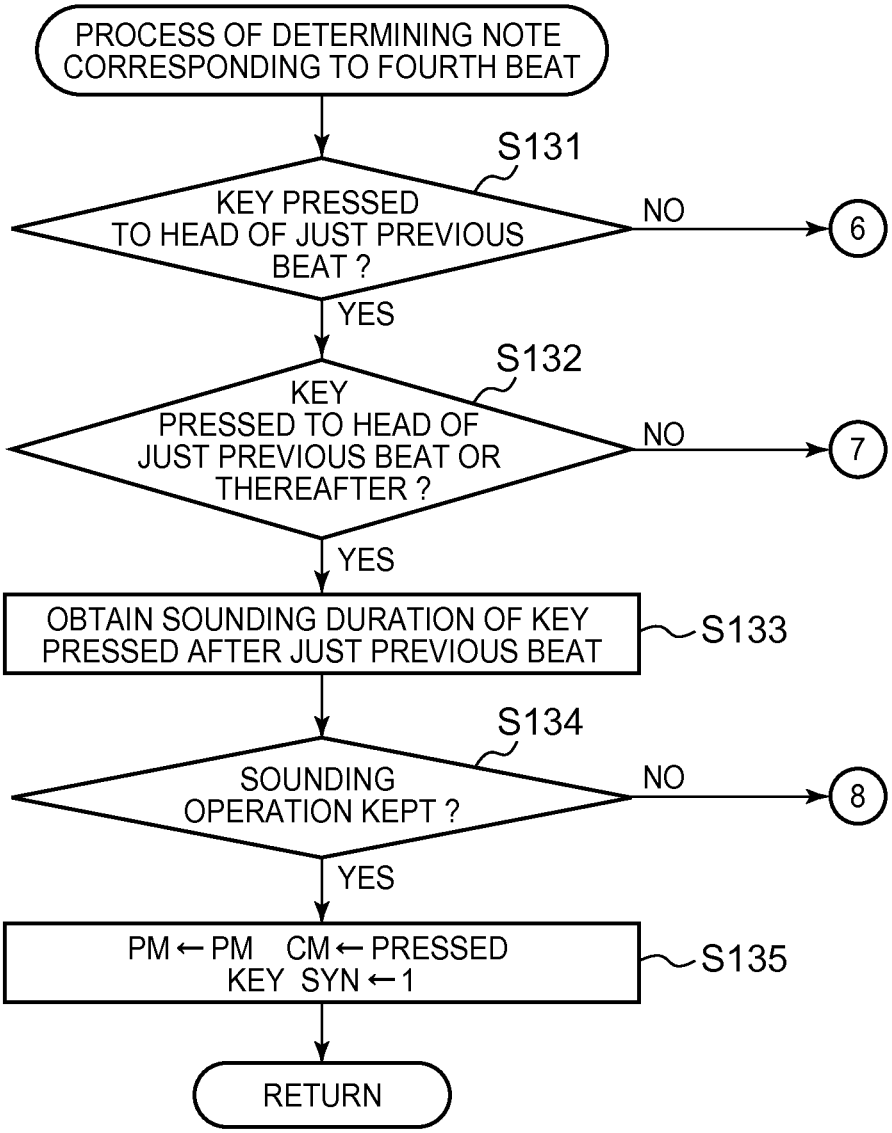
FIG. 15 and FIG. 16 are flow charts of an example of a process of determining a note corresponding to the fourth beat in the present embodiment of the invention.
Figure 16:
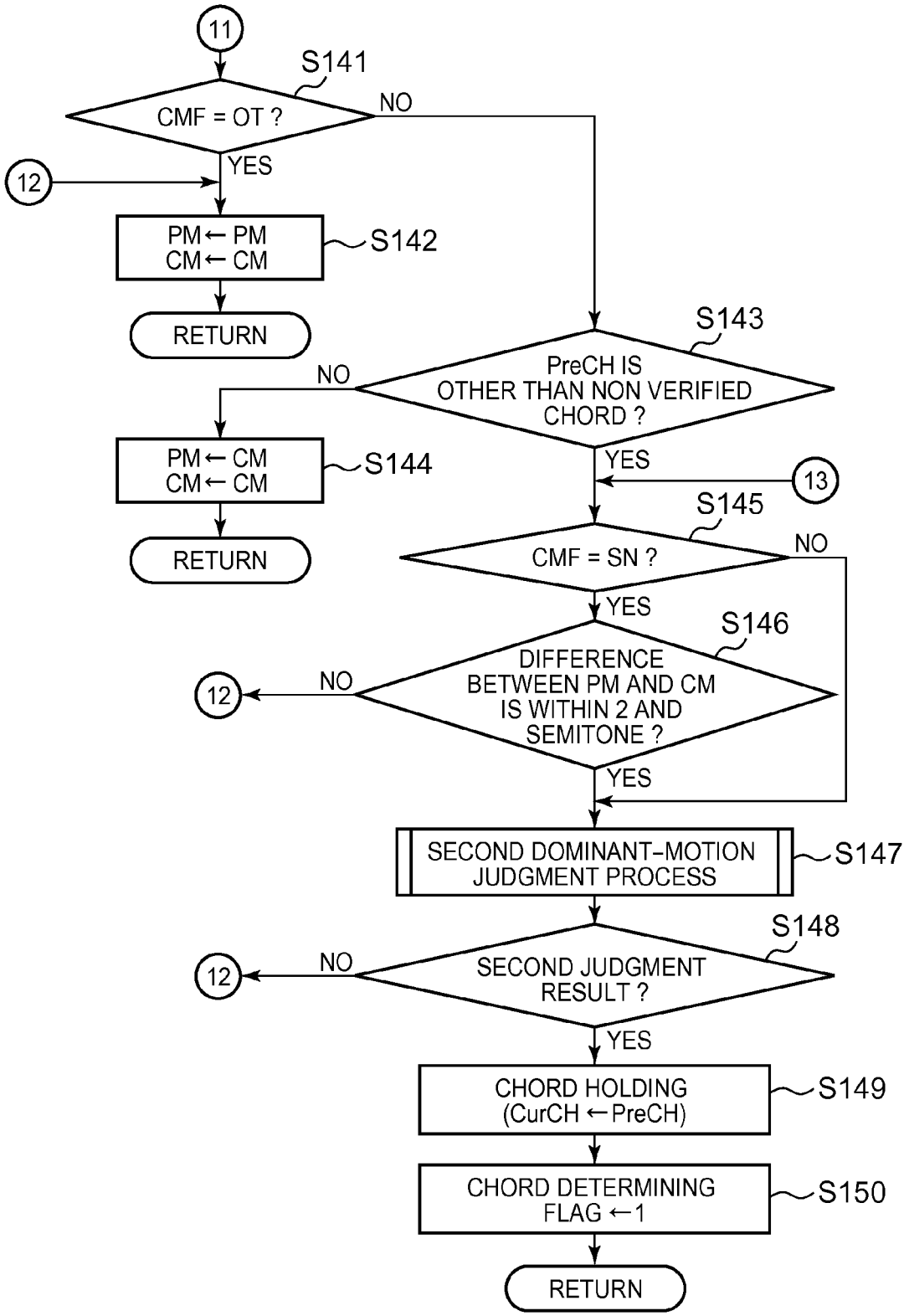

Now, a process (step S30 in FIG. 5) of determining a note corresponding to the fourth beat will be described. FIG. 15 and FIG. 16 are flow charts of an example of the process of determining a note corresponding to the fourth beat in the present embodiment. The process of determining a note corresponding to the fourth beat is similar to the process of determining a note corresponding to the second beat.

In the process of determining a note corresponding to the fourth beat, shown in FIG. 15, a process (step S91 in FIG. 11) for judging whether or not a key has been pressed and the related process (step S92) are omitted. Processes at step S131 to step S135 in FIG. 15 are substantially the same as those at step S93 to step S97 in FIG. 11. When it is determined YES at step S131, the processes shown in FIG. 12 are performed.

When it is determined NO at step S132, the processes shown in FIG. 16 are performed. In FIG. 16, processes at step S141 to step S146 are substantially the same as those at step S111 to step S116 in FIG. 13. In the process of determining a note corresponding to the fourth beat, when it is determined NO at step S145 or when it is determined YES at step S146, CPU 21 performs a second dominant-motion judgment process (step S147) and judges whether or not the chord holding should be effected.

Figure 17:
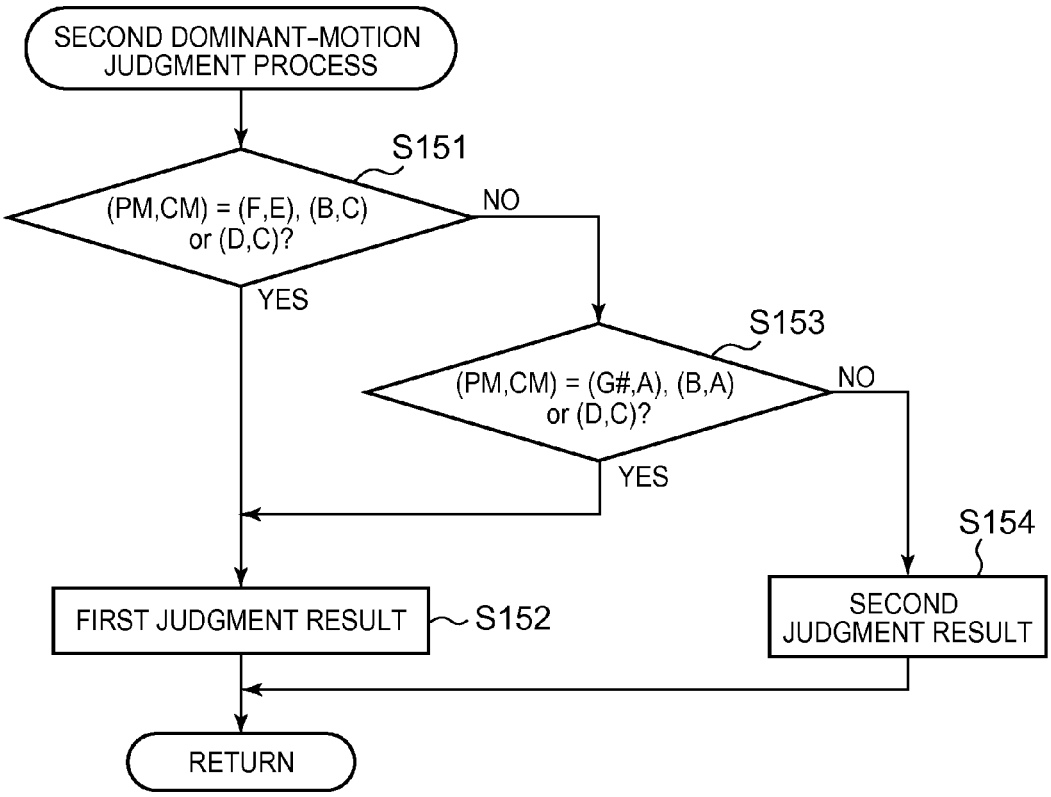
FIG. 17 is a flow chart of an example of a second dominant-motion judgment process performed in the present embodiment of the invention.

FIG. 17 is a flow chart of an example of the second dominant-motion judgment process performed in the present embodiment. In the second dominant-motion judgment process, only a transition of a melody tone is judged, and a sort of the Previous Chord name PreCH is not considered. CPU 21 judges whether or not (PM, CM) is any of (F, E), (B, C), and (D, C) (step S151). This process is substantially the same as that at step S82 in FIG. 10. When it is determined NO at step S151, then CPU 21 judges whether or not (PM, CM) is any of (G♯, A), (B, A), and (D, C) (step S153). This process is substantially the same as that at step S86 in FIG. 10.

When it is determined YES at step S151, or when it is determined YES at step S153, CPU 21 stores in RAM 23 information representing that the first judgment result was obtained as the result of the dominant motion process (step S152). Meanwhile, when it is determined NO at step S153, CPU 21 stores in RAM 23 information representing that the second judgment result was obtained as the result of the dominant motion process (step S154).

When it is determined that the second judgment result was obtained as the result of the second dominant-motion judgment process (YES at step S148 in FIG. 16), CPU 21 gives the Current Chord name CurCH the Previous Chord name PreCH (step S149). That is, the Previous Chord name PreCH is held. CPU 21 sets the chord determining flag in RAM to "1". Meanwhile, when it is determined NO at step S148, CPU 21 returns to step S142 and CPU 21 holds the Previous Melody tone PM and Current Melody tone CM with their initial values (step S142).

When it is determined NO at step S134 in FIG. 15, a process shown in FIG. 14 is performed.

When the note determining processes finish respectively at step S27, step S29 and step S30 in FIG. 5, the chord determining process is performed based on the determined Previous Melody tone PM and Current Melody tone CM (step S31). FIG. 18 to FIG. 21 are flow charts of an example of the chord determining process performed in the present embodiment.

Figure 18:
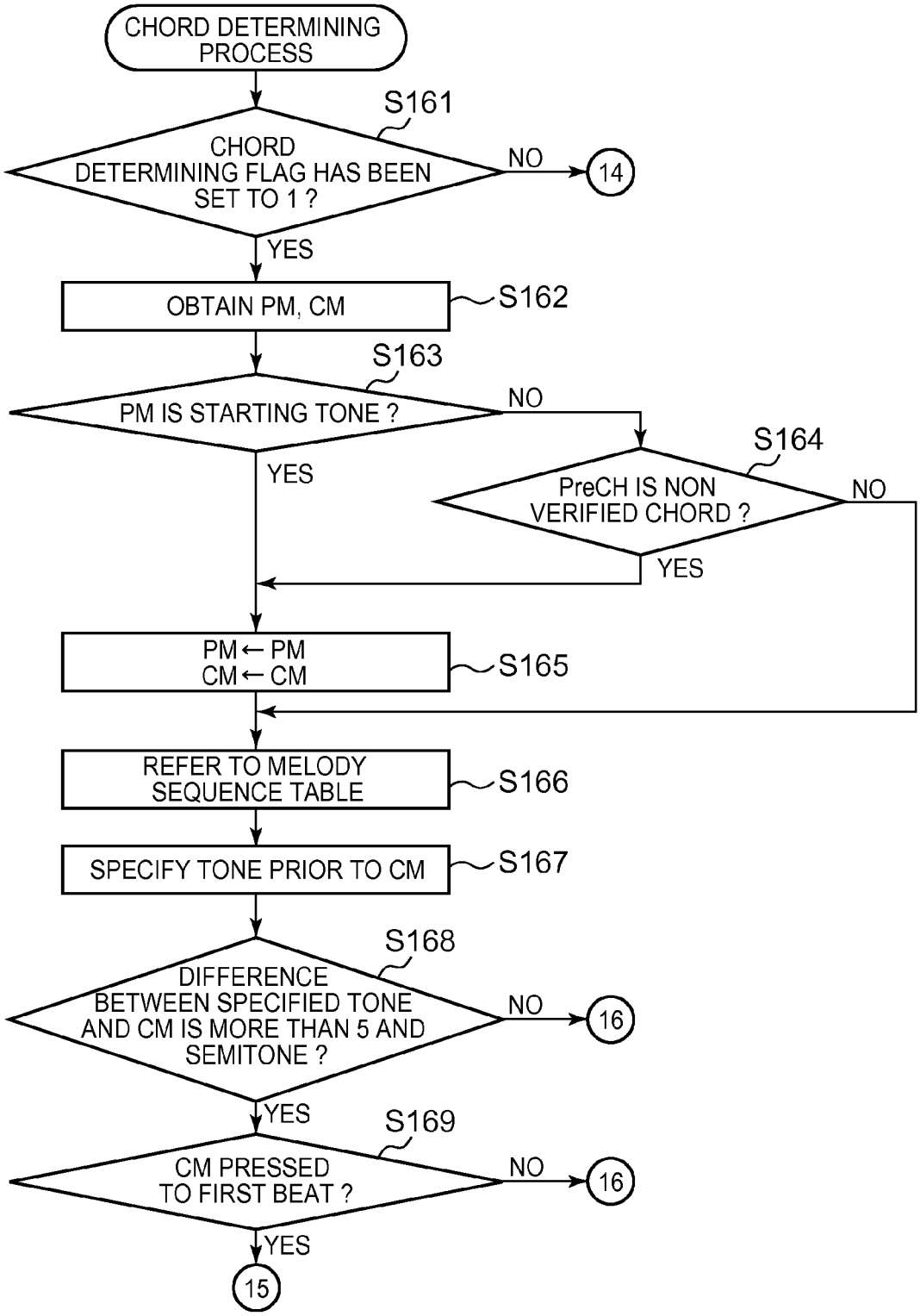
FIG. 18 to FIG. 21 are flow charts of an example of a chord determining process performed in the present embodiment of the invention.

In the chord determining process shown in FIG. 18, the chord holding is effected and the Current Chord name CurCH is already determined. CPU 21 judges whether or not the chord determining flag has been set to "1" (step S161). When it is determined that the chord determining flag has been set to "1", CPU 21 stores in RAM 23 the Current Chord name CurCH and the time of generating a sound (step S175 in FIG. 19).

When it is determined that the chord determining flag has not been set to "1", CPU 21 obtains the Previous Melody tone PM and Current Melody tone CM from RAM 23 (step S162 in FIG. 18). CPU 21 judges whether or not the Previous Melody tone PM is the starting tone of the musical piece (step S163). That is, CPU 21 judges whether or not any key was pressed prior to the Previous Melody tone PM (step S163). When it is determined NO at step S163, CPU 21 judges whether or not the Previous Chord name PreCH is a non verified chord (step S164).

When it is determined YES at step S163, or when it is determined YES at step S164, CPU 21 gives the Previous Melody tone PM the Current Melody tone CM (step S165). When it is determined YES at step S164, since the Previous Chord name PreCH is the non verified chord, it is proper to start a new melody sequence.

CPU 21 refers to a melody sequence table to obtain a combination of a value corresponding to (PM, CM) (step S166). FIG. 22 is a view of an example of the melody sequence table used in the present embodiment. In the melody sequence table 2200 shown in FIG. 22, combinations of values corresponding to various combinations of the Previous Melody tone PM and the Current Melody tone CM are stored. When a combination of a value corresponding to (PM, CM) is found in the melody sequence table 2200, the combination is temporarily stored in RAM 23. Meanwhile, when no combination of a value corresponding to (PM, CM) is found in the melody sequence table 2200, information is stored in RAM 23, representing that no combination of a value corresponding to (PM, CM) is found.

CPU 21 specifies a tone (tone just prior to CM) of a key which has been pressed just prior to the Current Melody tone CM (step S167). The tone just prior to CM is the tone of the key which has been actually pressed, and cannot be the same as the Previous Melody tone PM. CPU 21 compares the specified tone just prior to CM with the Current Melody tone CM to judge whether or not a difference in pitch between them is more than 5 and semitone or more (step S168). When it is determined YES at step S168, CPU 21 judges whether or not the Current Melody tone CM relates to the key which has been pressed to the first beat (step S169).

In the melody sequence, a melody tone is contained as a core tone (core melody tone), and melody tones (ornament melody tone) can be contained to ornament the core tone with said core tone held between them. It is general that the ornament melody tone is not so different in pitch from the core melody tone. Meanwhile, in the case the melody tone moves to the following tone to make a pitch difference more than a certain degree (for example, about 4 degrees), (conjunct motion), the following tone is often given a comparatively large weight. Therefore, CPU 21 judges the pitch difference between the tones and performs the various processes depending on the pitch difference (step S168).

Figure 19:
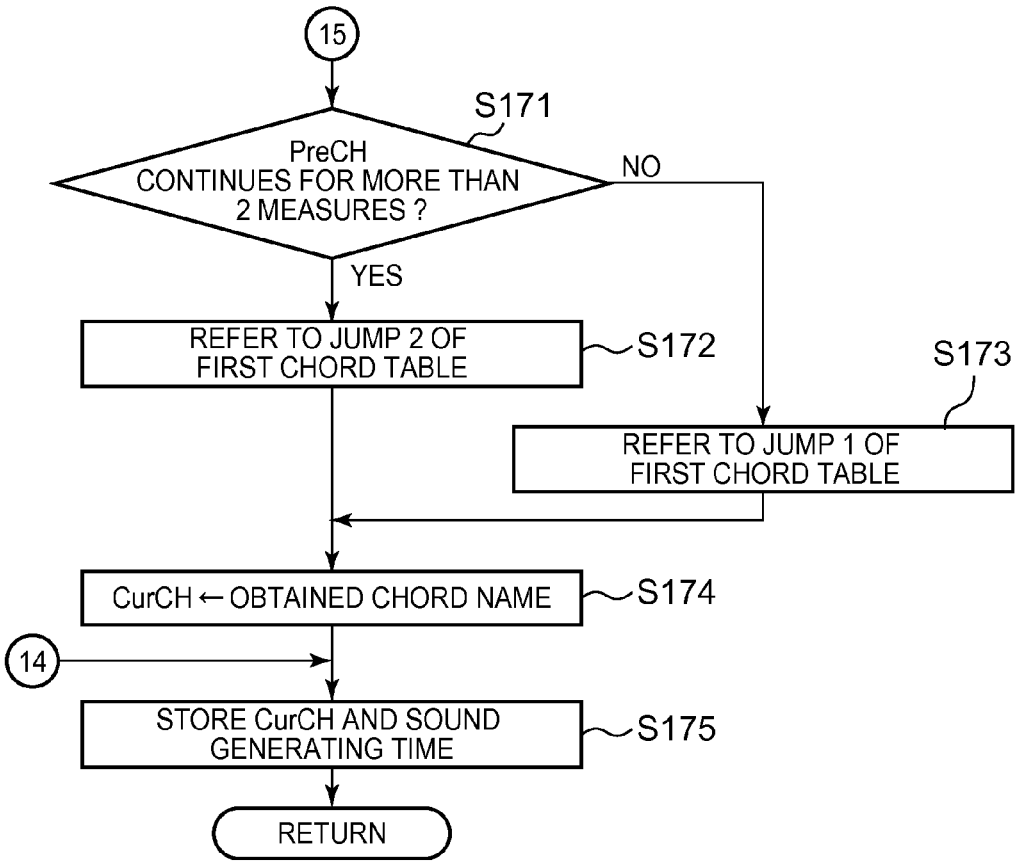

When it is determined YES at step S169, CPU 21 judges whether or not the Previous Chord name PreCH continues for more than two measures (step S171 in FIG. 19). When it is determined YES at step S171, CPU 21 determines to refer to the column of "jump 2" in the first chord table (FIG. 23) and reads the predetermined chord name from the first chord table (FIG. 23) (step S172). When it is determined NO at step S171, CPU 21 determines to refer to the column of "jump 1" in the first chord table 2300 and reads the predetermined chord name from the first chord table (FIG. 23) (step S173).

FIG. 23 is a view showing an example of the first chord table used in the present embodiment of the invention. In FIG. 23 is shown a part of the first chord table. In the chord table 2300 shown in FIG. 23, a chord name can be determined at least based on Previous Chord Function (See a reference numeral: 2310) and a combination of the Current Melody tone CM and Previous Melody tone PM (for instance, reference numerals: 2301 and 2302).

In the present embodiment, three sorts of elements: "non jump", "jump 1", and "jump 2" are prepared (See a reference numeral: 2311), and the chord name is determined based on the Previous Chord Function, a combination of the Current Melody tone CM and Previous Melody tone PM, and the sort.

Three functions such as "Tonic" TO, "Subdominant" SU, and "Dominant" DO are prepared as the Previous Chord Functions. The Tonic TO consists of chord names: "IMaj", "IM7", "IIImin", "IIIm7" "VImin", and "VIm7". The "Subdominant" SU consists of chord names: "IImin", "IIm7", "IIm7 (−5)", "IVMaj", "IVM7", "IVmin", and "IVmM7". The "Dominant" DO consists of chord names: "IIIMaj", "III7", "III7sus4", "VMaj", "V7", "V7sus4", and "VIIm7 (−5)". These chord names corresponding respectively to the Previous Chord Functions are previously stored in RAM 23.

The sort of "jump 2" consists of the chord names, which changes in a wide interval in consideration of the disjunct motion and continuation of the Previous Chord name PreCH in the melody sequence. Meanwhile, the sort of "jump 1" consists of the chord names, which changes in a less interval compared with the sort of "jump 2". As will be described, even though the first chord table 2300 is used, the sort of "non jump" is used when the sort of "jump 1" or "jump 2" does not appear.

For instance, in the case where the Previous Chord Function of the Previous Chord name PreCH is Tonic TO, the combination of the Current Melody tone CM and Previous Melody tone PM is (C, G), and the sort is "jump 2", CPU 21 obtains "VMaj" (See a reference numeral: 2321) from the first chord table 2300. And in the case where the Previous Chord Function of the Previous Chord name PreCH is Tonic TO, the combination of the Current Melody tone CM and Previous Melody tone PM is (C, G), and the sort is "jump 1", CPU 21 obtains "IMaj" (See a reference numeral: 2322) from the first chord table 2300.

CPU 21 stores in a predetermined area of RAM 23 the chord names obtained from the first chord table 2300 as the Current Chord name CurCH (step S174 in FIG. 19) and time of generating the sound in RAM 23 (step S175).

Figure 20:
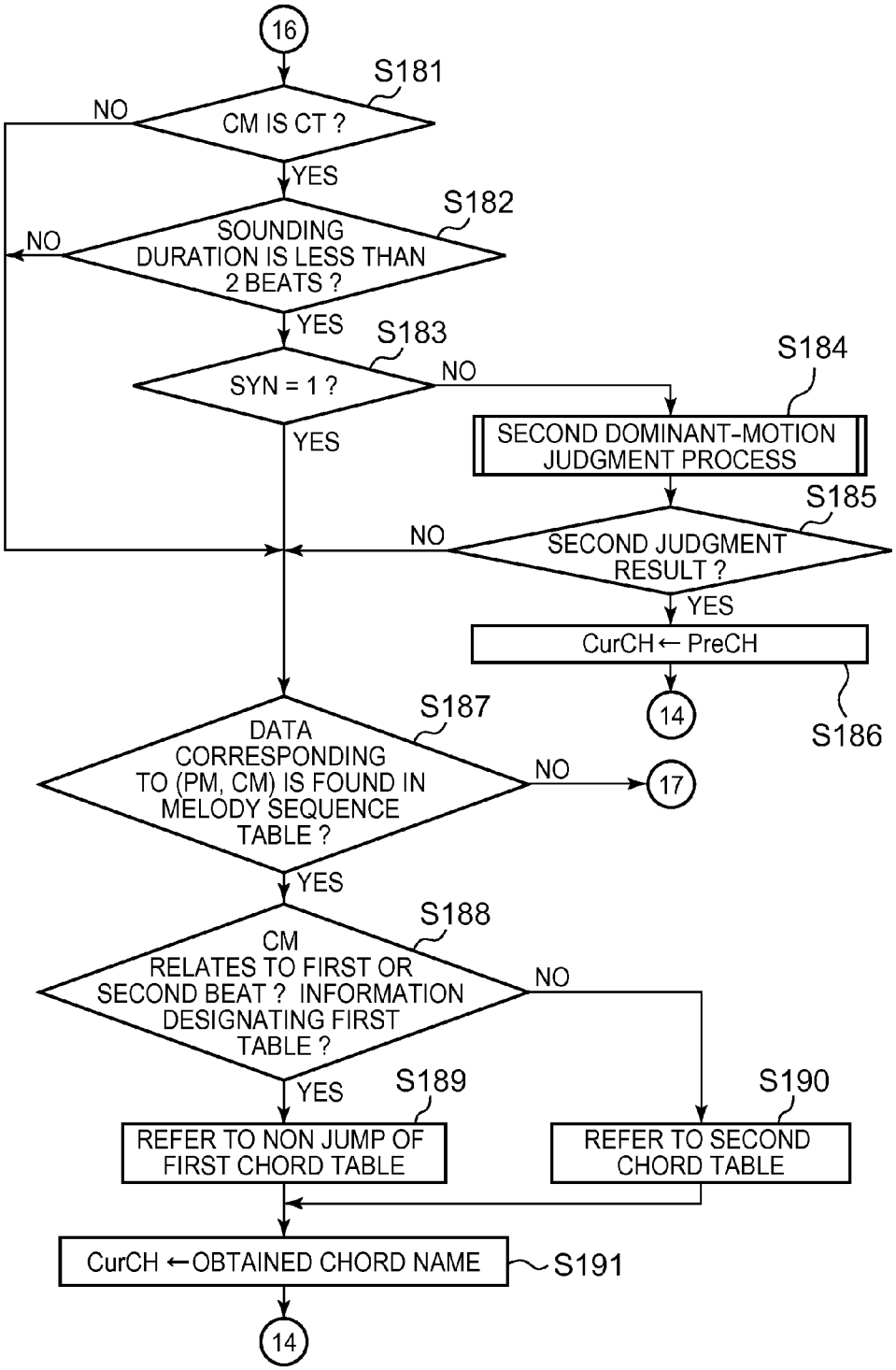

When it is determined NO at step S168, or when it is determined NO at step S169, a process is performed in accordance with a flow chart shown in FIG. 20. CPU 21 judges whether or not the Current Melody tone CM is the chord tone CT of the Previous Chord name PreCH (step S181 in FIG. 20). When it is determined YES at step S181, CPU 21 judges based on the sound-generation time of the musical tone of the Previous Chord name PreCH and the current time, whether or not a sounding duration of the Previous Chord name PreCH is 2 beats or less (step S182). When it is determined YES at step S182, CPU 21 judges whether or not a syncopation flag has been set to "1" (step S183).

When it is determined NO at step S183, CPU 21 performs the second dominant-motion judgment process (step S184) to judge whether or not the progress of tones from the Previous Melody tone PM to the Current Melody tone CM is the dominant motion. When it is determined that the second judgment result was obtained as the result of the second dominant-motion judgment process (YES at step S185), CPU 21 gives the Current Chord name CurCH the Previous Chord name PreCH (step S186). That is, the Previous Chord name PreCH is held.

When it is determined NO at step S181, when it is determined NO at step S182, or when it is determined NO at step S185, CPU 21 judges whether or not a combination of a value corresponding to the combination of the Previous Melody tone PM and Current Melody tone CM is found in the melody sequence table (step S187). Since the information representing that the combination of a value is found or not found in the melody sequence table, is stored in RAM 23 at step S166 in FIG. 18, CPU 21 refers to the information stored in the melody sequence table to make such judgment at step S187.

When it is determined YES at step S187, CPU 21 judges whether the Current Melody tone CM relates to the first beat or to the second beat and judges whether or not the table designating information designates the first chord table 2300 (step S188). When it is determined YES at step S188, CPU 21 determines to refer to the column of the "non jump" in the first chord table 2300 and obtains a predetermined chord name from the first chord table 2300 (step S189). Meanwhile, when it is determined NO at step S188, CPU 21 determines to refer to a second chord table (FIG. 24) and obtains a predetermined chord name from the second chord table (FIG. 24) (step S190).

FIG. 24 is a view showing an example of the second chord table used in the present embodiment. In FIG. 24 is shown a part of the second chord table. In the chord table 2400 shown in FIG. 24, a chord name can be determined based on the Previous Chord Function (See a reference numeral: 2410) and the combination of the Current Melody tone CM and Previous Melody tone PM (for instance, reference numerals: 2401 and 2402). For example, in the case where the Previous Chord Function of the Previous Chord name PreCH is "Subdominant" SU, and the combination of the Current Melody tone CM and Previous Melody tone PM is (C, G), CPU 21 obtains "VMaj" (See a reference numeral: 2421) from the second chord table 2400.

Thereafter, CPU 21 specifies a chord name as the Current Chord name CurCH in the first or second chord table 2300, 2400 (step S191), and stores the specified chord name together with the sound generating time in a specified area of RAM 23 (step S175 in FIG. 19).

When it is determined YES at step S187 in FIG. 20, since the combination of the Current Melody tone CM and Previous Melody tone PM is found in the melody sequence table, CPU 21 refers to the chord table and obtains a proper chord name. Meanwhile, when it is determined NO at step S187, a modulation is made or a non verified chord is temporarily determined. When it is determined NO at step S187, CPU 21 judges whether or not a sounding duration of the Current Melody tone CM is longer than a quarter note, that is, CPU 21 judges whether or not the sounding duration is longer than one beat (step S201 in FIG. 21).

When it is determined NO at step S201, CPU 21 gives the Previous Chord name PreCH the Current Chord name CurCH (step S207). In the case where it is determined NO at step S201, it is likely that the player has not pressed a key intentionally but in error. In this case, CPU 21 gives the Previous Chord name PreCH the Current Chord name CurCH without changing the chord name.

When it is determined YES at step S201, CPU 21 judges whether or not the sounding duration of the Current Melody tone CM is 3 beats or less (step S202). When it is determined YES at step S202, CPU 21 judges whether or not the modulation flag has been set to "2" or less (step S203). When it is determined YES at step S203, CPU 21 increments the modulation flag stored in RAM 23 (step S205). When it is determined NO at step S202, or when it is determined NO at step S203, CPU 21 performs a modulation process (step S204).

In the present embodiment, the melody tones including the Current Melody tone CM and Previous Melody tone PM are basically processed on the basis of the scale (tonality) C. Therefore, in the modulation process, a pitch difference between the modulated tonality and the scale C is calculated, and the calculated pitch difference (offset) is stored in RAM 23. After the modulation process is effected, a tone name specified by the key number of the actually pressed key can be processed on the scale C upon deduction of the offset from its pitch.

CPU 21 judges whether or not the Current Melody tone CM is either of the chord tone CT and Scale note SN of the Previous Chord name PreCH (step S206). In a similar manner to the process at step S61 in FIG. 8, at step S206, CPU 21 refers to the melody function table to judge whether or not a value corresponding to the combination of the Current Melody tone CM and the Previous Chord name PreCH is the chord tone CT or the Scale note SN. When it is determined YES at step S206, CPU 21 gives the Current Chord name CurCH the Previous Chord name PreCH, thereby holding the chord (step S207).

When it is determined NO at step S206, CPU 21 refers to a non verified-chord table to give the Current Chord name CurCH a diminished or augmented chord (step S208). FIG. 26 is a view showing an example of a part of the non verified-chord table used in the present embodiment. In the non verified-chord table 2600 shown in FIG. 26, a predetermined value can be obtained from a combination of a value corresponding to the combination of the Current Melody tone CM and Previous Chord name PreCH.

In the non verified-chord table 2600, an empty column (for instance, See a reference number: 2601) means that the Current Melody Function CMF corresponding to a combination of a value corresponding to the combination of the Current Melody tone CM and Previous Chord name PreCH is the Chord Tone CT or Scale Note SN (See FIG. 25). Therefore, in the non verified-chord table 2600, concerning the combination of the value of the combination of the Current Melody tone CM and Previous Chord name PreCH falling into the empty column, since the Current Chord name CurCH cannot be the non verified chord, a value is not stored. Therefore, in the non judged-chord table 2600, information of designating either diminished or augmented chord is stored, in the case where the Current Melody Function CMF is Other Tone.

CPU 21 obtains from the non judged-chord table 2600 information of designating either diminished or augmented chord corresponding to the combination of the value of the combination of the Current Melody tone CM and Previous Chord name PreCH and obtains a chord name having the Current Melody tone CM as the root tone. For instance, in the case where the current melody tone is "C♯" and the previous chord name is "IMaj", the chord name will be "I♯dim" (See a reference numeral: 2611). Further, in the case where the current melody tone is "A♭" and the previous chord name is "IM7", then the chord name will be "IV♯aug". In this manner, CPU 21 determines that the diminished or augmented chord name having the Current Melody tone CM as the root tone is the Current Chord name CurCH and stores the determined current chord name in RAM 23.

As described above in the present embodiment, the Current Melody tone CM of the key pressed to the head of the current beat and the Previous Melody tone PM of the key pressed to the head of the previous beat are modified in accordance with information representing what number the beat is, the Previous Chord name PreCH and the timing of the pressed key (step S21 to step S30 in FIG. 5). And then, the Current Chord name CurCH is determined based on the Current Melody tone CM, Previous Melody tone PM, and Previous Chord name PreCH (step S31).

Figure 45:
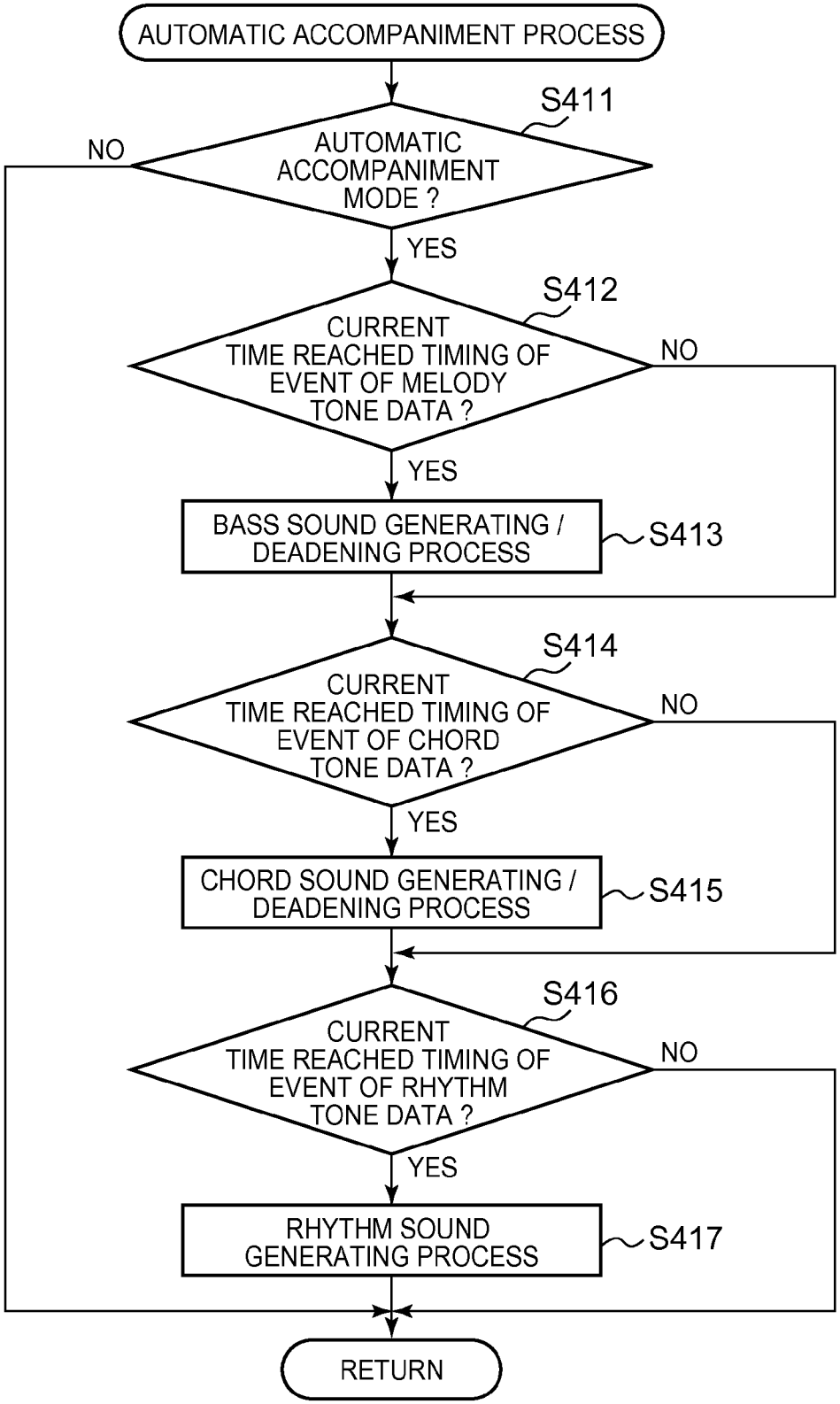
FIG. 45 is a flow chart of an example of an automatic accompaniment process performed in the present embodiment of the invention.

After finishing the chord-name determining process (step S4 in FIG. 3), CPU 21 performs an automatic accompaniment process (step S5). FIG. 45 is a flow chart of an example of the automatic accompaniment process performed in the present embodiment. CPU 21 judges whether or not the automatic accompaniment mode has been set in the electronic musical instrument 10 (step S411 in FIG. 45). When it is determined YES at step S411, CPU 21 refers to a timer (not shown) and judges whether or not the current time has reached a timing of performing an event expressed by melody-tone data contained in the automatic accompaniment data (step S412).

The automatic accompaniment data contains three sorts of musical tones: chord tones, bass tones and rhythm tones. Date of the bass tone (bass tone data) and data of the chord tones (chord tone data) contain the pitches, sound-generation timings and sound-generation durations of the musical tones to be generated. Data of the rhythm tone (rhythm tone data) contains the sound-generation timings of musical tones to be generated.

When it is determined YES at step S412, CPU 21 performs a bass-sound generating/deadening process (step S413). In the bass-sound generating/deadening process, CPU 21 judges whether or not the related event is a NOTE-ON EVENT. It is determined that the related event is the NOTE-ON EVENT, when the current time substantially coincides with the sound generation timing of a musical tone in the bass tone data. Meanwhile, it is determined that the related event is the NOTE-OFF EVENT, when the current time substantially coincides with the time at which the sound generation duration has lapsed after the sound generation timing of a musical tone in the bass tone data.

When the related event or the event to be processed is the NOTE-OFF EVENT, CPU 21 performs a sound deadening process. Meanwhile, the related event or the event to be processed is the NOTE-ON EVENT, CPU 21 performs a sound generating process of the bass tone data.

CPU 21 refers to the timer (not shown) to judge whether or not the current time has reached the timing of performing the event expressed by the chord tone data in the automatic accompaniment data (step S414). When it is determined YES at step S414, CPU 21 performs a chord sound generating/deadening process (step S415). In the chord sound generating/deadening process, CPU 21 performs the sound generating process of the chord tones, the sound generation timing of which has reached. Meanwhile, CPU 21 performs the sound deadening process of the chord tones, the sound deadening timing of which has reached.

CPU 21 judges whether or not the current time has reached the timing of performing the event expressed by the rhythm tone data in the automatic accompaniment data (step S416). When it is determined YES at step S416, CPU 21 performs a rhythm sound generating process (step S417). In the rhythm sound generating process, CPU 21 creates a NOTE-ON EVENT of the rhythm tone, the sound generation timing of which has reached.

After the automatic accompaniment process is performed (step S5 in FIG. 3), CPU 21 performs the sound-source sounding process (step S6 in FIG. 3). In the sound-source sounding process, CPU 21 supplies the sound source unit 26 with data representing a tone color and pitch of a musical tone, the sound of which is to be generated, based on the created NOTE-ON EVENT, or supplies the sound source unit 26 with data representing a tone color and pitch of a musical tone, the sound of which is to be deadening. The sound source unit 26 reads waveform data from ROM 22 in accordance with the data representing the tone color, pitch and duration, and creates musical tone data, whereby a musical tone is output through the speaker 28. Meanwhile, CPU 21 gives the sound source unit 26 an instruction to mute a musical tone of a pitch indicated by the NOTE-OFF EVENT.

After the sound-source sounding process is performed (step S6 in FIG. 3), CPU 21 performs other processes, including a storing process of storing the Current Chord name CurCH and Current Melody tone CM in RAM 23, a displaying process of displaying an image on the displaying unit 15, and a process of turning on/off LED (not shown), and advances to step S8.

CPU 21 judges whether or not the performance has finished (step S8). More specifically, CPU 21 judges whether or not the non real-time adjustment switch 14 has been operated. When it is determined YES at step S8, CPU 21 advances to step S9. When it is determined NO at step S8, CPU 21 returns to step S2. When it is determined that the performance finishes, the chord data and melody data are stored in RAM 23 as a result of the real-time chord placing operation in the process at step S7.

Figure 27:
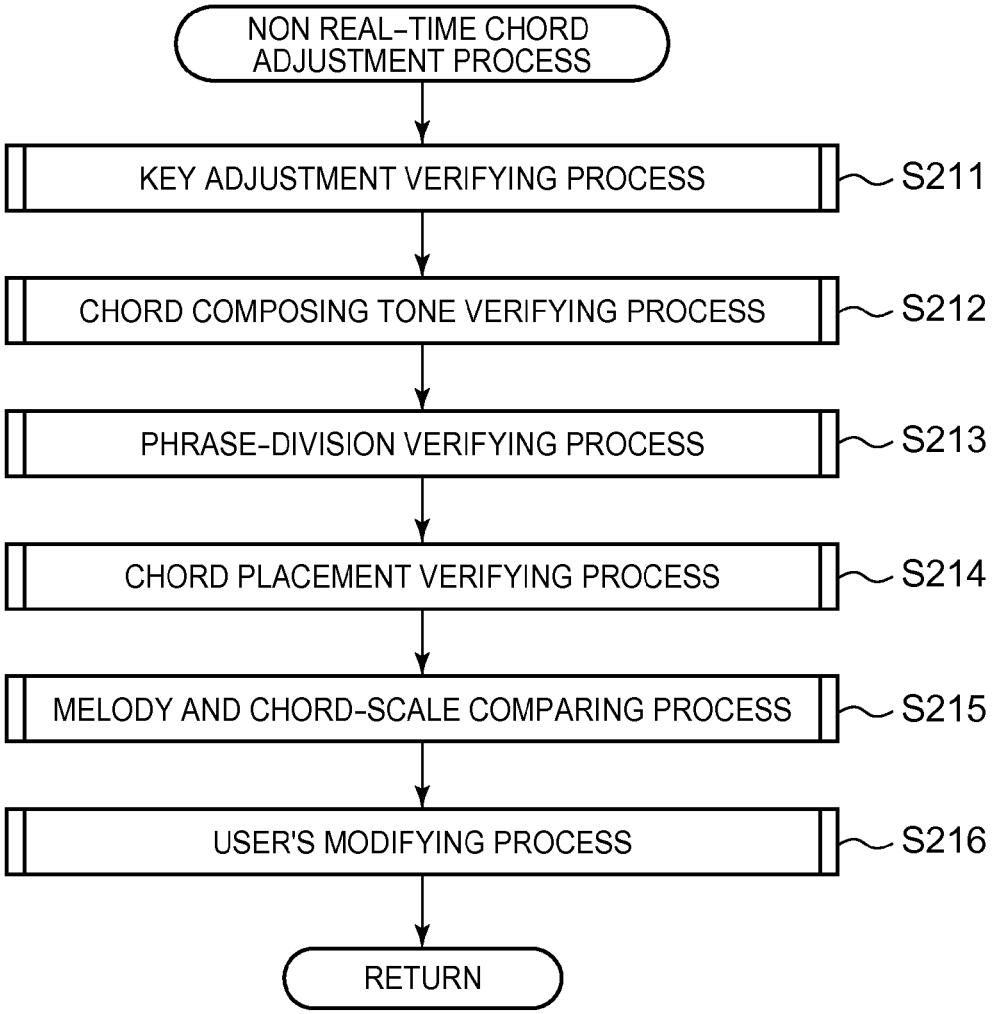
FIG. 27 is a flow chart of an example of a non real-time chord adjustment process performed in the present embodiment of the invention.

CPU 21 performs a non real-time chord adjustment process in accordance with a flow chart shown in FIG. 27. When the non real-time chord adjustment process (step S9) finishes, CPU 21 finishes the main process shown in FIG. 3.

FIG. 27 is a flow chart of an example of the non real-time chord adjustment process performed in the present embodiment of the invention.

Figure 28:
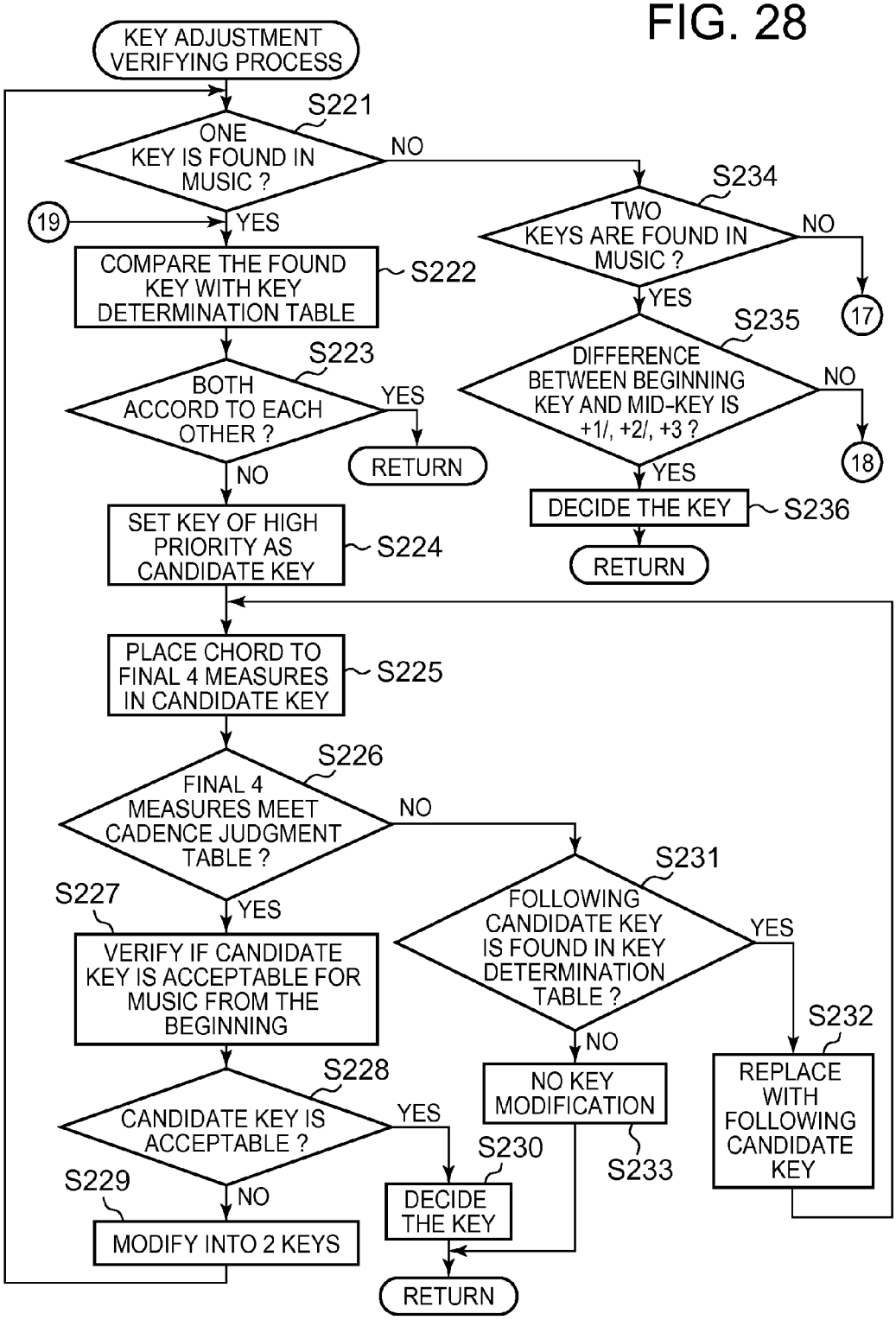
FIG. 28 and FIG. 29 are flow charts of an example of a key-adjustment verifying process performed in the present embodiment of the invention.
Figure 29:
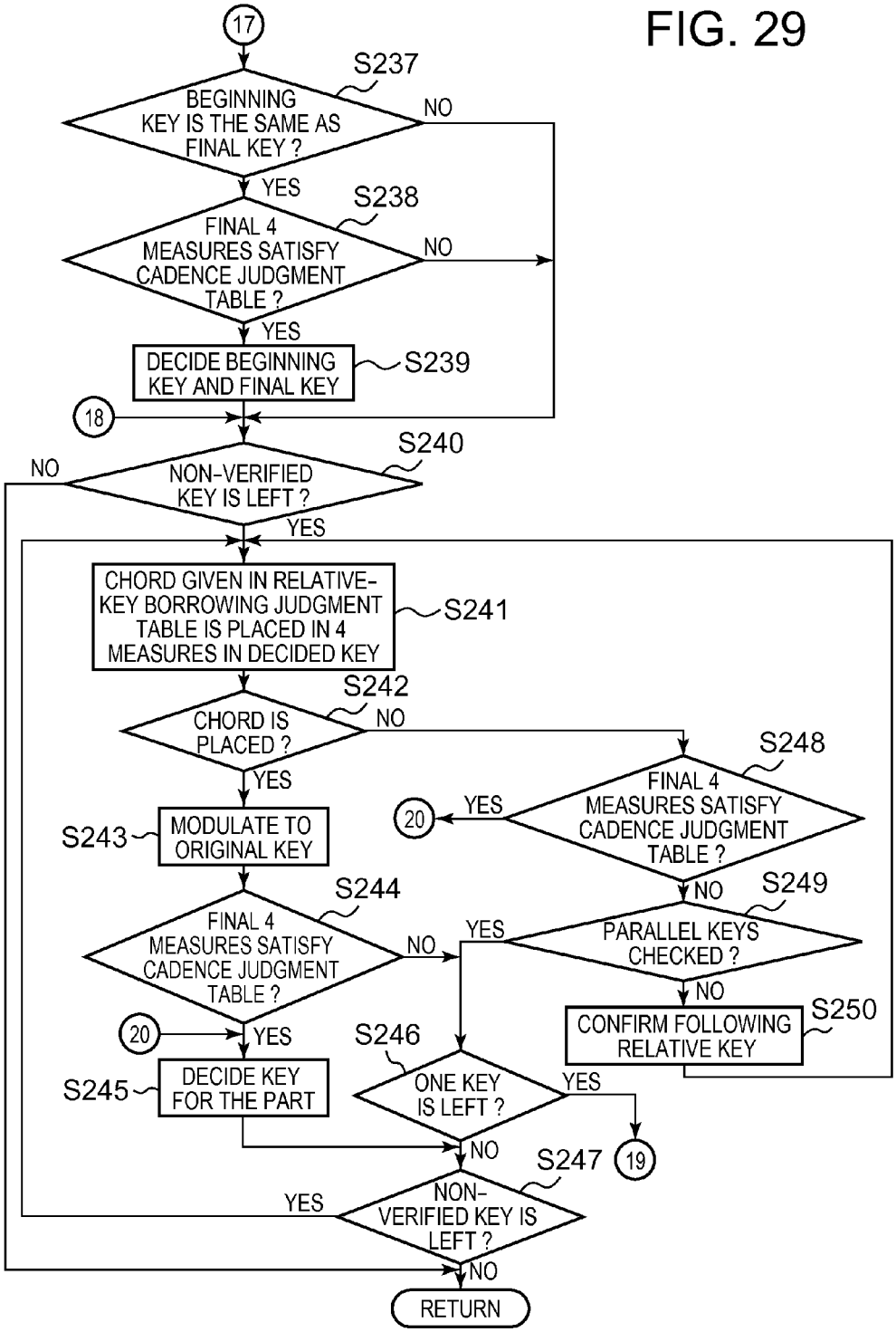

CPU 21 performs a key-adjustment verifying process in accordance with flow charts shown in FIG. 28 and FIG. 29 (step S211).

Figure 30:
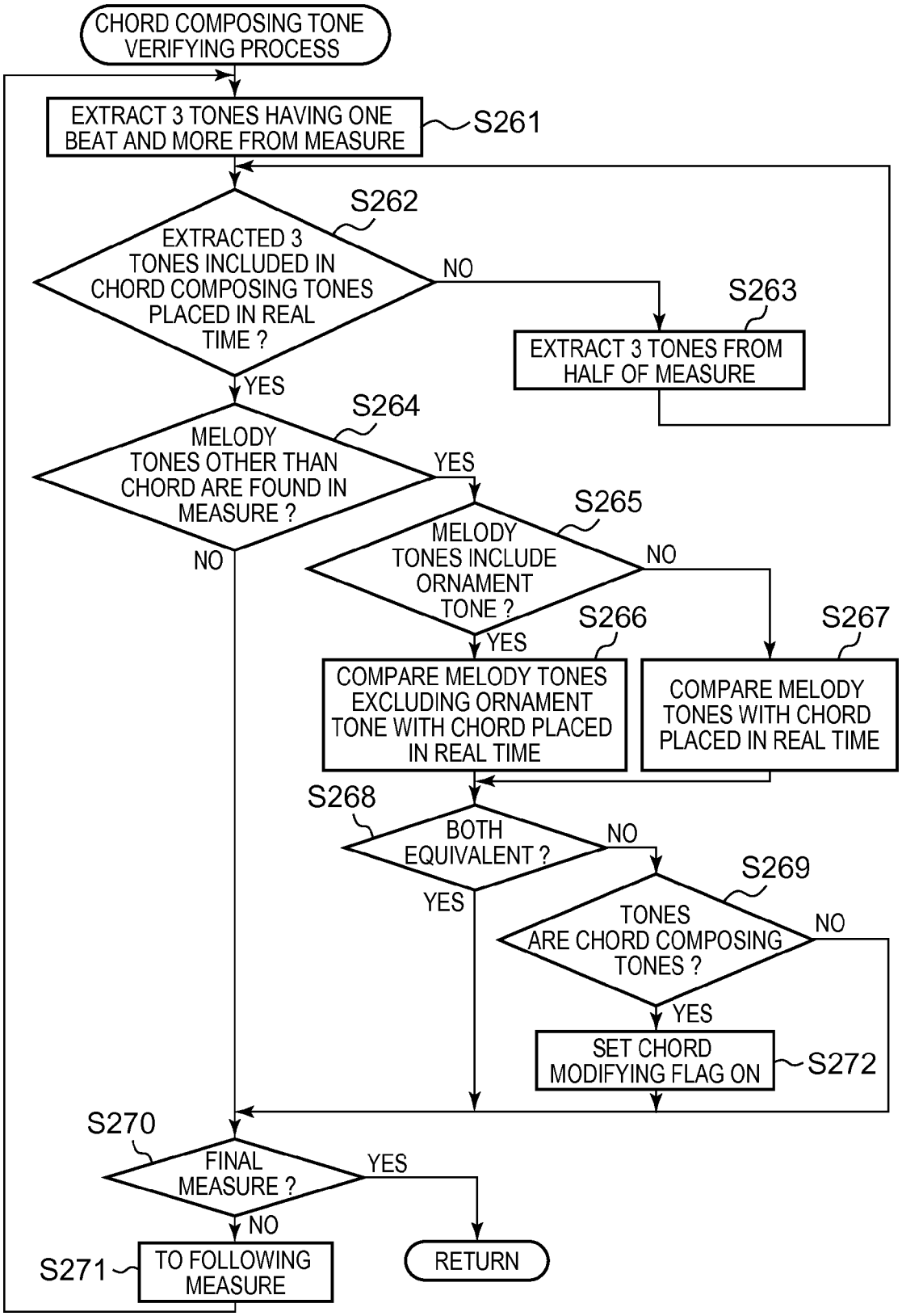
FIG. 30 is a flow chart of an example of a chord composing tone verifying process performed in the present embodiment of the invention.

CPU 21 performs a chord composing tone verifying process in accordance with a flow chart shown in FIG. 30 (step S212).

CPU 21 performs a phrase-division verifying process in accordance with flow charts shown in FIG. 31 to FIG. 34 (step S213).

Figure 35:
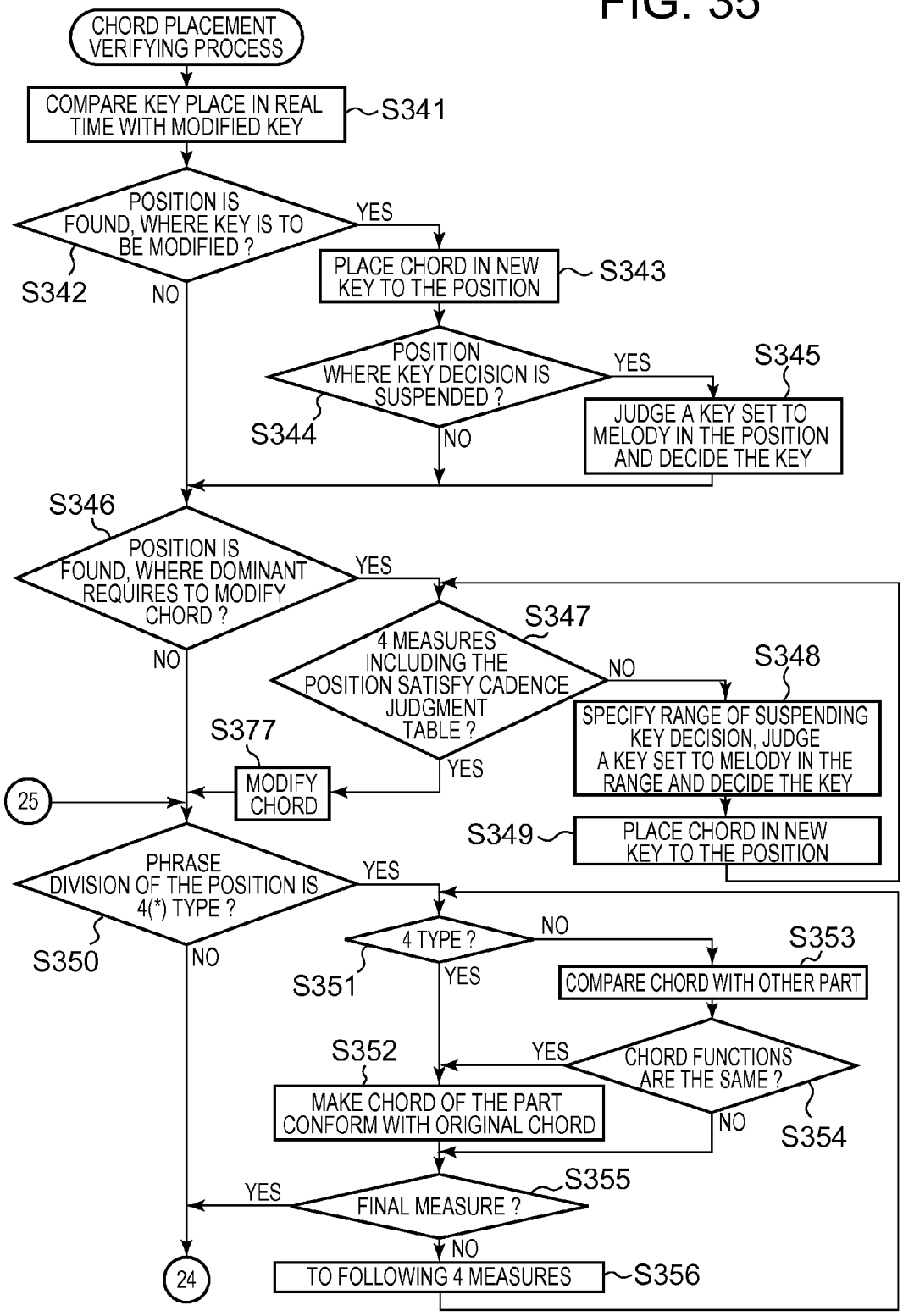
FIG. 35 and FIG. 36 are flow charts of an example of a chord placement modifying process performed in the present embodiment.
Figure 36:
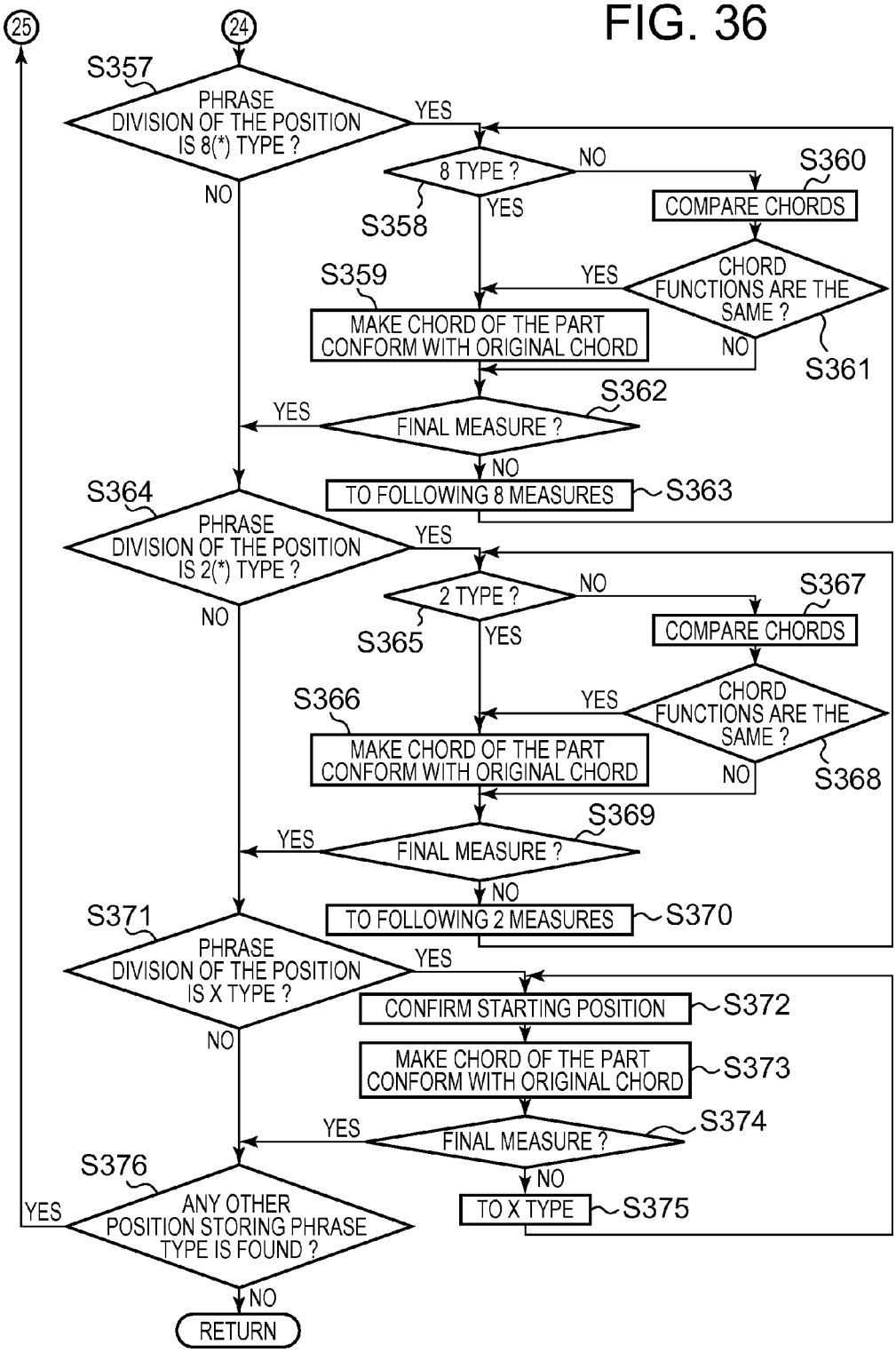

CPU 21 performs a chord placement modifying process in accordance with flow charts shown in FIG. 35 and FIG. 36 (step S214).

Figure 37:
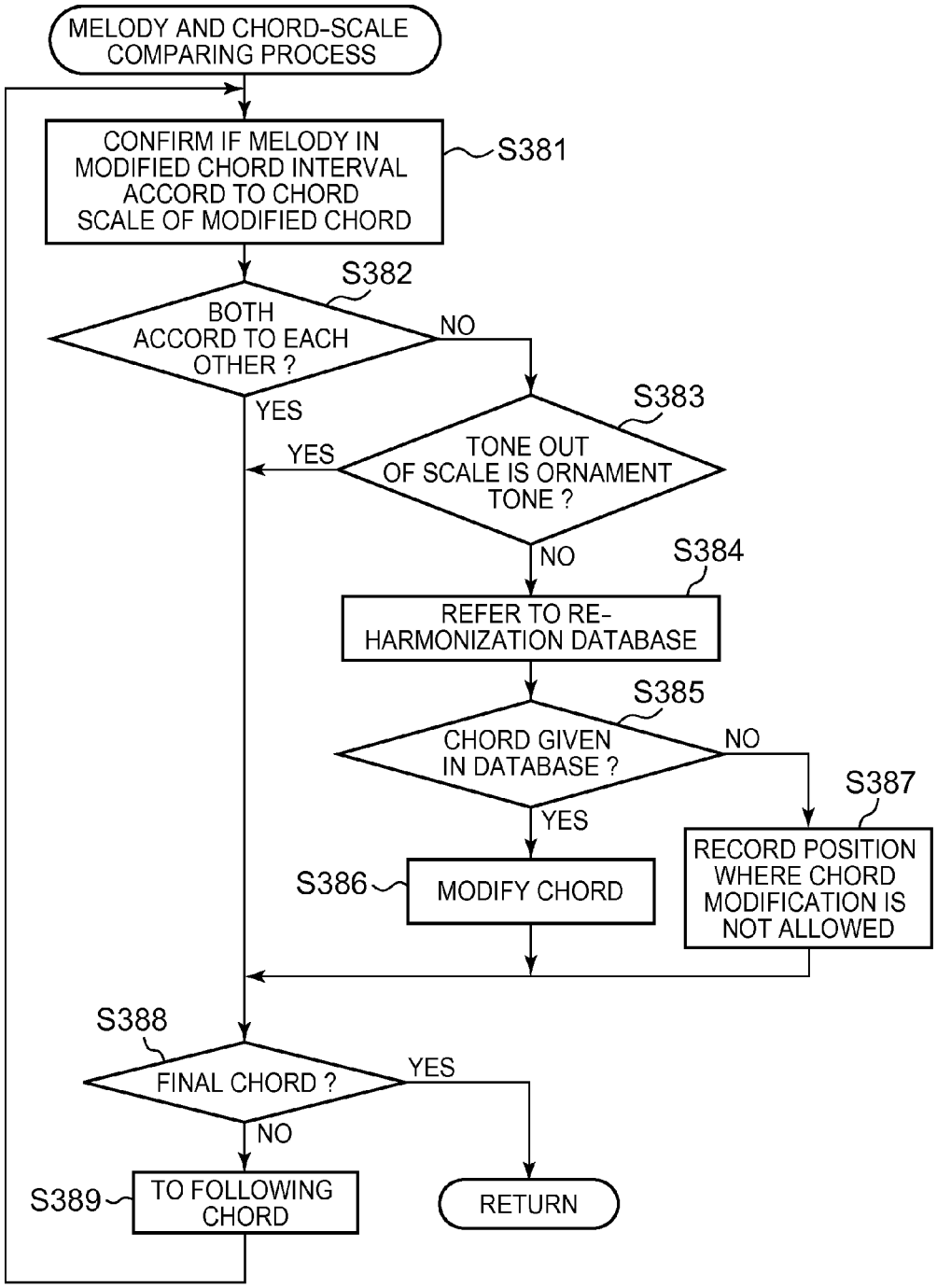
FIG. 37 is a flow chart of an example of a melody and chord-scale comparing process performed in the present embodiment of the invention.

CPU 21 performs a melody and chord-scale comparing process in accordance with a flow chart shown in FIG. 37 (step S215).

Figure 38:
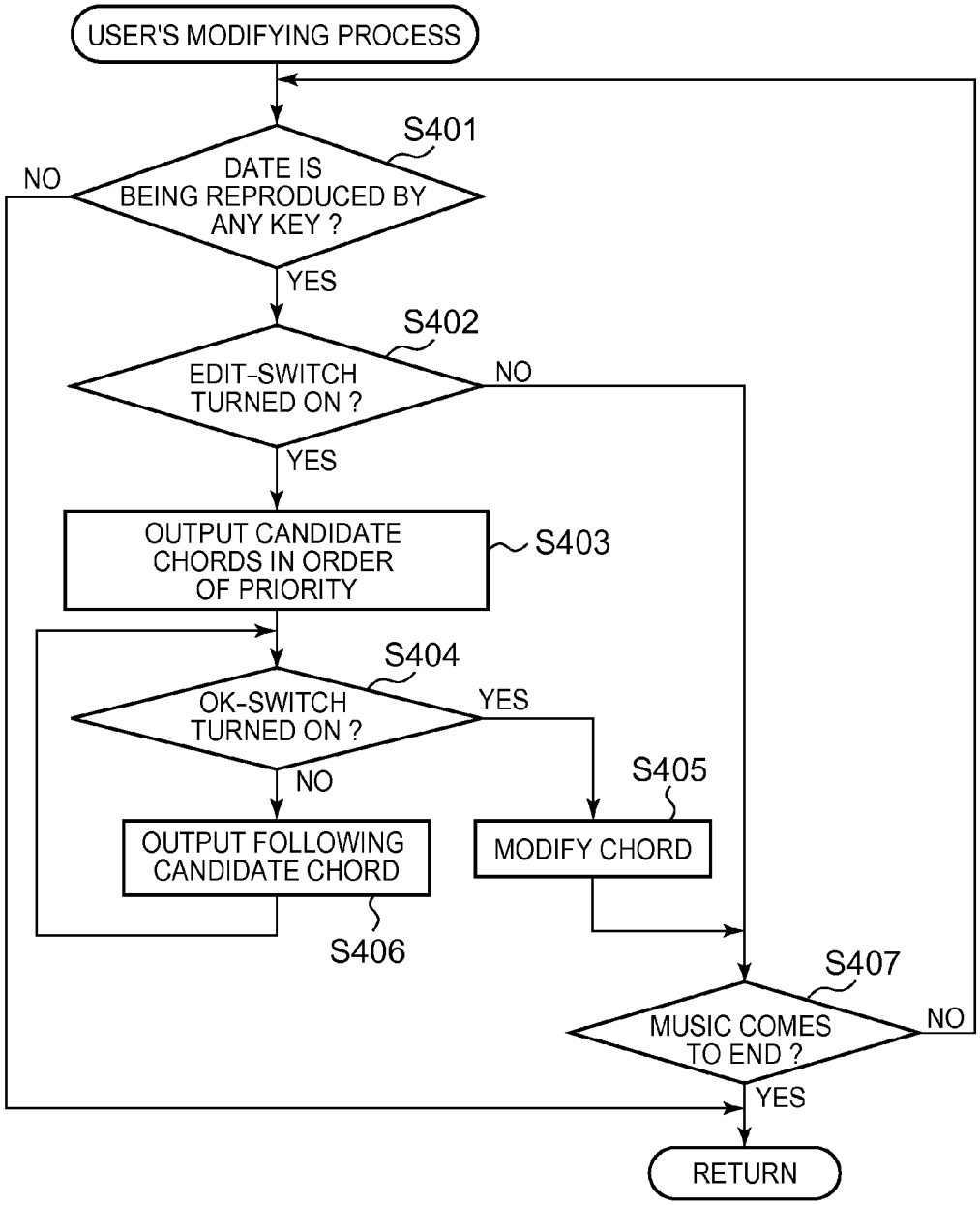
FIG. 38 is a flow chart of an example of a user's modifying process in the present embodiment.

CPU 21 performs a user's modifying process in accordance with a flow chart shown in FIG. 38 (step S216).

Thereafter, CPU 21 finishes the non real-time chord adjustment process.

FIG. 28 and FIG. 29 are flow charts of an example of the key-adjustment verifying process performed in the present embodiment of the invention.

CPU 21 judges whether or not the number of keys (mid-keys) in the course of music is one (step S221). More specifically, CPU 21 judges whether or not the number of the sorts of keys (mid-keys) stored in RAM 23. The keys (mid-keys) in the course of the musical piece are decided based on a history of pitches of the melody input from the keyboard 11 during the course of performance. For example, the mid-keys can be obtained by extracting tone-name groups corresponding to the history of pitches of the melody and searching for the key (tonality) contained in all the diatonic scales, in which the tone-name groups are contained. In this case, a table, which contains diatonic scale notes of each key will be used. When it is determined YES at step S221, CPU 21 advances to step S222, and when it is determined NO at step S221, CPU 21 advances to step S234.

CPU 21 compares the mid-key with a key-determination table (FIG. 39) in accordance with the final melody tone (step S222). More specifically, CPU 21 refers to the key-determination table (FIG. 39) to compare the mid-key with the final melody tone. For example, in the case where the mid-key is "C" and the final melody tone is either of "C", "E" and "G", since "C(1)" is stored in a position, where the mid-key "C" and the final melody tone correspond to each other, and therefore, it will be determined "matched" at step S223.

Meanwhile, in the case where the mid-key is "C" and the final melody tone is "A", then no data is stored in a position, where the mid-key "C" and the final melody tone correspond to each other, and therefore, it will be determined "not matched" at step S223.

CPU 21 judges whether the result of the comparison is "matched" or not (step S223). When it is determined the result is "matched" or YES at step S223, since the key judgment is acceptable, CPU 21 finishes the key-judgment verifying process. When it is determined the result is not "matched" or NO at step S223, CPU 21 advances to step S224.

CPU 21 employs the key of the high priority order as a candidate key among from the keys of the final tones given in the key-determination table of the final melody tone. In other words, CPU 21 refers to the key-determination table of the final melody tone (FIG. 39) to determine the candidate key. For instance, in the case where the final melody tone is "A", keys F(1), D(2), and A(3) are stored in the column of "A" of the key-determination table (FIG. 39). The keys F, D and A are the most possible keys placed when the melody has finished with the tone "A", and the numeral in parentheses represents the priority order. Therefore, in the case where it is determined in the real-time key judgment that the mid-key is "C" and the final melody tone is "A", the key F of the high priority order will be the candidate key for the final part of the musical piece. The key-determination table shown in FIG. 39 is for the major keys but a table (not shown) for the minor keys will be used.

CPU 21 places chords in the final four measures in the candidate key (step S225), and judges whether or not the final four measures meet a cadence judgment table (FIG. 40) (step S226). The above processes are performed to verify if the candidate keys will be acceptable for the final part of the musical piece. For example, in the case of the candidate key "F", CPU 21 places chords in the final four measures in the candidate key "F" and judges whether or not the chord functions of the beginning four measure placed with the chords accords with the chord function of the ending part of the musical piece in the cadence judgment table. When the result of judgment is YES at step S226, CPU 21 advances to step S227. When the result of judgment is NO at step S226, CPU 21 advances to step S231.

The cadence judgment table shown in FIG. 40 is a table, which divides the musical piece into the ending part and middle part and shows cadences of the respective parts. The musical piece can be divided into more parts such as an introduction part and a hook part. In the cadence judgment table shown in FIG. 40, "T" denotes Tonic chord, "D" Dominant chord, and "S" Subdominant chord.

CPU 21 verifies if the candidate key is acceptable for the musical piece from the beginning thereof. The process is performed when the final four measures in the candidate key accord with the chord function of the ending part of the musical piece in the cadence judgment table. For example, in the case of the candidate key "F", it is determined that the key of the final four measures is "F", but CPU 21 reads melody tone data from RAM 23 to verify if the key "F" is established from the beginning part of the musical piece, wherein the melody tone data has been input into RAM 23 in real time from the beginning part of the musical piece (keyboard process at step S3 in FIG. 4).

CPU 21 judges whether or not the candidate key is acceptable (step S228). In other words, CPU 21 judges at step S227, whether or not the candidate key has been established from the beginning part of the musical piece. When the result of judgment is YES at step S228, CPU 21 advances to step S230. When the result of judgment is NO at step S228, CPU 21 advances to step S229.

CPU 21 modifies the key into 2 keys at a position of an inconsistency (step S229). More specifically, CPU 21 refers to the result of the verification made at step S227 to divide the musical piece into two parts: one part from the beginning of the musical piece, where the candidate key is not established and other part from a position where the candidate key begins to be established to the ending of the musical piece. For example, in the case where it has been determined in the real time key judgment that the mid-key is "C" and the candidate key is "F", CPU 21 divides the key into two keys, "C" and "F". Thereafter, CPU 21 returns to step S221.

When the result of judgment is YES at step S228, since the candidate key is established from the beginning part of the musical piece, CPU 21 decides the key at step S230, finishing the key-judgment verifying process.

At step S231, CPU 21 judges whether or not the following candidate key is found in the key determination table (FIG. 39). More specifically, CPU 21 refers to the key determination table to search for the following candidate key. For example, in the case where the final melody tone is "A" and the candidate key is "F", the key "D" of the second priority is found as the following candidate key in the key determination table. Meanwhile, in the case where the final melody tone is "A" and the candidate key is "A", no following candidate key is found in the key determination table. When it is determined that the following candidate key has been found (YES at step S231), CPU 21 advances to step S232. When it is determined NO at step S231, CPU 21 advances to step S233.

At step S232, CPU 21 replaces the candidate key with the following candidate key found at step S231, and advances to step S225.

At step S233, CPU 21 makes no modification of key, finishing the key-judgment verifying process.

At step S234, CPU 21 judges whether or not 2 keys in the musical piece are included. When it is determined YES at step S234, CPU 21 advances to step S235. When it is determined NO at step S234, CPU 21 advances to step S237 in FIG. 29.

At step S235, CPU 21 judges whether or not a difference between a beginning key and the mid-key is either of +1 and semitone, +2 and semitone, and +3 and semitone. When it is determined YES at step S235, CPU 21 advances to step S236. When it is determined NO at step S235, CPU 21 advances to step S240 in FIG. 29.

At step S236, CPU 21 decides the key, finishing the key-judgment verifying process.

At step S237 in FIG. 29, CPU 21 judges whether or not the beginning key is the same as the final key. When it is determined YES at step S237, CPU 21 advances to step S238. When it is determined NO at step S237, CPU 21 advances to step S240.

At step S238, CPU 21 judges whether or not the final four measures satisfy the cadence judgment table (FIG. 40). More specifically, CPU 21 refers to the columns of the middle part of the cadence judgment table (FIG. 40) and judges whether or not the chord functions of the final four measures in the beginning key accord with the chord functions of the middle part in the cadence judgment table. Meanwhile, CPU 21 refers to the column of the ending part of the cadence judgment table (FIG. 40) and judges whether or not the chord functions placed in the final four measures in the final key accord with the chord functions placed in the ending part given in the cadence judgment table. When it is determined YES at step S238, CPU 21 advances to step S239. When it is determined NO at step S238, CPU 21 advances to step S240.

At step S239, CPU 21 decides the beginning key and final key. For example, when it is determined at step S238 that only the beginning key satisfies the cadence judgment table, only the beginning key is decided. When it is determined that only the final key satisfies the cadence judgment table, only the final key is decided. Further, when it is determined that both the beginning and final keys satisfy the cadence judgment table, both the beginning and final keys are decided.

At step S240, CPU 21 judges whether or not a not-verified key is left. When the result of this judgment is YES, CPU 21 advances to step S241. When the result of the judgment is NO, CPU 21 finishes the key-judgment verifying process.

At step S241, CPU 21 refers to a relative key borrowing judgment table, and judges whether or not the chord given in the relative key borrowing judgment table is placed within the four measures in the decided key. More specifically, CPU 21 refers to the relative key borrowing judgment table (FIG. 41), and judges whether or not the tonic-key specific chords given in the relative key borrowing judgment table are placed in the four measures in the decided key.

For instance, in the case where three keys are placed, the beginning key is "C", and a key between the beginning key and final key is a dominant key (the dominant key of the beginning key or the tonic key C is G), CPU 21 judges whether or not the tonic-key specific chords, V7 (G7) or IIm (Dm) are placed in the first four measures in the dominant key.

The tonic-key specific chord will be described. For instance, in the case where the tonic key is C, the dominant key G is a key with only the fourth tone (fa) in the tonic key being higher by a semitone. When the tonic key C (composed of do, re, mi, fa, so, la, and si) is compared with the dominant key G (composed of so, la, si, do, re, mi, and fa♯), the dominant key G does not include "fa", and therefore the chords G7 and Dm including "fa" are not the chords of the dominant key G but the chords of the tonic key C. In this sense, the name of tonic-key specific chord is referred to in the present embodiment.

At step S242, CPU 21 judges whether or not the chord placed in the four measures is found in the relative key borrowing judgment table (step S241). When it is determined YES at step S242, CPU 21 advances to step S243. When it is determined NO at step S242, CPU 21 advances to step S248.

At step S243, CPU 21 modulates the key of the musical piece to the original key at the position where the chord is matched with the chord given in the relative key borrowing judgment table. For instance, the key is altered to the tonic key (beginning key) at the position where the tonic-key specific chord is placed or found.

At step S244, CPU 21 judges whether or not the final four measures satisfy the cadence judgment table. In this process (step S244), CPU 21 refers to the column of "muddle part" of the cadence judgment table (FIG. 40), using the key modulated at step S243, and judges whether or not the chord functions placed in the final four measures in the modulated key accord with the chord functions given in the column of "middle part" of the cadence judgment table (FIG. 40). When it is determined YES at step S244, CPU 21 advances to step S245. When it is determined NO at step S244, CPU 21 advances to step S246.

At step S245, CPU 21 decides the key (modulated key) of the part and advances to step S247.

At step S246, CPU 21 judges whether or not the number of left keys is one. When it is determined YES at step S246, CPU 21 returns to step S222 in FIG. 28. When it is determined NO at step S246, CPU 21 advances to step S247.

At step S247, CPU 21 judges whether any not-verified key is left or not. When it is determined YES at step S247, CPU 21 returns to step S241. When it is determined NO at step S247, CPU 21 finishes the key-judgment verifying process.

At step S248, CPU 21 judges whether or not the final four measures satisfy the cadence judgment table. In this process (step S248), CPU 21 refers to the column of "muddle part" in the cadence judgment table (FIG. 40), using the not-verified key, and judges whether or not the chord functions placed in the final four measures in the not-verified key accord with the chord functions given in the column of "middle part" of the cadence judgment table (FIG. 40). When it is determined YES at step S248, CPU 21 advances to step S245. When it is determined NO at step S244, CPU 21 advances to step S249.

At step S249, CPU 21 judges whether or not parallel keys have been checked. In other words, CPU 21 judges whether or not the tonic-key specific chord has been found in the column (bottom line) of parallel keys of the relative key borrowing judgment table (FIG. 41). When the result of the judgment at step S249 is YES, CPU 21 advances to step S246. When it is determined NO at step S249, CPU 21 advances to step S250.

At step S250, CPU 21 advances to step S241 to confirm the following relative key. For example, if the dominant key has been checked, the following subdominant key is confirmed.

FIG. 30 is a flow chart of an example of a chord composing tone verifying process performed in the present embodiment of the invention. In the case where ornament tones such as appoggiatura and passing tones are placed to strong beats or downbeats in the musical piece by the real-time automatic chord placing operation, since the ornament tones affects such chord placing operation, the chord placement can be made in the wrong. In the present embodiment, a dominant verifying process is performed to modify such wrong chord placement. More specifically, CPU 21 extracts chord composing tones except the ornament tones from melody tones in each measure, and verifies if the chord composed of the extracted tones is the same as the chord placed in the real-time chord placing operation.

At step S261, CPU 21 extracts 3 tones in order of duration among from tones having a duration of one beat or more in the measure. More specifically, CPU 21 reads chord data and melody data from RAM 23 and extracts 3 tones in order of duration among from the tones having a duration of one beat or more in the measure, wherein the chord data and melody data are stored as a result of the real-time chord placing operation executed during in the performance of the musical piece, and the measure is a measure to be processed by CPU 21. Initially, the measure is the first measure.

At step S262, CPU 21 judges whether or not the extracted 3 tones are included in the chord composing tones placed by the real-time chord placing operation. More specifically, CPU 21 refers to a chord scale table (FIG. 43). For example, in the case of the chord IMajor placed in the real-time chord placing operation, CPU 21 judges whether or not 3 tones extracted step S261 or step S263 are the chord composing tones "CT", "C, E, G". When the result of the judgment at step S262 is YES, CPU 21 advances to step S246. When it is determined NO at step S262, CPU 21 advances to step S263. If the extracted 3 tones are the chord composing tones "CT", these 3 tones will be dominants.

At step S263, CPU 21 extracts 3 tones in order of duration among from tones in half of the measure, and returns to step S262.

At step S264, CPU 21 judges whether or not any melody tone is found other than the chord in the measure. More specifically, in the case where a tone other than the 3 tones extracted at step S261 or step S263 is found in the measure to be processed by CPU 21 and the tone is not the chord composing tone "CT" given in a chord scale table (FIG. 43), such tone will be the melody tone other than the chord. When it is determined YES at step S264, CPU 21 advances to step S265. When it is determined NO at step S264, CPU 21 advances to step S270.

At step S265, CPU 21 judges whether or not the melody tones found at step S264 include any ornament tone. More specifically, CPU 21 refers to an ornament tone database (FIG. 42) to make the above judgment. When the result of the judgment at step S265 is YES, CPU 21 advances to step S266. When it is determined NO at step S265, CPU 21 advances to step S267.

The ornament tone database will be described with reference to FIG. 42. The ornament tone database is referred to confirm whether or not any ornament tone (tone other than the chord composing tones) is found in the downbeats (in the case of the quadruple meter, the first and third beats). In the ornament tone database shown in FIG. 42, in the case of the quadruple meter, an ornament tone (for example, an appoggiatura) other than the chord composing tones is placed at the first beat, a chord composing tone is placed at the second beat (weak beat) and said chord composing tone at the second beat is higher or lower in pitch than the tone at the first beat by the whole tone (or semitone), then it will be determined that the tone at the first beat is the ornament tone. Tones at the third and fourth beats will be determined in the same manner.

Although not shown in FIG. 42, it can be determined whether or not an ornament tone is found in the case of the double meter and/or the triple meter other than the quadruple meter.

At step S266, CPU 21 compares the melody tones other than the chord composing tones excluding the ornament tones with the chord placed in the real-time chord placing operation. More specifically, CPU 21 reads the chord placed in the real-time chord placing operation from RAM 23 and judges whether or not the tones in the measure to be processed excepting the ornament tones are equivalent to the chord composing tones (CT) corresponding to each chord in the chord scale table of FIG. 43.

At step S267, CPU 21 compares the melody tones other than the chord composing tones with the chord placed in the real-time chord placing operation. More specifically, CPU 21 reads the chord placed in the real-time chord placing operation from RAM 23 and judges whether or not the tones in the measure to be processed are equivalent to the chord composing tones (CT) corresponding to each chord in the chord scale table of FIG. 43.

At step S268, CPU 21 decides if the result of the comparison made at step S266 and step S267 is YES or NO. When it is determined YES at step S268, CPU 21 advances to step S270. When it is determined NO at step S268, CPU 21 advances to step S269.

At step S269, CPU 21 judges whether or not the tones in the measure to be processed can be established as chord composing tones. More specifically, CPU 21 refers to the chord scale table of FIG. 43, and judges whether or not the tones compared at step S266 and step S267 are the chord composing tones (CT). When it is determined YES at step S269, CPU 21 advances to step S272. When it is determined NO at step S269, CPU 21 advances to step S270.

At step S272, CPU 21 sets a chord modifying flag to ON. More specifically, CPU 21 sets the chord modifying flag corresponding to the measure to be processed to ON. The chord modifying flag is stored in a predetermined area of RAM 23. After the process of step S272, CPU 21 modifies the chord placed in the measure to be processed in a chord modifying process (FIG. 35) to be described later.

At step S270, CPU 21 judges whether or not the measure is the final measure. When it is determined YES at step S270, CPU 21 finishes the chord composing tone verifying process. When it is determined NO at step S270, CPU 21 advances to step S271.

At step S271, CPU 21 sets the following measure to be processed in the chord composing tone verifying process (step S261).

FIG. 31 to FIG. 34 are flow charts of an example of the phrase-division verifying process.

Figure 31:
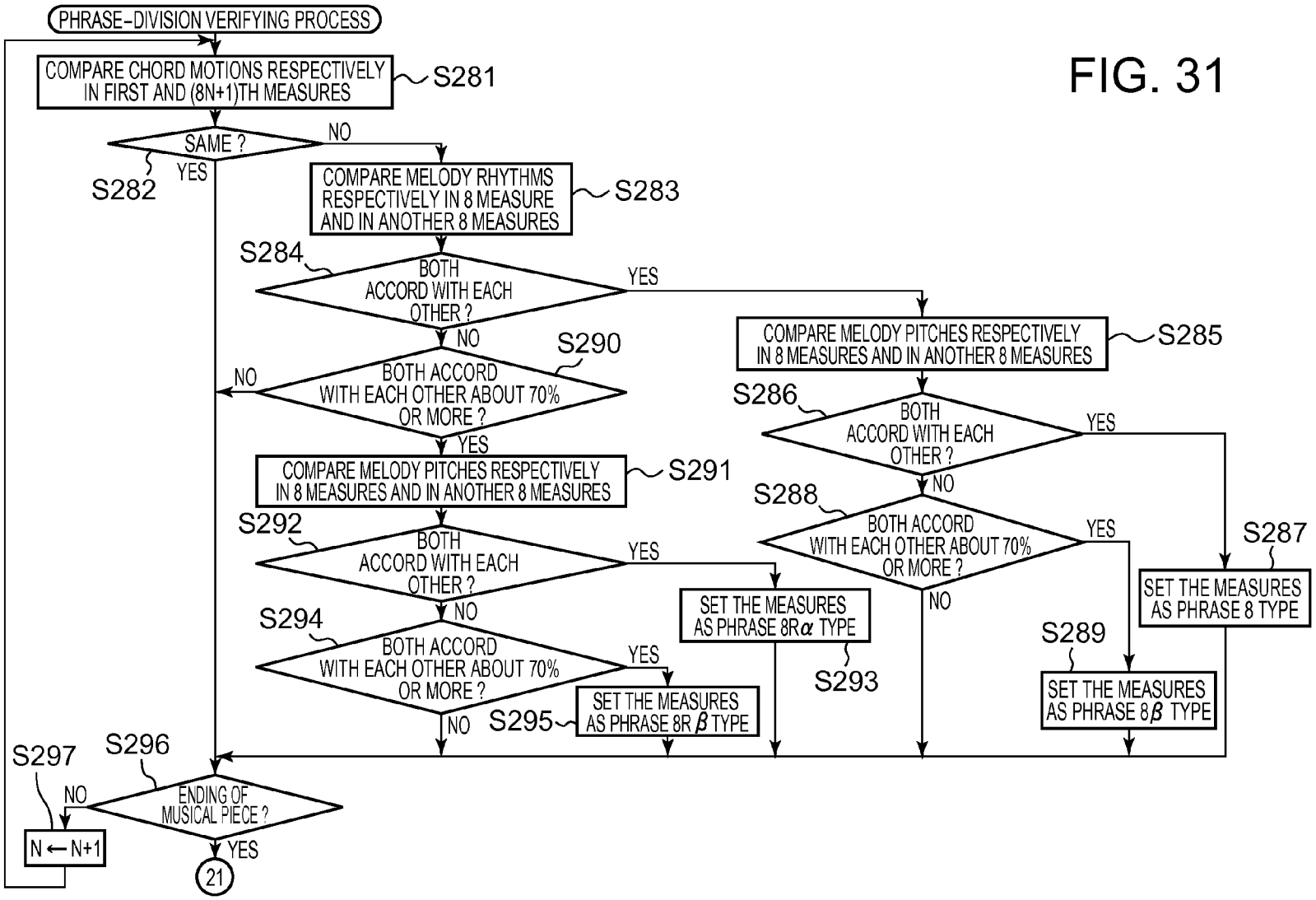
FIG. 31 to FIG. 34 are flow charts of an example of a phrase-division verifying process performed in the present embodiment of the invention.

At step S281 in FIG. 31, CPU 21 compares a chord motion in the first measure with a chord motion in (8N+1)-th measure. More specifically, CPU 21 reads the chord data and melody data from RAM 23 to compare the chord motions, wherein the chord data and melody data are stored in RAM 23 as a result of the real-time chord placing operation executed during the course of the performance of the musical piece. The initial value of "N" is "1".

At step S282, CPU 21 judges whether or not the chord motion in the first measure is the same as the chord motion in (8N+1)-th measure. When it is determined YES at step S282, CPU 21 advances to step S296. When it is determined NO at step S282, CPU 21 advances to step S283.

At step S283, CPU 21 compares a melody rhythm in 8 measures (from the first to eighth measures) with a melody rhythm in another 8 measures (from (8N+1)-th measure to (8N+8)-th measure). More specifically, CPU 21 refers to the melody data in RAM 23, which was used in the real-time chord placing operation, thereby comparing these melody rhythms.

At step S284, CPU 21 judges if the melody rhythms respectively in a unit of 8 measures (the first to eighth measures) and in a unit of another 8 measures ((8N+1)-th to (8N+8)-th measures) accord with each other. When it is determined YES at step S284, CPU 21 advances to step S285. When it is determined NO at step S284, CPU 21 advances to step S290.

At step S285, CPU 21 compares melody pitches respectively in a unit of 8 measures (the first to eighth measures) and in a unit of another 8 measures ((8N+1)-th to (8N+8)-th measures). More specifically, CPU 21 refers to the melody data in RAM 23, which was used in the real-time chord placing operation, thereby comparing these melody pitches.

At step S286, CPU 21 judges if both the melody pitches respectively in a unit of 8 measures (the first to eighth measures) and in a unit of another 8 measures ((8N+1)-th to (8N+8)-th measures) accord with each other. When it is determined YES at step S286, CPU 21 advances to step S287. When it is determined NO at step S286, CPU 21 advances to step S288.

At step S287, CPU 21 sets the pertinent measures as a "phrase 8 type". CPU 21 stores measure data and type data in a phrase-type area of RAM 23.

At step S288, CPU 21 judges if the melody pitches respectively in a unit of 8 measures (the first to eighth measures) and in a unit of another 8 measures ((8N+1)-th to (8N+8)-th measures) accord with each other about 70 percent or more. When it is determined YES at step S288, CPU 21 advances to step S289. When it is determined NO at step S288, CPU 21 advances to step S296.

At step S289, CPU 21 sets the pertinent measures as a "phrase 8β type". CPU 21 stores measure data and type data in the phrase-type area of RAM 23.

At step S290, CPU 21 judges if the melody rhythms respectively in a unit of 8 measures (the first to eighth measures) and in a unit of another 8 measures ((8N+1)-th to (8N+8)-th measures) accord with each other about 70 percent or more. When it is determined YES at step S290, CPU 21 advances to step S291. When it is determined NO at step S290, CPU 21 advances to step S296.

At step S291, CPU 21 compares the melody pitches respectively in a unit of 8 measures (the first to eighth measures) and in a unit of another 8 measures ((8N+1)-th to (8N+8)-th measures). More specifically, CPU 21 refers to the melody data stored in RAM 23 and used in the real-time chord placing operation, thereby comparing these melody pitches.

At step S292, CPU 21 judges if both the melody pitches respectively in a unit of 8 measures (the first to eighth measures) and in a unit of another 8 measures ((8N+1)-th to (8N+8)-th measures) accord with each other. When it is determined YES at step S292, CPU 21 advances to step S293. When it is determined NO at step S292, CPU 21 advances to step S294.

At step S293, CPU 21 sets the pertinent measures as a "phrase 8Rα type". CPU 21 stores measure data and type data in the phrase-type area of RAM 23.

At step S294, CPU 21 judges if the melody pitches respectively in a unit of 8 measures (the first to eighth measures) and in a unit of another 8 measures ((8N+1)-th to (8N+8)-th measures) accord with each other about 70 percent or more. When it is determined YES at step S294, CPU 21 advances to step S295. When it is determined NO at step S294, CPU 21 advances to step S296.

At step S295, CPU 21 sets the pertinent measures as a "phrase 8Rβ type". CPU 21 stores measure data and type data in the phrase-type area of RAM 23.

At step S296, CPU 211 judges if the process has reached the ending part of the musical piece. When it is determined YES at step S296, CPU 21 advances to step S298 in FIG. 32. When it is determined NO at step S296, CPU 21 advances to step S297.

At step S297, CPU 21 increments "N" by "1" and returns to step S281.

Figure 32:
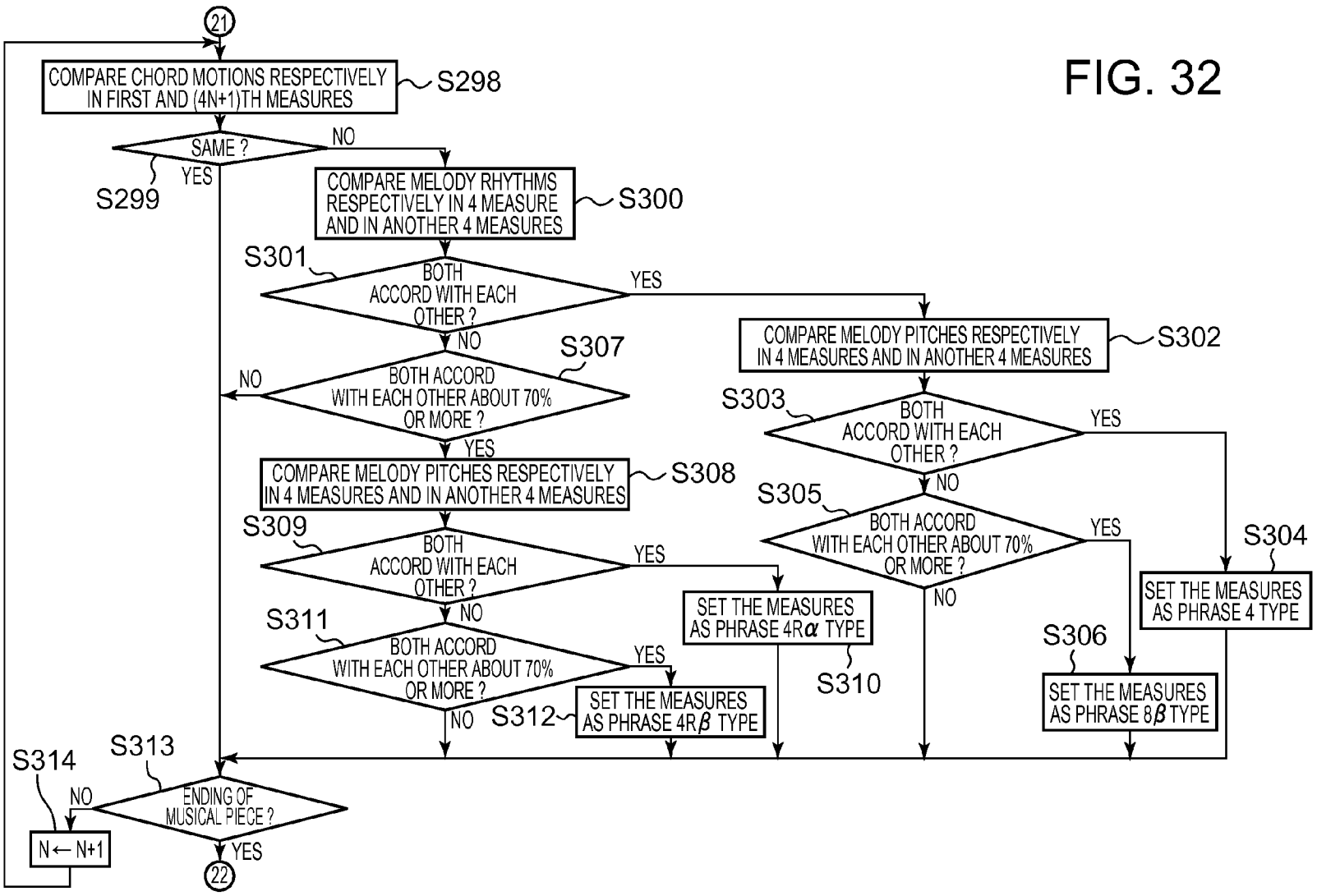

At step S298 in FIG. 32, CPU 21 compares the chord motion in the first measure with the chord motion in (4N+1)-th measure. More specifically, CPU 21 reads the chord data from RAM 23 to compare the chord motions, wherein the chord data is stored in RAM 23 in the real-time chord placing operation. The initial value of "N" is "1".

At step S299, CPU 21 judges whether or not the chord motion in the first measure is the same as the chord motion in (4N+1)-th measure. When it is determined YES at step S299, CPU 21 advances to step S313. When it is determined NO at step S299, CPU 21 advances to step S300.

At step S300, CPU 21 compares the melody rhythm in 4 measures (from the first measure to the fourth measure) with the melody rhythm in another 4 measures (from the (4N+1)-th measure to (4N+4)-th measure). More specifically, CPU 21 refers to the melody data in RAM 23, which was used in the real-time chord placing operation, thereby comparing these melody rhythms.

At step S301, CPU 21 judges if the melody rhythms respectively in a unit of 4 measures (the first to fourth measures) and in a unit of another 4 measures ((4N+1)-th to (4N+4)-th measures) accord with each other. When it is determined YES at step S301, CPU 21 advances to step S302. When it is determined NO at step S301, CPU 21 advances to step S307.

At step S302, CPU 21 compares the melody pitches respectively in a unit of 4 measures (the first to fourth measures) and in a unit of another 4 measures ((4N+1)-th to (4N+4)-th measures). More specifically, CPU 21 refers to the melody data in RAM 23, which was used in the real-time chord placing operation, thereby comparing these melody pitches.

At step S303, CPU 21 judges if both the melody pitches in a unit of 4 measures (the first to fourth measures) and in a unit of another 4 measures ((4N+1)-th to (4N+4)-th measures) accord with each other. When it is determined YES at step S303, CPU 21 advances to step S304. When it is determined NO at step S303, CPU 21 advances to step S305.

At step S304, CPU 21 sets the pertinent measures as a "phrase 4 type". CPU 21 stores measure data and type data in a phrase-type area of RAM 23.

At step S305, CPU 21 judges if the melody pitches respectively in a unit of 4 measures (first to fourth measures) and in a unit of another 4 measures ((4N+1)-th to (4N+4)-th measures) accord with each other about 70 percent or more. When it is determined YES at step S305, CPU 21 advances to step S306. When it is determined NO at step S305, CPU 21 advances to step S313.

At step S306, CPU 21 sets the pertinent measures as a "phrase 4β type". CPU 21 stores measure data and type data in the phrase-type area of RAM 23.

At step S307, CPU 21 judges if the melody rhythms respectively in a unit of 4 measures (the first to fourth measures) and in a unit of another 4 measures ((4N+1)-th to (4N+4)-th measures) accord with each other about 70 percent or more. When it is determined YES at step S307, CPU 21 advances to step S308. When it is determined NO at step S307, CPU 21 advances to step S313.

At step S308, CPU 21 compares the melody pitches respectively in a unit of 4 measures (the first to fourth measures) and in a unit of another 4 measures ((4N+1)-th to (4N+4)-th measures). More specifically, CPU 21 refers to the melody data stored in RAM 23 and used in the real-time chord placing operation, thereby comparing these melody pitches.

At step S309, CPU 21 judges if both the melody pitches respectively in a unit of 4 measures (the first to fourth measures) and in a unit of another 4 measures ((4N+1)-th to (4N+4)-th measures) accord with each other. When it is determined YES at step S309, CPU 21 advances to step S310. When it is determined NO at step S309, CPU 21 advances to step S311.

At step S310, CPU 21 sets the pertinent measures as a "phrase 4Rα type". CPU 21 stores measure data and type data in the phrase-type area of RAM 23.

At step S311, CPU 21 judges if the melody pitches respectively in a unit of 4 measures (the first to fourth measures) and in a unit of another 4 measures ((4N+1)-th to (4N+4)-th measures) accord with each other about 70 percent or more. When it is determined YES at step S311, CPU 21 advances to step S312. When it is determined NO at step S311, CPU 21 advances to step S313.

At step S312, CPU 21 sets the pertinent measures as a "phrase 4Rβ type". CPU 21 stores measure data and type data in the phrase-type area of RAM 23.

At step S313, CPU 211 judges if the process has reached the ending part of the musical piece. When it is determined YES at step S313, CPU 21 advances to step S315 in FIG. 33. When it is determined NO at step S313, CPU 21 advances to step S314.

At step S314, CPU 21 increments "N" by "1" and returns to step S281.

Figure 33:
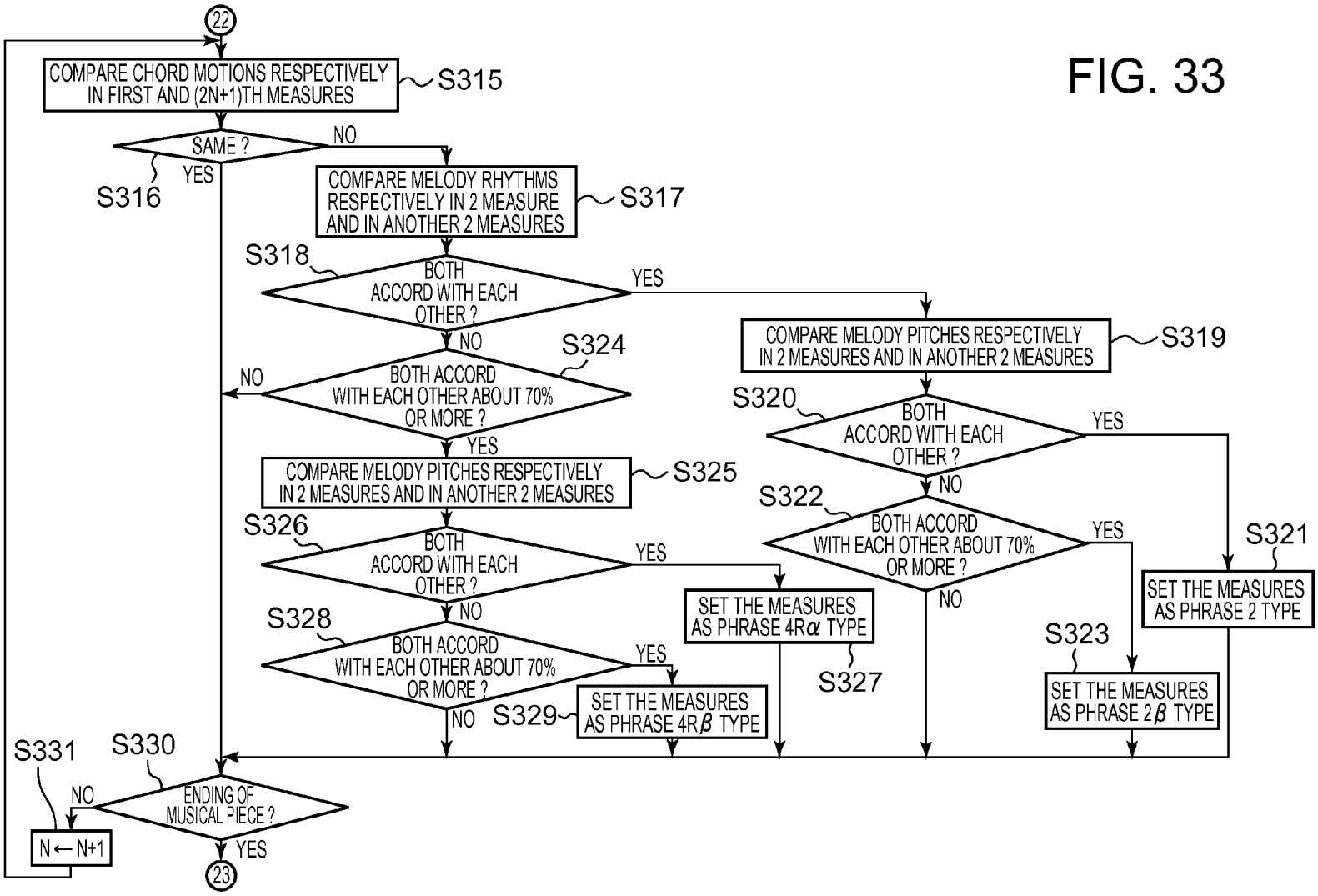
Figure 34:
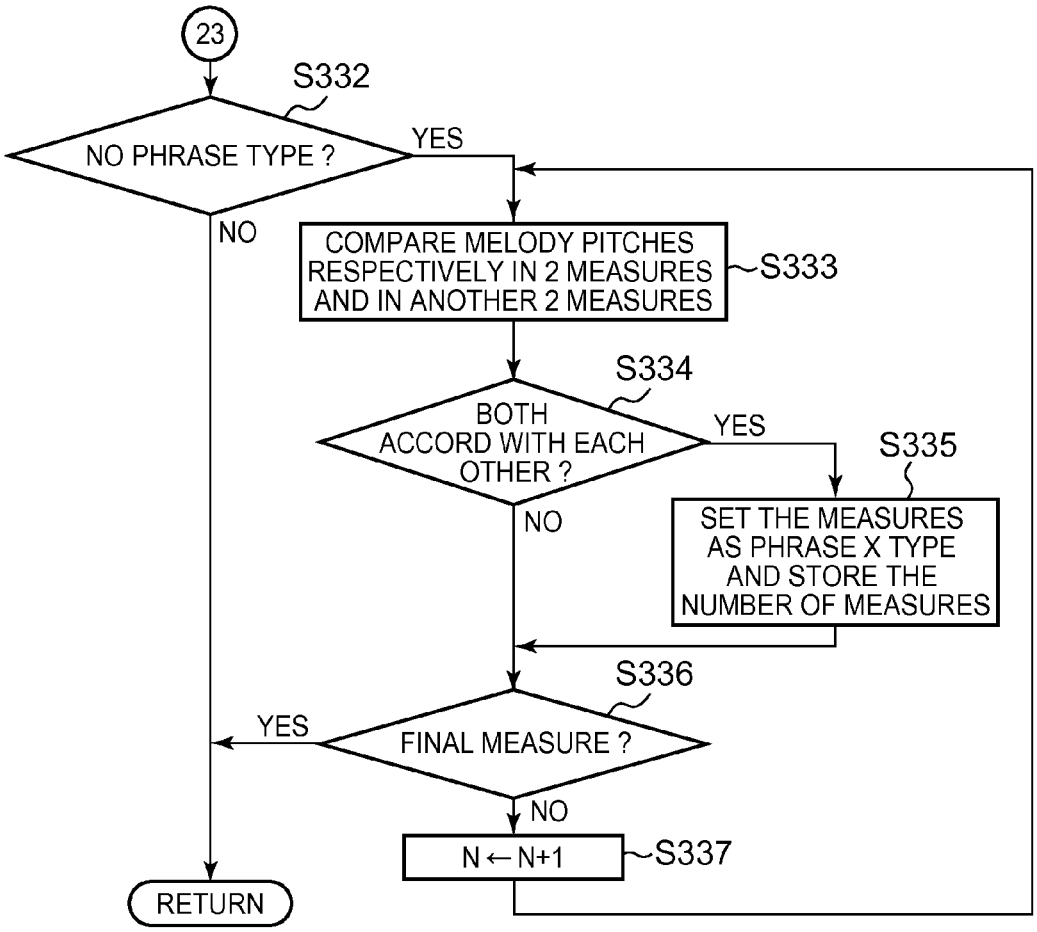

At step S315 in FIG. 33, CPU 21 compares the chord motion in the first measure with the chord motion in (2N+1)-th measure. More specifically, CPU 21 reads the chord data from RAM 23 to compare the chord motions, wherein the chord data was stored in RAM 23 in the real-time chord placing operation. The initial value of "N" is "1".

At step S316, CPU 21 judges whether or not the chord motion in the first measure is the same as the chord motion in (2N+1)-th measure. When it is determined YES at step S316, CPU 21 advances to step S330. When it is determined NO at step S316, CPU 21 advances to step S317.

At step S317, CPU 21 compares the melody rhythm in 2 measures (from the first to second measures) with the melody rhythm in another 2 measures (from (2N+1)-th measure to (2N+2)-th measure). More specifically, CPU 21 refers to the melody data in RAM 23, which was used in the real-time chord placing operation, thereby comparing these melody rhythms.

At step S318, CPU 21 judges if the melody rhythms respectively in a unit of 2 measures (the first to second measures) and in a unit of another 8 measures ((2N+1)-th to (2N+2)-th measures) accord with each other. When it is determined YES at step S318, CPU 21 advances to step S319. When it is determined NO at step S318, CPU 21 advances to step S324.

At step S319, CPU 21 compares the melody pitches respectively in a unit of 2 measures (the first to second measures) and in a unit of another 2 measures ((2N+1)-th to (2N+2)-th measures). More specifically, CPU 21 refers to the melody data in RAM 23, which was used in the real-time chord placing operation, thereby comparing these melody pitches.

At step S320, CPU 21 judges if the melody pitches respectively in a unit of 2 measures (the first to second measures) and in a unit of another 2 measures ((2N+1)-th to (2N+2)-th measures) accord with each other. When it is determined YES at step S320, CPU 21 advances to step S321. When it is determined NO at step S320, CPU 21 advances to step S322.

At step S321, CPU 21 sets the pertinent measures as a "phrase 2 type". CPU 21 stores measure data and type data in a phrase-type area of RAM 23.

At step S322, CPU 21 judges if the melody pitches respectively in a unit of 2 measures (the first to second measures) and in a unit of another 2 measures ((2N+1)-th to (2N+2)-th measures) accord with each other about 70 percent or more. When it is determined YES at step S322, CPU 21 advances to step S323. When it is determined NO at step S322, CPU 21 advances to step S330.

At step S323, CPU 21 sets the pertinent measures as a "phrase 2β type". CPU 21 stores measure data and type data in the phrase-type area of RAM 23.

At step S324, CPU 21 judges if the melody rhythms respectively in a unit of 2 measures (the first to second measures) and in a unit of another 2 measures ((2N+1)-th to (2N+2)-th measures) accord with each other about 70 percent or more. When it is determined YES at step S324, CPU 21 advances to step S325. When it is determined NO at step S324, CPU 21 advances to step S330.

At step S325, CPU 21 compares the melody pitches respectively in a unit of 2 measures (the first to second measures) and in a unit of another 2 measures ((2N+1)-th to (2N+2)-th measures). More specifically, CPU 21 refers to the melody data stored in RAM 23 and used in the real-time chord placing operation, thereby comparing these melody pitches.

At step S326, CPU 21 judges if both the melody pitches respectively in a unit of 2 measures (the first to second measures) and in a unit of another 2 measures ((2N+1)-th to (2N+2)-th measures) accord with each other. When it is determined YES at step S326, CPU 21 advances to step S327. When it is determined NO at step S326, CPU 21 advances to step S328.

At step S327, CPU 21 sets the pertinent measures as a "phrase 8Rα type". CPU 21 stores measure data and type data in the phrase-type area of RAM 23.

At step S328, CPU 21 judges if the melody pitches respectively in a unit of 2 measures (the first to second measures) and in a unit of another 2 measures ((2N+1)-th to (2N+2)-th measures) accord with each other about 70 percent or more. When it is determined YES at step S328, CPU 21 advances to step S329. When it is determined NO at step S328, CPU 21 advances to step S330.

At step S329, CPU 21 sets the pertinent measures as a "phrase 2Rβ type". CPU 21 stores measure data and type data in the phrase-type area of RAM 23.

At step S330, CPU 211 judges if the process has reached the ending part of the musical piece. When it is determined YES at step S330, CPU 21 advances to step S332 in FIG. 34. When it is determined NO at step S330, CPU 21 advances to step S331.

At step S331, CPU 21 increments "N" by "1" and returns to step S315.

At step S332, CPU 21 judges whether or not any phrase type is found among the measures. More specifically, CPU 21 searches for the phrase type through the phrase-type area of RAM 23. When the phrase type has been found, CPU 21 advances to step S333. When no phrase type has been found, CPU 21 finishes the phrase-division verifying process.

At step S333, CPU 21 compares the melody pitches respectively in the first measure and in (N+1)-th measure. More specifically, CPU 21 refers to the melody data in RAM 23, which was used in the real-time chord placing operation, thereby comparing these melody pitches. The initial value of "N" is "1".

At step S334, CPU 21 judges if the melody pitches respectively in the first measure and in (N+1)-th measure accord with each other. When it is determined YES at step S334, CPU 21 advances to step S335. When it is determined NO at step S334, CPU 21 advances to step S336.

At step S335, CPU 21 sets the pertinent measures as a "phrase X type", and stores the number of measures to "X". CPU 21 stores data of the number of measures and type data in a phrase-type area of RAM 23.

At step S336, CPU 21 judges whether or not the measure to be processed is the final measure. When it is determined YES at step S336, CPU 21 finished the phrase-division verifying process. When it is determined NO at step S336, CPU 21 advances to step S337.

At step S337, CPU 21 increments "N" by "1" and returns to step S333.

FIG. 35 and FIG. 36 are flow charts of an example of a chord placement modifying process performed in the present embodiment.

At step S341 in FIG. 35, CPU 21 compares a key placed in the real-time chord placing process with the key modified in the key-judgment verifying process (FIG. 28 and FIG. 29).

At step S342, CPU 21 judges whether or not any position is found in the musical piece, where the key should be changed. When it is determined YES at step S342, CPU 21 advances to step S343. When it is determined NO at step S342, CPU 21 advances to step S346.

At step S343, CPU 21 places a chord in a new key to such position where it is determined the key should be changed.

At step S344, CPU 21 judges whether or not there is any position where the key decision is suspended. When it is determined YES at step S344, CPU 21 advances to step S345. When it is determined NO at step S344, CPU 21 advances to step S346.

At step S346, CPU 21 judges whether or not a position is found, where the dominant will require to modify the chord. More specifically, CPU 21 judges whether or not there is any measure, to which the chord modifying flag has been set to ON at step S272 in FIG. 30. When it is determined YES at step S346, CPU 21 advances to step S347. When it is determined NO at step S346, CPU 21 advances to step S350.

At step S347, CPU 21 judges whether or not the final 4 measures including the found position satisfy the cadence judgment table. More specifically, CPU 21 refers to the columns of the middle part or the columns of the ending part of the cadence judgment table (FIG. 40), depending on whether the 4 measures are in the middle part of the musical piece or in the ending part, wherein said 4 measures include the measure, to which the chord modifying flag has been put to ON, thereby judging whether or not the chord functions placed to said 4 measures accord with the chord functions in the cadence judgment table (FIG. 40). When it is determined YES at step S347, CPU 21 advances to step S377. When it is determined NO at step S347, CPU 21 advances to step S348.

At step S348, CPU 21 specifies a range of suspending the key decision, and judges a key set to the melody in the range and decide the key.

At step S349, CPU 21 places a chord in a new key to the position where the key is to be altered, and then advances to step S347.

At step S377, CPU 21 modifies the chord. More specifically, CPU 21 modifies or changes the chord placed to the measure, to which the chord modifying flag has been set to ON, to the chord including the chord composing tones corresponding to the dominant, decided at step S269 in FIG. 30.

At step S350, CPU 21 judges whether or not the phrase division of the position where the chord is to be altered is 4(*) type (4 type, 4β type, 4Rα type, 4Rβ type). When it is determined YES at step S350, CPU 21 advances to step S351. When it is determined NO at step S350, CPU 21 advances to step S357 in FIG. 36.

At step S351, CPU 21 judges if the phrase division is the 4 type. When it is determined YES at step S351, CPU 21 advances to step S352. When it is determined NO at step S351, CPU 21 advances to step S353.

At step S352, CPU 21 makes the chords placed to the part conform with the chords of the part to be compared with. In the case of the 4 type, since the rhythm and the pitch of the melody are the same as those to be compared with, the chords will be made the same as those to be compared with. For instance, in the case where the fifth to eighth measures are of 4 type, CPU 21 makes the chords placed to the fifth to eighth measures conform with those placed to the first to fourth measures. As will be described later, in the case where the ninth to twelfth measures are either of the 4β type, 4Rα type and 4Rβ type, CPU 21 finds a part of the ninth to twelfth measures, which is different in chord from the first to fourth measures, and makes the chords of the part conform with the chords of the first to fourth measures when the chord functions of the part are the same as the first to fourth measures.

At step S353, CPU 21 makes a comparison of the chords of other parts. In this case, the phrase division is either of the 4β type, 4Rα type and 4Rβ type. Since either one or both of the melody pitch and melody rhythm of measures is different from the measures to be compared with not more than 30%, CPU 21 makes the comparison of the chords of other part. For instance, if the ninth to twelfth measures are either of the 4β type, 4Rα type and 4Rβ type, CPU 21 compares the chords of the ninth to twelfth measures with the chords of the first to fourth measures.

At step S354, CPU 21 judges whether or not the functions of chords are the same. More specifically, CPU 21 judges whether or not the functions of chords of the other parts are the same. When it is determined YES at step S354, CPU 21 advances to step S352. When it is determined NO at step S354, CPU 21 advances to step S355.

At step S355, CPU 21 judges whether or not the measure to be processed is the final measure. When it is determined YES at step S355, CPU 21 advances to step S357 in FIG. 36. When it is determined NO at step S355, CPU 21 advances to step S356.

At step S356, CPU 21 processes the following 4 measures and returns to step S351.

At step S357 in FIG. 36, CPU 21 judges whether or not the phrase division of the position where the chord is to be altered is the 8(*) type (8 type, 8β type, 8Rα type, 8Rβ type). When it is determined YES at step S357, CPU 21 advances to step S358. When it is determined NO at step S357, CPU 21 advances to step S364.

At step S358, CPU 21 judges if the phrase division is the 8 type. When it is determined YES at step S358, CPU 21 advances to step S359. When it is determined NO at step S358, CPU 21 advances to step S360.

At step S359, CPU 21 makes the chords placed to the part conform with the chords of the part to be compared with. In the case of the 8 type, since the rhythm and the pitch of the melody are the same as those to be compared with, the chords are made the same as those to be compared with. For instance, in the case where the ninth to sixteenth measures are of 8 type, CPU 21 makes the chords placed to the ninth to sixteenth measures conform with those of the first to eighth measures. Further, as will be described later, in the case where the 17th to 24th measures are either of 8β type, 8Rα type and 8Rβ type, CPU 21 finds a part of the 17th to 24th measures, which is different in chord from the first to eighth measures, and makes the chords of the part conform with the chords of the first to eighth measures when the chord functions of the part are the same as the first to eighth measures.

At step S360, CPU 21 makes a comparison of the chords of the parts. In this case, the phrase division is either of the 8β type, 8Rα type and 8Rβ type. Since either one or both of the melody pitch and melody rhythm of measures is different from the measures to be compared with not more than 30%, CPU 21 makes the comparison of the chords of such parts. For instance, if the 17th to 24th measures are either of the 4β type, 4Rα type and 4Rβ type, CPU 21 compares the chords of 17th to 24th measures with the chords of the first to eighth measures.

At step S361, CPU 21 judges whether or not the functions of chords are the same. More specifically, CPU 21 judges whether or not the functions of chords of the parts, which are different in the melody pitch and/or melody rhythm, are the same. When it is determined YES at step S361, CPU 21 advances to step S359. When it is determined NO at step S361, CPU 21 advances to step S362.

At step S362, CPU 21 judges whether or not the measure to be processed is the final measure. When it is determined YES at step S362, CPU 21 advances to step S364 in FIG. 36. When it is determined NO at step S362, CPU 21 advances to step S363.

At step S363, CPU 21 processes the following 8 measures and returns to step S358.

At step S364, CPU 21 judges whether or not the phrase division of the position is the 2(*) type (2 type, 2β type, 2Rα type, 2Rβ type). When it is determined YES at step S364, CPU 21 advances to step S365. When it is determined NO at step S364, CPU 21 advances to step S371.

At step S365, CPU 21 judges if the phrase division is the 2 type. When it is determined YES at step S365, CPU 21 advances to step S366. When it is determined NO at step S365, CPU 21 advances to step S367.

At step S366, CPU 21 makes the chords of the part conform with the chords of the part to be compared with. In the case of the 2 type, since the rhythm and the pitch of the melody are the same as those to be compared with, the chords is made the same as those to be compared with. For instance, in the case where the third to fourth measures are of 2 type, CPU 21 makes the chords of the third to fourth measures conform with those of the first to second measures. Further, as will be described later, in the case where the fifth to sixth measures are either of the 2β type, 2Rα type and 2Rβ type, CPU 21 finds a part of the third to fourth measures, which is different in chord from the first to second measures, and makes the chords of the part conform with the chords of the first to second measures when the chord functions of the part are the same as the first to second measures.

At step S367, CPU 21 makes a comparison of the chords of two parts. In this case, the phrase division is either of 2β type, 2Rα type and 2Rβ type. Since either one or both of the melody pitch and melody rhythm of measures is different from the measures to be compared with not more than 30%, CPU 21 makes the comparison of the chords of the parts, which are different is in melody pitch and/or melody rhythm. For instance, if the third to fourth measures are either of 2β type, 2Rα type and 2Rβ type, CPU 21 compares the chords of the third to fourth measures with the chords of the first to second measures.

At step S368, CPU 21 judges whether or not the functions of chord are the same. More specifically, CPU 21 judges whether or not the functions of chords of the different parts are the same. When it is determined YES at step S368, CPU 21 returns to step S366. When it is determined NO at step S368, CPU 21 advances to step S369.

At step S369, CPU 21 judges whether or not the measure to be processed is the final measure. When it is determined YES at step S369, CPU 21 advances to step S371. When it is determined NO at step S369, CPU 21 advances to step S370.

At step S370, CPU 21 processes the following 2 measures and returns to step S365.

At step S371, CPU 21 judges if the phrase division of the position is the X type. When it is determined YES at step S371, CPU 21 advances to step S372. When it is determined NO at step S371, CPU 21 advances to step S376.

At step S372, CPU 21 confirms the starting position.

At step S373, CPU 21 makes the chords of the part accord to the part to be compared with.

At step S374, CPU 21 judges whether or not the measure to be processed is the final measure. When it is determined YES at step S374, CPU 21 advances to step S376. When it is determined NO at step S374, CPU 21 advances to step S375.

At step S375, CPU 21 advances to the following X type, and returns to step S372.

At step S376, CPU 21 judges whether or not any other position storing the phrase type is found. When it is determined YES at step S376, CPU 21 returns to step S350 in FIG. 35. When it is determined NO at step S376, CPU 21 finishes the chord placement modifying process.

FIG. 37 is a flow chart of an example of a melody and chord-scale comparing process performed in the present embodiment.

At step S381 in FIG. 37, CPU 21 refers to a chord scale table (FIG. 43) to confirm a chord scale of the modified chord, thereby confirming if the melody in the modified chord interval (a melody input in the real-time chord placing operation) accord with the chord scale of the modified chord. The chord scale is a tone group consisting of a combination of a scale note (SN) and a chord composing tone (CT) given in the chord scale table (FIG. 43).

For instance, in the case where the modified chord in the key Cis IMajor or (CMajor), the chord scale of the modified chord is (C, D, E, F, G, A, B), as shown in FIG. 43. Therefore, in the case where the modified chord in the key C is IMajor or (CMajor), if the melody in the interval of the modified chord is either of (C, D, E, F, G, A, B), the melody and the chord scale will accord with each other.

At step S382, CPU 21 judges whether or not the melody in the modified chord interval accord with the chord scale of the modified chord. When it is determined YES at step S382, CPU 21 advances to step S388. When it is determined NO at step S382, CPU 21 advances to step S383.

At step S383, CPU 21 judges whether or not a tone out of the scale is an ornament tone. More specifically, CPU 21 refers to the ornament tone database (FIG. 42) to judge if the tone is an ornament tone. When it is determined YES at step S383, CPU 21 advances to step S388. When it is determined NO at step S383, CPU 21 advances to step S384.

At step S384, CPU 21 refers to a re-harmonization database (not shown). For example, in the case where a melody is a melodic minor ascending order (A, B, C, D, E, F♯, G♯) in the key of Am (composing tones of Am: "A, B, C, D, E, F, G"), since "F♯, G♯" are not the composing tones of the key of Am, a chord placed to the tone "F♯" can be changed to Bm7. In this manner, patterns, in which the chords can be altered, are registered in the re-harmonization database (not shown)

At step S385, CPU 21 refers to the re-harmonization database to judge whether or not it is allowed to change the chord. When it is determined YES at step S385, CPU 21 advances to step S386. When it is determined NO at step S385, CPU 21 advances to step S387.

At step S386, CPU 21 modifies the chord. More specifically, CPU 21 changes or modifies the chord to the chord register in the re-harmonization database.

At step S387, CPU 21 records in RAM 23 a position where the chord modification is not allowed in the re-harmonization database.

At step S388, CPU 21 judges whether or not the chord to be modified is the final chord. When it is determined YES at step S388, CPU 21 finishes the melody and chord-scale comparing process. When it is determined NO at step S388, CPU 21 advances to step S389.

At step S389, CPU 21 advances to the following chord and returns to step S381.

FIG. 38 is a flow chart of an example of a user's modifying process in the present embodiment. Even if the chords are modified in the non real-time, often appreciative listeners cannot satisfy with the performance of the musical piece. It will be convenient, if the chords can be modified by the user. The present embodiment is provided with the user's modifying process, which allows the user to modify the chords.

At step S401 in FIG. 38, CPU 21 judges whether or not data is being reproduced by ANY-key. When it is determined YES at step S401, CPU 21 advances to step S402. When it is determined NO at step S401, CPU 21 finishes the user's modifying process.

At step S402, CPU 21 judges whether or not Edit-switch (not shown) has been turned on. When it is determined YES at step S402, CPU 21 advances to step S403. When it is determined NO at step S402, CPU 21 advances to step S407.

At step S403, CPU 21 outputs candidate chords in order of chord priority given in a chord priority database (FIG. 44). More specifically, CPU 21 outputs the candidate chords in order of chord priority stored in the chord priority database (FIG. 44). For instance, in the case where the chord which has not been modified is "IIm", "IIm7" is output as the first candidate chord.

At step S404, CPU 21 judges whether or not OK-switch (not shown) has been turned on. When it is determined YES at step S404, CPU 21 advances to step S405. When it is determined NO at step S404, CPU 21 advances to step S406.

At step S405, CPU 21 modifies the chord, and advances to step S407. More specifically, CPU 21 uses the chord output at step S403 to modify the chord.

At step S406, CPU 21 outputs the following candidate chord, and returns to step S404. For example, if the chord "IIm7" is output at present, CPU 21 will output the chord "IV" as the second candidate chord.

At step S407, CPU 21 judges whether or not the musical piece has come to the end. When it is determined YES at step S407, CPU 21 finishes the user's modifying process. When it is determined NO at step S407, CPU 21 returns to step S401.

The electronic musical instrument 10 according to the present embodiment is provided with the keyboard 11 for playing the melody of a musical piece. CPU 21 refers to the history of pitches of the played melody, thereby placing chords to the melody in real time, and after the melody of the musical piece is played, CPU 21 modifies the placed chords in non real time.

Therefore, after the chords are placed to the input melody in real time, CPU 21 modifies the placed chords in non real time. Therefore, accuracy of the placement of chords can be enhanced.

In the electronic musical instrument 10 according to the present embodiment, CPU 21 divides the musical piece into predetermined intervals, and verifies if a tone is found among the melody tones contained in each interval, which tone allows a chord other than the placed chord to establish. When it is determined that such tone is found among the melody tones contained in the predetermined interval, CPU 21 designates such predetermined interval as the modifying position, and divides the melody of the musical piece into plural phrases of a predetermined duration. Further, CPU 21 verifies a degree of coincidence in musical forms between the divided phrases and modifies the placed chords based on the verifying result of the degree of coincidence in musical form.

Therefore, for example, in the case where the melody is divided into plural phrases of a predetermined duration, for example, of 4 measures, since the chords are modified based on the result of verifying the degree of coincidence in musical form every 4 measures, if the degree of coincidence in musical form between the divided phrases is high, the degree of coincidence between the chords placed to the divided phrases can be made high.

In the electronic musical instrument 10 according to the present embodiment, CPU 21 verifies if the key set to a predetermined interval of the musical piece accords with the key decided based on the final melody tone of said predetermined interval. Therefore, it is possible to verify in accordance with the final melody tone, if the key set to a predetermined interval of the musical piece is accurate.

In the electronic musical instrument 10 according to the present embodiment, CPU 21 judges whether or not the scale of each modified chord accords with the scale of the melody in the corresponding interval. When it is determined these scales do not accord to each other, then the modified chord is further modified.

Therefore, accuracy of the modified chord is verified and when it is determined that the chord is not accurate, the chord can be further modified to improve accuracy of the modified chord.

In the electronic musical instrument 10 according to the present embodiment, in the real-time chord placing process, CPU 21 determines the chord to be placed to a predetermined beat based on a pitch of a tone in a predetermined beat in the musical data, a pitch of a tone in the beat just prior to the predetermined beat and the chord placed to the beat just prior to the predetermined beat. Therefore, the real time chord placement can be made promptly and precisely.

In the electronic musical instrument 10 according to the present embodiment, CPU 21 judges whether or not any tones other than the tones composing the placed chord are found among the melody tones contained in each of measures of the musical piece. When it is determined that such tones are found, CPU 21 judges whether or not said tones are ornament tones. When it is determined that said tones are ornament tones, CPU 21 compares the chord consisting of tones excepting the ornament tones with the chord attached to the measure. When it is determined that said tones are not ornament tones, CPU 21 compares the chord consisting of said tones with the chord attached to the measure. When it is determined that both the chords do not coincide with each other, CPU 21 designates the interval of the measure as the modifying position. Therefore, the chords can be modified based on the dominant excepting the ornament tone, which can cause an error in the real-time chord placing process.

In the electronic musical instrument 10 according to the present embodiment, when it is judged whether or not other tones other than the dominant are found among the melody tones contained in each of measures of the musical piece, CPU 21 extracts three tones of a long duration among from the melody tones contained in each measure, and judges whether or not these three tones are the chord composing tones of the chord placed in the measure. When it is determined that these three tones are the chord composing tones, these three tones are dominants, and therefore, the dominants can be the chord composing tones.

In the electronic musical instrument 10 according to the present embodiment, when the melody of the musical piece is divided into plural phrases each of a predetermined duration, CPU 21 divides the melody into plural units such as units of 4 measures, units of 8 measures, and/or units of 2 measures. CPU 21 verifies a degree of coincidence in musical form between these units of plural measures, such as units of 4 measures, units of 8 measures, and units of 2 measures, which contain many musical repetitions.

In the present embodiment, the music data includes rhythm tones. CPU 21 compares the plural phrases in pitches of melody tones and in rhythm tones. The phrases are classified into any one of groups: the first group of phrases, which accord with each other both in pitches of melody tones and in rhythm tones; the second group of phrases, which accord with each other either-or in pitches of melody tones and in rhythm tones at not less than a predetermined level; and the third group of phrases, which accord with each other both in pitches of melody tones and in rhythm tones at not less than a predetermined level. Therefore, a wide variety of methods are provided for verifying a degree of coincidence in musical form.

In modifying the chord in the present embodiment, when an interval, where the chord is to be modified is found in the musical piece in the chord-composing tone verifying process, CPU 21 places other chord in such interval, thereby judging whether or not the final part of the interval satisfies data given in the cadence judgment table. When it is determined that the final part of the interval satisfies the cadence judgment table, then CPU 21 replaces the chord with said other chord. Therefore, the more appropriate chord can be placed.

In modifying the chord in the present embodiment, when an interval, where the chord is to be modified is found in the musical piece in the chord-composing tone verifying process, CPU 21 places other chord in such interval, thereby judging whether or not the final part of the interval satisfies data given in the cadence judgment table. When it is determined that the final part of the interval does not satisfy the cadence judgment table, CPU 21 decides the key based on the melody tone contained in said interval, and places another chord based on the decided key, thereby judging whether or not the final part of the interval satisfies the cadence judgment table. Therefore, the more appropriate chord can be attached.

In the electronic musical instrument 10 according to the present embodiment, the melody of the musical piece is divided into plural phrases, each having a predetermined duration. CPU 21 classifies the phrases into the first group, which accord with each other both in pitches of tones and in rhythm tones, and amends the chords placed to this first group to be identical. CPU 21 classifies the phrases into the second group, which accord with each other either-or in pitches of tones and in rhythm tones at not less than a predetermined level, and amends the chords placed in the disaccord phrases among the second group to be identical, when the functions of the chords placed in the disaccord phrases are identical. Further, CPU 21 classifies the phrases into the third group, which accord with each other both in pitches of tones and in rhythm tones at not less than a predetermined level, and amends the chords placed in the disaccord phrases among the third group to be identical, when the functions of the chords placed in the disaccord phrases are identical. Therefore, accuracy of placed chords can be improved.

In the chord-name judging process (step S4 in FIG. 3), CPU 21 determines the Current Melody tone CM of the key pressed to the head of the present beat and the Previous Melody tone PM of the key pressed to the head of the just previous beat, based on the time information and rhythm information, which define the motion of the automatic accompaniment data in operation in the melody sequence, which advances in response to a series of key operations on the keyboard 11. CPU 21 performs the chord-name determining process to determine the Current Chord name CurCH based on the determined Current Melody tone CM, Previous Melody tone PM and Previous Chord name PreCH. When determining the melody tone, CPU 21 determines the Current Melody tone CM and Previous Melody tone PM based on what number of the beat the current beat is in the measure.

In consideration of the position (temporal position) where the key is pressed, the Current Melody tone CM and Previous Melody tone PM are determined. The Current Chord name CurCH is determined based on the sequence of the determined melody tones and the Previous Chord name PreCH.

In the case where the musical piece is in four-four time, CPU 21 determines current melody-tone information and previous melody-tone information based on whether the current beat is the first beat or the third beat or other beat. In other words, based on the down beats (the first beat and third beat) and the weak beats (the second beat and fourth beat), the Current Melody tone CM and Previous Melody tone PM are determined, and weights to be given on beats can be considered.

In the case where the duration of the tone of the key pressed after the head of the previous beat extends beyond the current beat, it is determined syncopation, and the tone extending to the present beat is used as the Current Melody tone CM. In other words, even though the key is not pressed to the head of the current beat, but if the tone of the key extends to the current beat, such tone is processed as if such tone has been pressed to the head of the current beat.

In the first dominant-motion judgment process (FIG. 10), when the Previous Chord name PreCH indicates the dominant chord and a transition from the Previous Melody tone PM to the Current Melody tone CM indicates the predetermined transition form the dominant chord composing tones to the tonic chord composing tones, CPU 21 gives a chord name corresponding to the tonic to the Current Chord name CurCH. In the case where the dominant motion from the melody sequence is clearly shown, a rest is formed in the chord transition, with the Current Chord name CurCH as the tonic.

In the second dominant-motion judgment process (FIG. 17), when a transition from the Previous Melody tone PM to the Current Melody tone CM indicates the predetermined transition form the dominant chord composing tones to the tonic chord composing tones, CPU 21 gives a chord name corresponding to the tonic to the Current Chord name CurCH. Even if the Previous Chord name PreCH is not the dominant chord, when the dominant motion from the melody sequence is clearly shown, a rest is formed in the chord transition with the Current Chord name CurCH as the tonic.

Further, when no chord name corresponding to the tonic is given as the Current Chord name CurCH in the first or second dominant motion judgment process, CPU 21 gives the Previous Chord name PreCH as the Current Chord name CurCH, whereby the chord is held for sure.

In the present embodiment, the first and second chord tables are prepared. In the first chord table are stored chord names corresponding to the Previous Melody tone PM, the Current Melody tone CM, and the Previous Chord names PreCH in the case where the Current Melody tone CM relates to the key pressed to the first beat. In the second chord table are stored chord names corresponding to the Previous Melody tone PM, the Current Melody tone CM, and the Previous Chord names PreCH in the case where the Current Melody tone CM relates to the key pressed to the beat other than the first beat. CPU 21 refers to the first or second chord table depending on the timing at which the key has been pressed, whereby a chord name can be obtained depending on the beat. Further, CPU 21 can determine the chord name in real time, by referring to the chord tables.

In the present embodiment, when a chord name corresponding to the Previous Melody tone PM and Current Melody tone CM has not been found in the first and second chord tables, CPU 21 gives a non-verified chord name, such as an augment chord or diminish chord, as the Current Chord name CurCH. Even if the Previous Melody tone PM and Current Melody tone CM are not the chord composing tone or scale note, a chord name can be placed, which gives no sense of discomfort in the musical piece.

In the present embodiment, CPU 21 refers to the non-verified chord table to determine based on the Previous Melody tone PM and Current Melody tone CM and the Previous Chord names PreCH, which chord should be placed, the augment chord or diminish chord.

The scope of the present invention is not limited to the present embodiments described herein, and it should be apparent that modification and variation may be made to the disclosed embodiments while remaining within the scope of the invention as defined by the following claims.

In the above embodiment, the musical piece is in four-four time, but the present invention can be applied to the musical piece in triple time or in sixth time. For example, in the case of the musical piece in triple time, the processes relating to the first to third beats are performed in the above described processes. In the case of the musical piece in sixth time, it is considered that there exists two triples and the processes relating to the beats (the first and third beats) are performed. The processes relating to the beats (the fourth to sixth beats) are performed in a similar manner to the beats (the first to third beats).

In the above embodiment, the chord name using a degree to the tonic is used in the tonality of CMaj or Amin, but the tonality is not limited to the tonality of CMaj or Amin. The invention can be applied to other tonality. For example, in the case of the musical piece in the major key (C), a pitch difference between the major key (C) and the root of the tonality of the musical piece is calculated, and the pitch difference is used as the "offset" and stored in RAM 23. In the process, the number of the key actually pressed, which defines a tone name, is decreased by the offset, whereby the tone name can be processed in (C) scale.

What is claimed is:

1. An automatic key adjusting apparatus comprising:

a performance input unit for performing and sequentially inputting a melody of a musical piece;

a real-time key judging unit for judging a key of the melody of the musical piece, while a user is performing the melody of the musical piece with the performance input unit, based on a history of pitches of the melody of the musical piece sequentially input by the performance input unit; and a non real-time key modifying unit for modifying the key decided by the real-time key judging unit after the user has finished the performance of the melody of the musical piece with the performance input unit.

2. The automatic key adjusting apparatus according to claim 1, wherein the non real-time key modifying unit comprises:

a decided-key database representing a final pitch of the melody of the musical piece and a relationship between the final pitch of the melody of the musical piece and the key; and a non real-time key judging unit for judging whether or not a key read from the decided-key database with respect to the final pitch of the melody accords with the key decided by the real-time key judging unit, and for determining that the key read from the decided-key database is a decided key, when it is determined that both the keys accord with each other.

3. The automatic key adjusting apparatus according to claim 2, further comprising:

a cadence judging unit for reading a candidate key from the decided-key database, wherein the candidate key is most closely related to the final pitch of the melody of the musical piece, and for judging whether or not a provisional chord terminates so as to meet a cadence, wherein the provisional chord is provisionally placed to a final interval of the musical piece based on the candidate key, when the non real-time key judging unit determines that the key read from the decided-key database does not accord with the key decided by the real-time key judging unit; and a decided-key judging unit for judging based on the result of the judgment made by the cadence judging unit, whether or not the candidate key is the decided key.

4. The automatic key adjusting apparatus according to claim 3, wherein the decided-key judging unit comprises:

a verifying unit for verifying if the candidate key causes any inconsistency in the musical piece from beginning to end, when the cadence judging unit determines that the provisional chord terminates so as to meet the cadence, and for determining that the candidate key is the decided key, when it is decided that the candidate key causes no inconsistency.

5. The automatic key adjusting apparatus according to claim 4, wherein the decided-key judging unit comprises:

a key placing unit for placing the decided key in an interval of the musical piece where no inconsistency exists, and placing the key decided by the real-time key judging unit in the musical piece excluding the above interval, when the verifying unit determines that the candidate key causes an inconsistency; and a modulation judging unit for judging whether a relationship between the key placed in a beginning interval of the musical piece and the key placed at an interval other than the beginning interval of the musical piece is ascending or not, and for determining that both the key placed in the beginning interval and the key placed in the other interval are the decided keys, when it is determined that the relationship between the keys is ascending.

6. The automatic key adjusting apparatus according to claim 1, further comprising:

a relative key and borrowing chord database representing relationships between relative keys and borrowing chords;

wherein when plural keys are placed in the musical piece and an interval of the musical piece exists, where a not-verified key is placed, and a chord not in a relative key of the not-verified key is found in the interval, then it is decided that the not-verified key is the decided key.

7. The automatic key adjusting apparatus according to claim 1, wherein the real-time key judging unit comprises:

a storing unit having a register for storing, at least, tone names, tone-name groups corresponding to a history of the input melody of the musical piece, and candidate keys, based on information input by the performance input unit, and a first table storing diatonic scale notes in each key; and a key deciding unit for comparing the tone-name group corresponding to the history of the input melody of the musical piece with the first table to judge whether or not all the tone names contained in the history of the input melody of the musical piece are involved in a diatonic scale in some key, thereby narrowing a range of the candidate keys to be employed, thereby deciding a key for the musical piece, and storing the decided key in the register.

8. The automatic key adjusting apparatus according to claim 7, wherein the key deciding unit judges whether or not a tritone and a scale note lying among the tritone involved in the diatonic scale in the candidate key are contained in the tone-name group corresponding to the history of the input melody of the musical piece, thereby furthermore narrowing the range of the candidate keys to be employed, when plural candidate keys are left as a result of narrowing the range of the candidate keys.

9. The automatic key adjusting apparatus according to claim 7, wherein the key deciding unit determines that a key having a least number of key signatures is the key for the musical piece, when plural candidate keys are left as a result of narrowing the range of the candidate keys.

10. The automatic key adjusting apparatus according to claim 7, wherein the storing unit has a second table storing key-unique tritones and scale notes lying between the tritone among diatonic scale notes in each key; and the key deciding unit compares the tone-name group corresponding to the history of the input melody of the musical piece with the second table to judge whether or not tone names contained in the history of the melody of the musical piece accord with the tritone and the scale note in some key, thereby narrowing the range of the candidate keys to be employed, and decides a key to be employed for the musical piece, storing the decided key in the register.

11. The automatic key adjusting apparatus according to claim 7, wherein, when the range of the candidate keys has been narrowed down into one candidate key, the key deciding unit determines that such one candidate key is the decided key, storing said decided key in the register, and when the range of the candidate keys has not been narrowed down into one candidate key, the key deciding unit determines that a predetermined candidate key is a provisional key, storing the provisional key in the register.

12. The automatic key adjusting apparatus according to claim 7, further comprising:

a chord-name judging unit for deciding a current chord name based on the pitches corresponding to the melody of the musical piece and a previous chord name, and wherein, when the current chord name has a predetermined relationship with the key stored in the register, the key deciding unit obtains a new key based on the predetermined relationship between the current chord name and the key stored in the register.

13. The automatic key adjusting apparatus according to claim 12, wherein, when the current chord name is a chord of 7 having a relationship other than III7 or V7 in the key stored in the register, the key deciding unit calculates a difference between the key and a root tone of the current chord name, and adds the calculated difference and a semitone to the key to obtain a new key.

14. The automatic key adjusting apparatus according to claim 12, wherein, when the previous chord name is a pivot chord in the key stored in the register, and the current chord name corresponds to a related key of the pivot chord in a diatonic chord in a key following the pivot chord, the key deciding unit obtains the relative key as a new key.

15. The automatic key adjusting apparatus according to claim 12, wherein, when the current chord name is a chord of I or III in a key higher than the key stored in the register by a semitone, a whole tone, or a minor third, the key deciding unit obtains the key higher than the key stored in the register by the semitone, whole tone, or the minor third as a new key.

16. The automatic key adjusting apparatus according to claim 7, wherein the key deciding unit refers to major/minor information of selecting a major or minor stored in the storing unit to judge whether the decided key is a major key or a minor key.

17. The automatic key adjusting apparatus according to claim 1, wherein the real-time key judging unit comprises:

a storing unit having a register for storing, at least, tone names, tone-name groups corresponding to a history of the input melody of the musical piece, and candidate keys, based on the information input by the performance input unit, and a table storing key-unique tritones and scale notes lying between notes of the tritone among diatonic scale notes in each key; and a key judging unit for comparing the tone-name group corresponding to the history of the input melody of the musical piece with the table to judge whether or not tone names contained in the history of the melody of the musical piece accord with the tritone and the scale note in a key, thereby narrowing a range of the candidate keys to be employed, and for deciding a key for the musical piece, and storing the decided key in the register.

* * * * *